US006596452B2

(12) United States Patent
Magome et al.

(10) Patent No.: US 6,596,452 B2
(45) Date of Patent: Jul. 22, 2003

(54) MAGNETIC TONER AND IMAGE-FORMING METHOD MAKING USE OF THE SAME

(75) Inventors: Michihisa Magome, Shizuoka-ken (JP); Tsutomu Kukimoto, Kanagawa-ken (JP); Tsuyoshi Takiguchi, Kanagawa-ken (JP); Tatsuhiko Chiba, Kamakura (JP); Akira Hashimoto, Shizuoka-ken (JP); Keiji Komoto, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/788,399

(22) Filed: Feb. 21, 2001

(65) Prior Publication Data

US 2001/0028988 A1 Oct. 11, 2001

(30) Foreign Application Priority Data

| | | |
|---|---|---|
| Feb. 21, 2000 | (JP) | 2000-043671 |
| Mar. 27, 2000 | (JP) | 2000-086484 |
| Mar. 27, 2000 | (JP) | 2000-086486 |
| Dec. 27, 2000 | (JP) | 2000-399203 |

(51) Int. Cl.[7] ..... G03G 9/083; G03G 9/087; G03G 13/22

(52) U.S. Cl. ..... 430/106.2; 430/109.3; 430/109.4; 430/110.3; 430/114.4; 430/111.41; 430/122; 430/125; 430/126; 430/902

(58) Field of Search ..... 430/106.1, 106.2, 430/110.3, 108.23, 109.3, 109.4, 111.4, 111.41, 122, 125, 126, 902

(56) References Cited

U.S. PATENT DOCUMENTS

| | | | | |
|---|---|---|---|---|
| 4,530,894 A | | 7/1985 | Imamura et al. | |
| 4,620,987 A | | 11/1986 | Yamashita et al. | 427/131 |
| 4,769,676 A | | 9/1988 | Mukai et al. | 355/15 |
| 4,804,609 A | | 2/1989 | Imanaka et al. | |
| 4,820,603 A | | 4/1989 | Sakashita | |
| 4,843,424 A | | 6/1989 | Oda et al. | |
| 4,851,960 A | | 7/1989 | Nakamura et al. | |
| 5,014,089 A | | 5/1991 | Sakashita et al. | |
| 5,106,815 A | | 4/1992 | Akada et al. | 503/229 |
| 5,215,845 A | | 6/1993 | Yusa et al. | 430/122 |
| 5,282,007 A | | 1/1994 | Oshiumi | |
| 5,432,037 A | | 7/1995 | Nishikiori et al. | 430/126 |
| 5,450,180 A | | 9/1995 | Ohzeki et al. | |
| 5,480,755 A | | 1/1996 | Uchiyama et al. | |
| 5,508,139 A | * | 4/1996 | Tanaka et al. | 430/106.1 |

(List continued on next page.)

FOREIGN PATENT DOCUMENTS

| | | |
|---|---|---|
| EP | 1058157 A1 * | 12/2000 |
| JP | 54-43027 | 4/1979 |

(List continued on next page.)

*Primary Examiner*—Janis L. Dote
(74) *Attorney, Agent, or Firm*—Fitzpatrick, Cella, Harper & Scinto

(57) ABSTRACT

A magnetic toner comprising magnetic toner particles containing at least a binder resin, a magnetic material containing a magnetic iron oxide, and a release agent. The magnetic toner has a weight-average particle diameter of from 3 $\mu$m to 10 $\mu$m, a magnetization intensity (saturation magnetization) of from 10 $Am^2/kg$ to 50 $Am^2/kg$ (emu/g) under application of a magnetic field of 79.6 kA/m (1,000 oersteds), an average circularity of 0.970 or more, a ratio of weight-average particle diameter to number-average particle diameter, of 1.40 or less, iron and an iron compound which stand liberated from the magnetic toner particles at a liberation percentage of from 0.05% to 3.00%, and a resin component having a tetrahydrofuran-insoluble matter in an amount of from 3% by weight to 60% by weight. Also disclosed is an image-forming method making use of the magnetic toner.

57 Claims, 4 Drawing Sheets

U.S. PATENT DOCUMENTS

| | | | | |
|---|---|---|---|---|
| 5,669,126 | A | 9/1997 | Nagano et al. | 29/25.35 |
| 5,672,454 | A | 9/1997 | Sasaki et al. | |
| 5,948,584 | A | 9/1999 | Hashimoto et al. | |
| 5,976,755 | A | 11/1999 | Yoshida et al. | 430/126 |
| 6,077,636 | A | 6/2000 | Moriki et al. | 430/45 |
| 6,081,681 | A | 6/2000 | Nagase et al. | 399/174 |
| 6,128,456 | A | 10/2000 | Chigong et al. | 399/176 |

FOREIGN PATENT DOCUMENTS

| | | |
|---|---|---|
| JP | 54-84731 | 7/1979 |
| JP | 57-151952 | 9/1982 |
| JP | 59-133573 | 7/1984 |
| JP | 59-168458 | 9/1984 |
| JP | 59-200254 | 11/1984 |
| JP | 59-200256 | 11/1984 |
| JP | 59-200257 | 11/1984 |
| JP | 59-224102 | 12/1984 |
| JP | 60-69660 | 4/1985 |
| JP | 61-34070 | 2/1986 |
| JP | 61-141452 | 6/1986 |
| JP | 61-249059 | 11/1986 |
| JP | 61-275864 | 12/1986 |
| JP | 62-203182 | 9/1987 |
| JP | 62-258472 | 11/1987 |
| JP | 62-279352 | 12/1987 |
| JP | 63-133179 | 6/1988 |
| JP | 63-149669 | 6/1988 |
| JP | 63-235953 | 9/1988 |
| JP | 1-020587 | 1/1989 |
| JP | 1-112253 | 4/1989 |
| JP | 2/120865 | 5/1990 |
| JP | 2-123385 | 5/1990 |
| JP | 2-256064 | 10/1990 |
| JP | 2-302772 | 12/1990 |
| JP | 3-9045 | 2/1991 |
| JP | 4-9860 | 1/1992 |
| JP | 4-264453 | 9/1992 |
| JP | 5-2287 | 1/1993 |
| JP | 5-2289 | 1/1993 |
| JP | 5-53482 | 3/1993 |
| JP | 5-61383 | 3/1993 |
| JP | 5-66608 | 3/1993 |
| JP | 5-150539 | 6/1993 |
| JP | 5-346682 | 12/1993 |
| JP | 7-99422 | 4/1995 |
| JP | 7-209904 | 8/1995 |
| JP | 8-22191 | 1/1996 |
| JP | 2681791 | 8/1997 |
| JP | 2749122 | 5/1998 |
| JP | 2749234 | 5/1998 |
| JP | 63-250660 | 10/1998 |
| JP | 10-307421 | 11/1998 |
| JP | 10-307455 | 11/1998 |
| JP | 10-307456 | 11/1998 |
| JP | 10-307457 | 11/1998 |
| JP | 10-307458 | 11/1998 |
| JP | 11-38678 | 2/1999 |
| JP | 11-15206 | 7/1999 |

* cited by examiner

MAGNETIC TONER AND IMAGE-FORMING METHOD MAKING USE OF THE SAME

BACKGROUND OF THE INVENTION

1. Field of the Invention

This invention relates to a magnetic toner for rendering latent images visible in image-forming processes such as electrophotography, electrostatic recording, magnetic recording and toner jetting, and also relates to an image-forming method making use of the magnetic toner.

2. Related Background Art

A number of methods are conventionally known as electrophotography. In general, copies or prints are obtained by forming an electrostatic latent image on an electrostatic latent image bearing member (hereinafter also "photosensitive member") by utilizing a photoconductive material and by various means, subsequently developing the electrostatic latent image by the use of a toner to form a toner image as a visible image, transferring the toner image to a transfer medium such as paper as occasion calls, and then fixing the toner image to a recording medium by the action of heat, pressure, or heat-and-pressure.

Apparatus for such image formation include copying machines and printers. In recent years, as printers, LED printers or LBP printers are prevailing in the recent market. As a trend of techniques, there is a tendency toward higher resolution. More specifically, those which hitherto have a resolution of 240 dpi or 300 dpi are being replaced by those having a resolution of 600 dpi, 800 dpi or 1,200 dpi. Accordingly, with such a trend, developing systems are now required to achieve a high minuteness. Copying machines have also made progress to have high functions, and hence they trend toward digital systems. In this trend, chiefly employed is a method in which electrostatic latent images are formed by using a laser. Hence, the copying machines also have come to have a high resolution. Also, with an improvement in image quality, it is much sought to achieve a higher speed and a longer service life.

In developing systems used in such printers and copying machines, toner images formed on the photosensitive member in the step of development are transferred to a recording medium in the step of transfer via, or not via, an intermediate member. Any transfer residual toner and fogging toner at non-image areas, left on the photosensitive member are removed in the step of cleaning, and is stored in a waste toner container. In this cleaning step, blade cleaning, fur brush cleaning, roller cleaning and so forth are conventionally used. When viewed from the standpoint of apparatus, the whole apparatus must be made larger in order to provide such a cleaning means. This has been a bottleneck in attempts to make apparatus compact. In addition, from the viewpoint of ecology, a system that may produce no waste toner is long-awaited in the sense of effective utilization of toner. Thus, it is sought to provide a toner having a high transfer efficiency and less causing fog.

From the viewpoint of making apparatus compact, one-component developing systems are preferable because they require no carrier particles such as ferrite particles or iron powder which are required in two-component developing systems. Also, since in the two-component developing systems the concentration of toner in two-component developers must be kept constant, a device for detecting toner concentration so as to supply the toner in the desired quantity is required, resulting in a large size for the developing assemblies. In the one-component developing system, on the other hand, such a device is not required, and hence the developing assemblies can also be made small and light-weight as being preferable. Magnetic toners used in such image-forming processes are commonly chiefly composed of a binder resin and a magnetic material and besides contain additives such as a charge control agent and a release agent which are used to bring out properties necessary as toners. As a colorant of the magnetic toner, the magnetic material is used as it is as the colorant, or a non-magnetic inorganic compound, organic pigment or dye is used together with the magnetic material. As the release agent, used are waxes sparingly compatible with the binder resin, as exemplified by low-molecular weight polyethylene and low-molecular weight polypropylene.

However, developing systems making use of an insulating magnetic toner have a problem concerning the insulating magnetic toner used. The problem is that, in insulating magnetic toner particles, a finely powdery magnetic material is mixed and dispersed in a considerable quantity, and it affects fluidity and triboelectric chargeability of the magnetic toner because magnetic fine particles constituting the magnetic material stand partly uncovered to the surfaces of toner particles, consequently causing variation or deterioration of various performances required for the magnetic toner, in relation to developing performance and running performance of the magnetic toner. This is presumed to be due to the fact that magnetic fine particles having a relatively lower electrical resistance than the resin constituting the magnetic toner particles are present at the surfaces of the magnetic fine particles. Also, the chargeability of the magnetic toner also has a great influence on development and transfer, and is closely concerned with image quality. Accordingly, it is sought to provide a magnetic toner which can stably provide a high charge quantity.

To cope with this problem, proposals concerning magnetic iron oxides to be contained in magnetic toners are hitherto made, but there is room for further improvement.

For example, Japanese Patent Application Laid-Open No. 62-279352 discloses a magnetic toner containing a magnetic iron oxide incorporated with silicon element. In such a magnetic iron oxide, the silicon element is intentionally brought into existence inside the magnetic iron oxide, but there is room for further improvement in the fluidity of the magnetic toner containing the magnetic iron oxide. Japanese Patent Publication No. 3-9045 discloses adding a silicate to control the shape of magnetic iron oxide to be spherical. In the magnetic iron oxide thereby obtained, the silicon element is rich distributed inside the magnetic iron oxide fine particles because of the use of the silicate for the controlling of particle shape of magnetic fine particles and the silicon element is less present at the surfaces of the magnetic iron oxide fine particles, thus, because of a high smoothness of the magnetic iron oxide fine particles, the fluidity of the magnetic toner can be improved to a certain extent. However, it is preferable to more improve the close adhesion between the binder resin constituting magnetic toner particles and the magnetic iron oxide. Japanese Patent Application Laid-Open No. 61-34070 discloses a process for producing triiron tetraoxide by adding a hydroxosilicate solution to triiron tetraoxide in the course of oxidation reaction. The triiron tetraoxide fine particle obtained by this process has silicon element in the vicinity of its surface, but the silicon element is present in layer in the vicinity of the surface of the triiron tetraoxide fine particles. Hence, there is a problem that the surface is weak to mechanical shock such as friction.

Meanwhile, toners are produced by melt-mixing a binder resin, colorant and so forth and uniformly dispersing them, followed by pulverization by means of a fine griding mill and then classification by means of a classifier to obtain toners having the desired particle diameters (pulverization process). To make toners have fine particle diameters, there is a limit to the range of material selection. For example, colorant-dispersed resin compositions must be brittle enough to be pulverizable by means of economically available production apparatus. Since the colorant-dispersed resin compositions are made brittle because of such a requirement, particles having particle diameters in a broad range tend to be formed when such compositions are actually pulverized at a high speed, so that, in particular, fine particles (particles having been pulverized in excess) having a relatively large proportion are formed in a large quantity and also the magnetic fine particles tend to come off from the resin during pulverization. Moreover, such highly brittle materials tend to be further pulverized or powdered when used as developing toners in copying machines or printers.

As a countermeasure therefor, Japanese Patent Application Laid-Open No. 2-256064 disclose, in the production of pulverization toners, a magnetic toner production process in which magnetic fine particles standing free are removed by classification after pulverization. In pulverization processes, however, the magnetic iron oxide fine particles essentially come to stand uncovered to the surfaces of magnetic toner particles, and hence a problem tends to arise in fluidity of magnetic toner particles and in charging stability in severe environment, resulting in a low transfer performance. Thus, there is further room for improvement.

In the pulverization process, it is also difficult to uniformly disperse solid fine particles such as a magnetic powder and a colorant in the resin. Depending on the degree of such dispersion, this can be one of the causes of an increase in fog and a decrease in image density.

In the pulverization process, making toner particles finer in order to achieve high minuteness and high image quality accompanies a lowering of uniform chargeability and fluidity of toners.

In order to overcome such problems of toners which are ascribable to the pulverization process and further to satisfy requirements stated above, proposed are processes for producing toner particles by suspension polymerization.

Toner particles produced by suspension polymerization (hereinafter "synthetic toner particles" or "synthetic toner") can readily be produced in fine particles. In addition, toner particles obtained have a spherical shape and hence have a superior fluidity. This is advantageous for achieving a high image quality.

However, incorporation of magnetic fine particles into such synthetic toner particles tends to make the toner particles have a low fluidity and a low charging performance, tending to cause a lowering of developing performance. This is because the magnetic fine particles are commonly hydrophilic and hence tend to be present at toner particle surfaces in the suspension polymerization, which makes use of an aqueous medium. This is also because, in the step of granulation carried out when magnetic synthetic toner particles are produced, hydrophilic magnetic fine particles may partly move to the aqueous medium to become present as free magnetic fine particles having come off from the magnetic toner particles. In order to solve this problem, it is important to modify the surface properties the magnetic fine particles have.

To improve dispersibility and enclosure property of the magnetic fine particles in the synthetic toner particles, proposals are made in a large number in regard to surface modification of the magnetic fine particles. For example, Japanese Patent Applications Laid-Open No. 59-200254, No. 59-200256, No. 59-200257 and No. 59-224102 disclose techniques for treating magnetic fine particles with silane coupling agents of various types, and Japanese Patent Application Laid-Open No. 63-250660 discloses a technique for treating silicon-element-containing magnetic fine particles with a silane coupling agent.

Such treatment brings about a certain improvement in the dispersibility in the magnetic toner particles. However, the magnetic fine particle surfaces must be made uniformly hydrophobic, and the uncovering of the magnetic fine particles to the magnetic toner particle surfaces must be more controlled.

Meanwhile, with regard to the quantity of magnetic fine particles at the magnetic toner particle surfaces, a toner having a special structure in which any magnetic fine particles are not present in toner particle surface layers is proposed as disclosed in Japanese Patent Application Laid-Open No. 7-209904. This toner is advantageous in that it ensures superior enclosure of magnetic fine particles and can be free from any uncovering of the magnetic fine particles to the magnetic toner particle surfaces. However, such a toner must be produced by a complicate process, and can be produced with difficulty in an industrial manufacture scale. Also, its repeated use over a long period of time in an environment of low humidity may cause a lowering of image quality which is due to charge-up of the magnetic toner. Thus, more improvement has been necessary for the stability of charging of the magnetic toner.

Further, a technique for making the particle diameter of the magnetic toner particles smaller to achieve higher image quality is disclosed in Japanese Patent Application Laid-Open No. 1-112253. However, with the magnetic toner particles having such a smaller diameter, it is more difficult to obtain the uniform dispersion of the magnetic powder and the enclosure thereof, tending to give rise to the above-mentioned various problems.

For the purpose of improving the fluidity and charging performance of toners, methods are also proposed in which inorganic fine powder is added as an external additive, and are put into wide use. For example, Japanese Patent Applications Laid-Open No. 5-66608, No. 4-9860 and so forth disclose external addition of an inorganic fine powder having been subjected to hydrophobic treatment or an inorganic fine powder having been subjected to hydrophobic treatment and thereafter further to treatment with a silicone oil. Japanese Patent Applications Laid-Open No. 61-249059, No. 4-264453 and No. 5-346682 disclose use of a hydrophobic-treated inorganic fine powder and a silicone-oil-treated inorganic fine powder in combination. Such methods are known in the art.

Methods in which conductive fine particles are externally added as the external additive are also proposed in a large number. For example, carbon black as conductive fine particles is known to be used as an external additive for the purpose of providing conductivity to toners or controlling any excess charging of toners to make their triboelectric distribution uniform. Also, Japanese Patent Applications Laid-Open No. 57-151952, No. 59-168458 and No. 60-69660 disclose external addition of conductive fine particles such as tin oxide, zinc oxide and titanium oxide, respectively, to high-resistance magnetic toner particles. Japanese Patent Applications Laid-Open No. 61-275864, No. 62-258472, No. 61-141452 and No. 2-120865 disclose addition of graphite, magnetite, polypyrrole conductive particles or polyaniline conductive particles to toners.

These proposals, however, have room for further improvement to solve the above problems, when toner particles having small particle diameters are used in order to achieve a higher resolution.

In recent years, as copying machines and printers are being made compact, it has also become an important subject to achieve space saving, cost reduction and low power consumption. With regard to fixing assemblies, too, they have become required to be compact, structurally simple, and small power consumption. With this trend, toners are made to have a low viscosity at the time of melting to enlarge the area for their adhesion to fixing base materials or toner particles are incorporated with a release agent so that the toners can exhibit a sufficient fixing performance at a low amount of heat and a low pressure. Accordingly, binder resins used are required to have a low glass transition point (Tg) and a low molecular weight. However, for toners composed chiefly of soft components, it is difficult to achieve both fixing performance and high-temperature anti-offset properties simultaneously. Such toners also have a problem that they tend to cause a lowering of developing performance during long-term service or to stick or cling to the photosensitive member.

Meanwhile, with regard to the improvement of fixing performance, various proposals have been made from old times. For example, Japanese Patent Publication No. 51-23354 discloses a pulverization toner improved in high-temperature anti-offset properties and low-temperature fixing performance, obtained by polymerizing a monomer such as styrene in the presence of a cross-linking agent and a molecular-weight modifier to obtain an appropriately cross-linked resin, and kneading this resin and a colorant such as carbon black, followed by pulverization. Japanese Patent No. 2681791 discloses a pulverization toner obtained by melt-kneading a styrene type binder resin containing a THF-insoluble matter in an mount of 10 to 60% by weight based on the weight of the resin, together with a charge control agent and a wax, followed by pulverization. These publications teach that molecular chains of the THF-insoluble matter (cross-linked component) of the binder resin are cut by melt kneading to form a high-molecular weight component, to thereby obtain a toner improved in both high-temperature anti-offset properties and low-temperature fixing performance. However, as a result of such thermal and mechanical cutting of the insoluble matter of the binder resin, soluble components formed by the cutting of molecular chains may have a fairly broad molecular weight distribution. Hence, medium-molecular-weight components which may damage low-temperature fixing performance also tend to be formed in a large quantity.

Such pulverization toner particles further have a problem that they have so low a circularity as to have a low transfer efficiency. Also, since the magnetic fine particles stand uncovered to toner particle surfaces in a large number, the toners tends to have a low fluidity and a low uniform chargeability.

On the other hand, in the case of the synthetic toners, different from the pulverization toners, toner particles can directly be produced without the step of melt kneading, and hence molecular chains of the insoluble matter (cross-linked component) formed at the time of polymerization are by no means cut. Thus, they are advantageous in that toner particles having very high anti-offset properties can be obtained, but on the other hand the insoluble matter tends to damage the low-temperature fixing performance. Accordingly, the low-temperature fixing performance and the high-temperature anti-offset properties must be balanced by controlling the insoluble matter. Also, when the magnetic fine particles are made insufficiently hydrophobic, the magnetic fine particles tend to stand uncovered to the toner particle surfaces in a large number, tending to make fixing performance poor and cause a deterioration of fixing assemblies.

Japanese Patent Application Laid-Open No. 11-38678 discloses non-magnetic synthetic toner particles having 0 to 20% of components having a molecular weight of 1,000,000 or more and 0 to 60% of THF-insoluble matter, the total of the both being 1 to 60%. This publication, however, discloses a technique concerning non-magnetic toner particles, and there is room for improvement in respect of magnetic synthetic toner particles containing magnetic fine particles. In addition, Japanese Patent No. 2749234 discloses a process for producing magnetic toner particles in which a wax component in toner particles is present in a fibrous form. As disclosed in this publication, a polymerizable cross-linking agent is added in a monomer composition containing magnetic particles, which is then polymerized in the presence of an azo type polymerization initiator to obtain magnetic synthetic toner particles. Also, Japanese Patent No. 2749122 discloses a method of surface-treating magnetic particles with a polymer having a specific reactive group. As disclosed in this publication, a polymerizable cross-linking agent is added in a monomer composition containing magnetic particles, which is then polymerized in the presence of an azo type polymerization initiator to obtain magnetic synthetic toner particles. However, as presumed from the amount of the cross-linking agent, the type and amount of the polymerization initiator and the polymerization temperature which are described in these publications, the medium molecular weight component produced because of any excess formation of THF-insoluble matter or its cross-linking in a very weak state may be in a large proportion. Hence, in the case of the magnetic toner containing the magnetic fine particles in a large quantity, there is a problem on fixing performance. Also, in the magnetic synthetic toner particles obtained by the processes disclosed in these publications, the hydrophobic treatment of the magnetic fine particles used is insufficient, and there are problems also on fluidity and charging performance. Moreover, the achievement of both developing performance and fixing performance is also insufficient.

With regard to the image-forming method, as methods by which the electrostatic latent image is formed into a visible image, developing systems such as cascade development, magnetic brush development and pressure development are known in the art. Another method is also known in which, using a magnetic toner and using a rotary sleeve internally provided with a magnet, the magnetic toner is caused to fly across a photosensitive member and a developing sleeve by the aid of an electric field. For example, Japanese Patent Application Laid-Open No. 54-43027 discloses a method in which a magnetic toner is thinly coated on a magnetic toner-carrying member and this is triboelectrically charged, which is then served to develop an electrostatic latent image under application of a magnetic field. According to this method, the thin coating of a magnetic toner on a magnetic toner-carrying member enables the magnetic toner to be sufficiently triboelectrically charged. Moreover, the electrostatic latent image is developed while the magnetic toner is supported by the action of magnetic force. Hence, the magnetic toner can be kept from spreading to non-image areas, so that any fog can be kept from occurring and highly minute images can be obtained. Also, with regard to transfer efficiency, use of a toner having a uniform charge quantity distribution brings about a high transfer efficiency, but it is sought to make further improvement.

Spherical toner particles are esteemed to have a high transfer efficiency. Concerning such particles, Japanese Patent Application Laid-Open No. 61-279864 discloses a proposal on a toner whose shape factors SF-1 and SF-2 are specified. Japanese Patent Application Laid-Open No. 63-235953 discloses a proposal on a magnetic toner made spherical by the action of mechanical impact force. However, toners are sought to be more improved in transfer efficiency.

Such spherical toner particles have on the one hand an advantage that they have a higher transfer efficiency than toner particles produced by pulverization, but on the other hand have a nature that they can be removed by cleaning with difficulty because of their sphericity. Moreover, since toner particles trend toward smaller particle diameters as state previously, toner particles may escape at the time of cleaning, and it has become more difficult to remove transfer residual toner completely by cleaning. However, an improvement of cleaning assemblies can keep the toner particles from escaping to a level that may cause no great problem. In image-forming methods having a conventional corona charging system, images having no problem in practical use can be formed.

However, in recent years, from the viewpoint of environmental protection, in place of the primary charging and transfer process which have utilized corona discharging conventionally used, it is becoming prevailing to employ primary charging (contact charging) and transfer process (contact transfer) each of which make use of a member brought into contact with the photosensitive member surface, having great advantages of low ozone and low power consumption. For example, Japanese Patent Applications Laid-Open No. 63-149669 and No. 2-123385 disclose processes concerning the contact charging process and contact transfer process. In these processes, a conductive flexible charging roller is brought into contact with a photosensitive member and the photosensitive member is uniformly charged applying a voltage to the conductive roller, followed by exposure and development to form a toner image. Thereafter, another conductive roller to which a voltage is kept applied is pressed against the photosensitive member, during which a transfer medium is passed between them, and the toner image held on the photosensitive member is transferred to the transfer medium, followed by the step of fixing to obtain a fixed copy image.

However, in such a contact charging process and a contact transfer process, too, there is room for further improvement. Stated specifically, in the case of the contact charging, the charging member is kept in pressure contact with the surface of the photosensitive member by pressing the former against the latter. Hence, the presence of any transfer residual toner tends to lower the contact between the contact charging member and the photosensitive member to tend to lower charging performance. In reverse development, the toner tends to spread to non-image areas to tend to cause fog. Also, any accumulation of toner on the charging performance tends to make it difficult to charge the photosensitive member uniformly, tending to cause a decrease in image density or cause coarse images. In addition, since the charging member is kept in pressure contact, melt-adhesion of toner tends to occur. These tendencies appear more remarkably as the transfer residual toner is in a large quantity.

Then, in the case of the contact transfer, the transfer member is brought into contact with the photosensitive member through the transfer medium at the time of transfer, and hence the toner image is pressed when the toner image formed on the photosensitive member is transferred to the transfer medium, tending to cause a problem of partial faulty transfer, which is called "blank areas caused by poor transfer". Moreover, as a trend of techniques in recent years, there is a demand for developing systems of higher resolution and higher minuteness. To meet such a demand, toners are directed to have a smaller particle diameter. However, as toners are made to have a smaller particle diameter, the attraction force (e.g., mirror force or van der Waals force) of toner particles on the photosensitive member may increase to tend to result in an increase in the transfer residual toner, tending to cause faulty transfer.

Thus, in the image-forming methods making use of the contact charging process and contact transfer process which are very preferable taking account of environment, it is sought to bring forth a magnetic toner, and an image-forming method, which promise a high transfer performance and a superior charging stability and may hardly cause melt-adhesion of toner.

Meanwhile, with regard to the toner having a high transfer efficiency as stated above, also proposed is a technique called a development-cleaning (also called cleaning-at-development) system or cleanerless system in which development and cleaning are carried out in the same step.

Disclosure of conventional techniques concerning the development-cleaning or cleanerless system is, as seen in Japanese Patent Application Laid-Open No. 5-2287, focused on positive memory or negative memory appearing on images because of an influence of the transfer residual toner. However, in these days where electrophotography is utilized on and on, it has become necessary to transfer toner images to various recording mediums. In this sense, it is sought to make further adaptation to various recording mediums.

The prior art having disclosed the cleanerless system is seen in Japanese Patent Applications Laid-Open No. 59-133573, No. 62-203182, No. 63-133179, No. 64-20587, No. 2-302772, No. 5-2289, No. 5-53482 and No. 5-61383. These, however, neither mention any desirable image-forming methods nor refer to how the toner be constituted.

As developing systems in which the development-cleaning system or cleanerless system is preferably applied, in conventional development-cleaning systems basically having no cleaning assembly, it has been considered essential for the system to be so made up that the photosensitive member surface is rubbed with the toner and toner-carrying member. Accordingly, studies have largely made on contact developing systems in which the toner or toner-carrying member comes into contact with an image-bearing member. This is because, in order to collect the transfer residual toner in a developing means, it is considered advantageous for the system to be so made up that the toner or toner-carrying member comes into contact with and rub the image-bearing member. However, in the development-cleaning system or cleanerless system making use of a contact development system, its long-term service tends to cause deterioration of toner, deterioration of toner-carrying member surface and deterioration or wear of photosensitive member surface, but any satisfactory solution has not been made for running performance. Accordingly, it is sought to provide a development-cleaning system according to a non-contact developing system.

Here, consider an instance in which the contact developing system is applied to a image-forming method employing the development-cleaning system or cleanerless system. In the image-forming method employing the development-cleaning system or cleanerless system, any cleaning member is provided and hence the transfer residual toner remaining on the photosensitive member surface comes into contact with the contact charging member as it is, to come to adhere to or mix in the contact charging member. Also, in the case of a charging system predominantly governed by a discharge charging mechanism, the transfer residual toner tends to adhere to the charging member because of a deterioration due to discharge energy. When insulating toners commonly used adhere to or mix in the contact charging member, the charging performance tends to lower.

In the case of the charging system predominantly governed by a discharge charging mechanism, the charging performance of the member to be charged tends to lower abruptly around the time when a toner layer having adhered to the contact charging member surface comes to have a resistance which may obstruct the discharge voltage. On the other hand, in the case of a charging system predominantly governed by a direct injection charging mechanism, the charging performance of the member to be charged may lower where the transfer residual toner having adhered or mixed has lowered the probability of contact between the contact charging member surface and the member to be charged.

This lowering of uniform charging performance of the member to be charged appears as a lowering of contrast and uniformity of electrostatic latent images after imagewise exposure to tend to cause a decrease in image density or make fog occur seriously.

In the image-forming method employing the development-cleaning system or cleanerless system, the point is that the charge polarity and charge quantity of the transfer residual toner on the photosensitive member is controlled so that the transfer residual toner can stably be collected in the step of development and the collected toner may not make the developing performance poor. Accordingly, the charge polarity and charge quantity of the transfer residual toner on the photosensitive member is controlled by means of the charging performance.

This will be described specifically taking the case of a commonly available laser beam printer. In the case of reverse development making use of a charging member for applying a voltage with negative polarity, a negatively chargeable photosensitive member and a negatively chargeable toner, in the transfer step the toner image is transferred to the recording medium by means of a positively chargeable transfer member. The charge polarity of the transfer residual toner varies from positive to negative because of its relation to the type of the recording medium (differences in thickness, resistance, dielectric constant and so forth) and the areas of images. However, the charging member having a negative polarity, used to charge the negatively chargeable photosensitive member, can uniformly adjust the charge polarity to the negative side even if even the polarity of the transfer residual toner has been shifted to the positive side in the transfer step. Hence, when the reversal development is employed as the developing system, the transfer residual toner, which stands negatively charged, remains at light-area potential areas to be developed by toner. At dark-area potential areass not to be developed by toner, the toner is attracted toward the toner carrying member in relation to the development electric field and is collected without remaining on the photosensitive member having a dark-area potential. That is, the development-cleaning system can be established by controlling the charge polarity of transfer residual toner simultaneously with the charging of the photosensitive member by means of the charging member.

However, where the transfer residual toner has adhered to or mixed in the contact charging member beyond the contact charging member's capacity to control toner's charge polarity, it becomes difficult to uniformly adjust the charge polarity of the transfer residual toner. Also, even where the transfer residual toner has been collected on the toner-carrying member by mechanical force such as rubbing, the transfer residual toner may adversely affect the charging performance of toner on the toner-carrying member, resulting in a lowering of developing performance, unless its charge has not uniformly been adjusted.

More specifically, in the image-forming method employing the development-cleaning system or cleanerless system, the charge control performance at the time the transfer residual toner passes the charging member and the manner in which the transfer residual toner adheres to or mixes in the charging member are closely concerned with the running performance and image quality characteristics.

In order to prevent uneven charging to effect stable and uniform charging, the contact charging member may be coated with a powder on its surface coming into contact with the surface of the member to be charged. Such constitution is disclosed in Japanese Patent Publication No. 7-99442.

The contact charging member (charging roller) is follow-up rotated as the member to be charged (photosensitive member) is rotated (without no velocity differential drive), and hence may remarkably less cause ozone products compared with corona charging assemblies such as Scorotron. However, the principle of charging is still chiefly the discharge charging mechanism like the case of the roller charging mentioned previously. In particular, a voltage formed by superimposing AC voltage on DC voltage is applied in order to attain more stable charging uniformity, and hence the ozone products caused by discharging may more greatly occur. Accordingly, when the apparatus is used over a long period of time, difficulties such as smeared images due to ozone products tend to come out. Moreover, when applied in cleanerless image-forming apparatus, any inclusion of the transfer residual toner makes it difficult for the powder coated, to stand adhered uniformly to the charging member, so that the effect of carrying out uniform charging may lower.

Japanese Patent Application Laid-Open No. 5-150539 also discloses that, in an image-forming method making use of contact charging, at least image-developing particles and conductive fine particles having an average particle diameter smaller than that of the image-developing particles are contained in a toner in order to prevent any charging obstruction which may be caused when toner particles or silica particles having not completely be removed by a cleaning means such as a cleaning blade come to adhere to and accumulate on the surface of the charging means during repetition of image formation for a long time. However, the contact charging used here, or proximity charging, applies the discharge charging mechanism, which is not the direct injection charging mechanism, and has the above problem ascribable to the discharge charging. Moreover, when applied in the cleanerless image-forming apparatus, nothing is taking into consideration about any of the influence on charging performance that is exercised when the conductive fine particles and transfer residual toner pass the charging step in a larger quantity than the apparatus having a cleaning mechanism, the influence on the collection of these large-quantity conductive fine particles and transfer residual toner in the developing step, and the influence on toner's developing performance that is exercised by the conductive fine particles and transfer residual toner thus collected.

Furthermore, when the direct injection charging mechanism is applied in the contact charging, the conductive fine particles can not be fed to the contact charging member in necessary quantity to tend to cause faulty charging due to the influence of the transfer residual toner.

In the proximity charging, it is also difficult to uniformly charge the photosensitive member because of the large-quantity conductive fine particles and transfer residual toner, and the effect of leveling patterns of the transfer residual toner can not be obtained, to cause pattern ghost because the transfer residual toner may shut out pattern-imagewise exposure light. In-machine contamination due to toner may further occur when a power source is instantaneously put off or paper jam occurs during image formation.

In the image-forming method employing the development-cleaning system, development-cleaning performance can be improved by improving charge control performance required when the transfer residual toner passes the charging member. As a proposal therefor, Japanese Patent Application Laid-Open No. 11-15206 discloses an image-forming method making use of a toner having toner particles containing specific carbon black and a specific azo type iron compound and having inorganic fine powder. It is also proposed, in the image-forming method employing the development-cleaning system, to improve development-cleaning performance by reducing the quantity of transfer residual toner, using a toner having a superior transfer efficiency the shape factors of which have been specified. However, the contact charging used here also applies the discharge charging mechanism, which is not the direct injection charging mechanism, and has the above problem ascribable to the discharge charging. Moreover, these proposals may be effective for keeping the charging performance of the contact charging member from lowering because of the transfer residual toner, but can not be expected to be effective for positively improving the charging performance.

In addition, among commercially available electrophotographic printers, image-forming apparatus are also available which are designed for carrying out the development-cleaning system, in which a roller member coming into contact with the photosensitive member is provided between the transfer step and the charging step so that the performance of collecting the transfer residual toner at development can be assisted or controlled. Such image-forming apparatus have good development-cleaning performance and the waste toner can greatly be reduced, but involve a high cost and may damage the advantage inherent in the development-cleaning system also in view of compact construction.

As countermeasures for these, Japanese Patent Application Laid-Open No. 10-307456 discloses an image-forming apparatus in which a toner containing conductive charge-accelerating particles having particle diameter which is ½ or smaller than average particle diameter of toner particles or toner is applied in an image-forming method employing the development-cleaning system making use of the direct injection charging mechanism. According to this proposal, an image-forming apparatus for carrying out the development-cleaning system can be obtained, which can greatly reduce the quantity of waste toner and is advantageous for making the apparatus compact at a low cost, and good images are obtainable without causing any faulty charging and any shut-out or dispersion of imagewise exposure light.

Japanese Patent Application Laid-Open No. 10-307421 also discloses an image-forming apparatus in which a toner containing conductive particles having particle diameter which is 1/50 to ½ of average particle diameter of the toner is applied in an image-forming method employing the development-cleaning system making use of the direct injection charging mechanism and the conductive particles are made to have a transfer accelerating effect. Japanese Patent Application Laid-Open No. 10-307455 still also discloses that, a conductive fine powder is controlled to have particle diameter not larger than the size of one pixel of constituent pixels, and the conductive fine powder is controlled to have particle diameter of from 10 nm to 50 $\mu$m in order to attain better charging uniformity.

Japanese Patent Application Laid-Open No. 10-307457 discloses that, taking account of human visual sensation, conductive fine particles are controlled to have particle diameter of about 5 $\mu$m or smaller, and preferably from 20 nm to 5 $\mu$m, in order to make any influence of faulty transfer on images visually recognizable with difficulty.

Japanese Patent Application Laid-Open No. 10-307458 also discloses an image-forming method which employs the development-cleaning system making use of the direct injection charging mechanism and in which a conductive fine powder is controlled to have particle diameter not larger than the average particle diameter of a toner to thereby prevent the conductive fine powder from obstructing the behavior of the toner at the time of development or prevent development bias from leaking through the conductive fine powder, and the conductive fine is controlled to have particle diameter larger than 0.1 $\mu$m to thereby eliminate a difficulty that the conductive fine powder may become buried in the image-bearing member to shut out imagewise exposure light, thus superior image recording can be materialized.

Japanese Patent Application Laid-Open No. 10-307456 discloses an image-forming apparatus which carries out the development-cleaning system and in which a conductive fine powder is externally added to toner particles so that the conductive fine powder contained in the toner particles may adhere to an image-bearing member in the step of development, at least at a contact zone between a flexible contact charging member and the image-bearing member, and may remain and be carried on the image-bearing member also after the step of transfer so as to stand between them, to thereby obtain good images without causing neither faulty charging nor shut-off of imagewise exposure light.

In all these proposals, however, there is room for further improvement in stable performances required when the apparatus are repeatedly used over a long period of time and in performances required when toner particles having a small particle diameter are used in order to achieve a higher resolution.

SUMMARY OF THE INVENTION

An object of the present invention is to provide a magnetic toner having solved the problems the prior art has had, and an image-forming method making use of the magnetic toner.

Another object of the present invention is to provide a magnetic toner having a good fixing performance, having superior environmental stability and charging stability and can form images in a high density and a high minuteness even over long-term service, and an image-forming method making use of such a magnetic toner.

Still another object of the present invention is to provide an image-forming method which can well carry out the development-cleaning system.

A further object of the present invention is to provide an image-forming method which can stably achieve a good charging performance and enables image formation by the cleanerless system.

To achieve the above objects the present invention provides a magnetic toner comprising magnetic toner particles containing at least a binder resin, a magnetic material containing a magnetic iron oxide, and a release agent.

the magnetic toner having;

a weight-average particle diameter of from 3 μm to 10 μm;

a magnetization intensity (saturation magnetization) of from 10 $Am^2/kg$ to 50 $Am^2/kg$ (emu/g) under application of a magnetic field of 79.6 kA/m (1,000 oersteds);

an average circularity of 0.970 or more;

a ratio of weight-average particle diameter to number-average particle diameter, of 1.40 or less;

iron and an iron compound which stand liberated from the magnetic toner particles at a liberation percentage of from 0.05% to 3.00%; and a resin component having a tetrahydrofuran (THF)-insoluble matter in an amount of from 3% by weight to 60% by weight.

The present invention also provides an image-forming method comprising;

a charging step of charging an image-bearing member electrostatically by applying a voltage to a charging member kept in contact with the image-bearing member, forming a contact zone between them;

an electrostatic latent image forming step of forming an electrostatic latent image on the charged surface of the image-bearing member;

a developing step of forming a toner image by developing the electrostatic latent image by causing a magnetic toner to move to the electrostatic latent image at a developing zone where an alternating electric field is kept formed; the developing zone being formed between the image-bearing member for holding thereon the electrostatic latent image and a toner-carrying member for carrying the magnetic toner on its surface which are face to face disposed leaving a preset space between them, and a layer of the magnetic toner being formed on the surface of the toner-carrying member in a thickness smaller than that space; and a transfer step of transferring the toner image to a transfer material via, or not via, an intermediate transfer member;

the steps being repeated to form images;

wherein the magnetic toner comprises magnetic toner particles containing at least a binder resin, a magnetic material containing a magnetic iron oxide, and a release agent.

the magnetic toner having;

a weight-average particle diameter of from 3 μm to 10 μm;

a magnetization intensity (saturation magnetization) of from 10 $Am^2/kg$ to 50 $Am^2/kg$ (emu/g) under application of a magnetic field of 79.6 kA/m (1,000 oersteds);

an average circularity of 0.970 or more;

a ratio of weight-average particle diameter to number-average particle diameter, of 1.40 or less;

iron and an iron compound which stand liberated from the magnetic toner particles at a liberation percentage of from 0.05% to 3.00%; and a resin component having a tetrahydrofuran (THF)-insoluble matter in an amount of from 3% by weight to 60% by weight.

DESCRIPTION OF THE PREFERRED EMBODIMENTS

Figure 1:
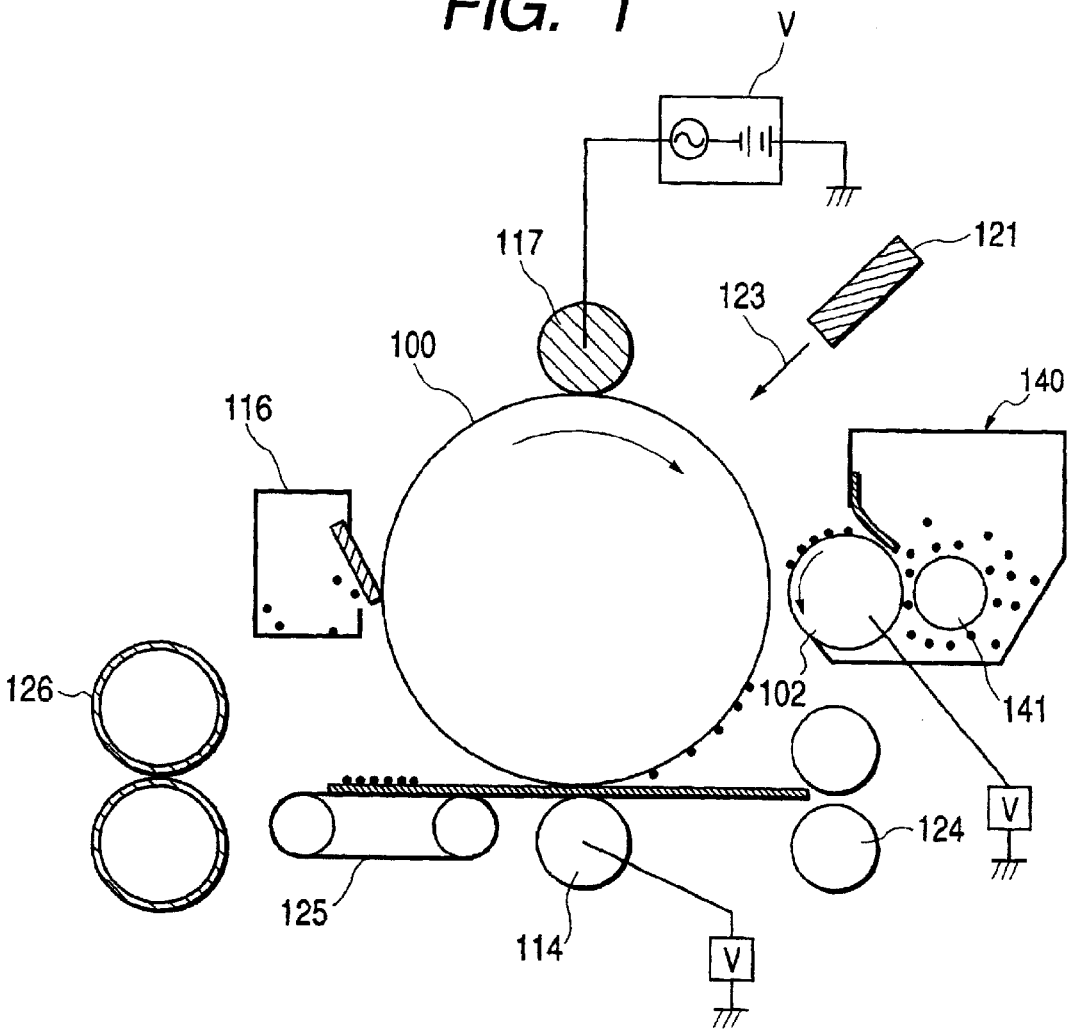
FIG. 1 illustrates an example of an image-forming apparatus used in Examples of the present invention.

To solve the problems discussed previously, the present inventors took note of circularities of magnetic toners, liberation percentages of iron and an iron compound which are contained in magnetic toners, and THF-insoluble matter of resins, and have discovered that a magnetic toner having a superior charging stability, which can form images with a high quality and have a superior fixing performance can be obtained by controlling these factors to specific values. Thus, they have accomplished the present invention.

The present invention will be described below in detail.

(1) Magnetic Toner

The magnetic toner of the present invention is described first. The magnetic toner (hereinafter often simply "toner") of the present invention is a magnetic toner for rendering electrostatic latent images visible, and is characterized by having toner particles containing at least a binder resin, a release agent and a magnetic material containing a magnetic iron oxide, and having a weight-average particle diameter of from 3 to 10 μm, a magnetization intensity of from 10 to 50 $Am^2/kg$ under application of a magnetic field of 79.6 kA/m, an average circularity of 0.970 or more, a ratio of weight-average particle diameter to number-average particle diameter of 1.40 or less, iron and an iron compound which stand liberated from the magnetic toner particles at a liberation percentage of from 0.05 to 3.00%, and a resin component having a THF-insoluble matter in an amount of from 3 to 60% by weight.

Extensive studies made by the present inventors have revealed that a toner can have a very good transfer performance when the toner has an average circularity of 0.970 or more. This is presumably because the area of contact between toner particles and the photosensitive member surface is so small as to lower the attraction force of toner particles on photosensitive member that is ascribable to mirror force or van der Waals force. In addition, since the toner has an average circularity of as high as 0.970 or more, the magnetic toner can be formed into uniform and fine ears at the developing zone and can perform development faithfully to latent images, bringing about an improvement in image quality.

The magnetic toner of the present invention may preferably have also a mode circularity of 0.99 or more in its circularity distribution. What is meant by having a mode circularity of 0.99 or more is that most toner particles have a shape close to spheres. This is preferable because the above action can be more remarkable. Thus, the use of such a toner can make its transfer efficiency so high that the transfer residual toner can be reduced, and hence the toner can be very less present at the pressure contact zone between the charging member and the photosensitive member, whereby stable charging can be performed and at the same time the melt-adhesion of toner can be prevented, so that any faulty images can greatly be kept from occurring, as so presumed.

These effects are more remarkably brought about in image-forming methods having the step of contact transfer, which tends to cause blank areas caused by poor transfer.

The average circularity referred to in the present invention is used as a simple method for expressing the shape of toner quantitatively. In the present invention, the shape of particles is measured with a flow type particle image analyzer FPIA-1000, manufactured by Toa Iyou Denshi K. K., and circularity (Ci) is individually calculated on a group of particles having a circle-corresponding diameter of 3 μm or larger, according to the following Equation (1). As also further shown in the following Equation (2), the value obtained when the sum total of circularity of all particles measured is divided by the number (m) of all particles is defined to be the average circularity (C).

Equation (1)

$$\text{Circularity}(Ci) = \frac{\text{Circumferential length of a circle with the same area as particle image}}{\text{Circumferential length of particle projected image}}$$

Equation (2)

$$\text{Average circularity } (C) = \sum_{i=1}^{m} Ci/m$$

The mode circularity refers to a peak circularity at which the value of frequency in circularity frequency distribution comes to be maximum when circularities of 0.40 to 1.00 are divided into 61 ranges at intervals of 0.01 as from 0.40 to 1.00 and the circularity of particles thus measured is assigned to each divided range in accordance with the corresponding circularity.

The measuring device "FPIA-1000" used in the present invention employs a calculation method in which, in calculating the circularity of each particle and thereafter calculating the average circularity and mode circularity, particles are divided into division ranges, which are divided into 61 ranges at intervals of 0.010 as from 0.40 to 1.00, in accordance with the corresponding circularities, and the average circularity and mode circularity are calculated using the center values and frequencies of divided points. Between the values of the average circularity and mode circularity calculated by this calculation method and the values of the average circularity and mode circularity calculated by the above calculation equation which uses the circularity of each particle directly, there is only a very small accidental error, which is at a level that is substantially negligible.

The measurement is made in the procedure as shown below.

In 10 ml of water in which about 0.1 mg of a surface-active agent has been dissolved, about 5 mg of the magnetic toner is dispersed to prepare a dispersion. Then the dispersion is exposed to ultrasonic waves (20 kHz, 50 W) for 5 minutes and the dispersion is made to have a concentration of 5,000 to 20,000 particles/μl, where the measurement is made using the above analyzer to determine the average circularity and mode circularity of the group of particles having a circle-corresponding diameter of 3 μm or larger.

The circularity referred to in the present invention is an index showing the degree of surface unevenness of magnetic toner particles. It is indicated as 1.000 when the particles are perfectly spherical. The more complicate the surface shape is, the smaller the value of circularity is.

In the above measurement, the reason why the circularity is measured only on the group of particles having a circle-corresponding diameter of 3 μm or larger is that a group of particles of external additives that is present independently from toner particles are included in a large number in a group of particles having a circle-corresponding diameter smaller than 3 μm, which may affect the measurement not to enable any accurate estimation of the circularity on toner particles.

The magnetic toner of the present invention is characterized by having iron and an iron compound at a liberation percentage of from 0.05% to 3.00%. This liberation percentage may preferably be from 0.05 to 2.00%, more preferably from 0.05 to 1.50%, still more preferably from 0.05 to 1.20%, particularly preferably from 0.05 to 0.80%, and most preferably from 0.05 to 0.60%. As mentioned previously, the magnetic toner of the present invention contains a magnetic material containing a magnetic iron oxide. Hence, the liberation percentage of the iron and iron compound specifically indicates the proportion of a magnetic material standing liberated from the toner particles.

The liberation percentage of the iron and iron compound in the magnetic toner of the present invention is a value measured with a particle analyzer (PT1000, manufactured by Yokogawa Denki K. K.), and is measured on the basis of the principle described in Japan Hardcopy '97 Papers, pages 65–68. Stated specifically, in this analyzer, fine particles such as toner particles are individually led into plasma, and the element(s), number of particles and particle diameter of particles can be known from emission spectrum of the fine particles.

Herein, the liberation percentage is a value defined from the following equation, on account of the simultaneousness of light emission of carbon atoms and iron atoms which are those of constituent elements of the binder resin.

Liberation percentage (%) of iron and iron compound=100×[(the number of light emissions of only iron atoms)/(the number of light emissions of iron atoms having emitted light simultaneously with carbon atoms+the number of light emissions of only iron atoms)]

Here, as to the simultaneous light emission of carbon atoms and iron atoms, light emission of iron atoms having emitted light within 2.6 msec after the light emission of carbon atoms is regarded as simultaneous light emission, and light emission of iron atoms after that is regarded as light emission of only iron atoms. Since in the present invention the magnetic material is contained in a large quantity, what is meant by the fact of simultaneous light emission of carbon atoms and iron atoms is that the toner particles contain the magnetic material, and the light emission of only iron atoms can be said in other words to mean that the magnetic material stands liberated from toner particles.

A specific measuring method therefor is as follows: Using helium gas containing 0.1% of oxygen, measurement is made in an environment of 23° C. and 60% humidity. As a toner sample, a sample having been moisture conditioned by leaving overnight in the same environment is used in the measurement. Also, carbon atoms are measured in channel 1 (measurement wavelength: 247.860 nm; a recommended value is used as K-factor), and iron atoms in channel 2 (measurement wavelength: 239.56 nm; 3.3764 is used as K-factor). Sampling is so carried out that the number of light emissions of carbon atoms comes to be 1,000 to 1,400 in one scanning, and the scanning is repeated until the number of light emission of carbon atoms comes to be 10,000 times or more in total, where the number of light emissions is calculated by addition. Here, the measurement is made by sampling carried out in such a way that, in distribution given by plotting the number of light emissions of carbon atoms as ordinate and the cube root voltage of carbon atoms as abscissa, the distribution has one peak and also no valley is present. Then, on the basis of the data thus obtained, the liberation percentage of the iron and iron compound is calculated using the above calculation expression, setting the noise-cut level of all elements at 1.50 V. It is measured in the same manner also in Examples given later.

In some cases, organic compounds containing iron atoms, such as an azo type iron compound used as a charge control agent is also contained in the toner particles. However, such compounds are not counted as free iron atoms because the carbon atoms in such organic compound also emit light simultaneously with iron atoms.

Studies made by the present inventors have revealed that the liberation percentage of the iron and iron compound closely correlates with the extent of their uncovering to the toner particle surfaces and that, as long as the magnetic material standing liberated is in a proportion of 3.00% or less, the magnetic material can be kept from being uncovered to the toner particle surfaces and also a high charge quantity can be provided. The liberation percentage of the iron and iron compound depends on hydrophobicity of the magnetic material, its fitting with resins, particle size distribution and treatment uniformity. As an example, when magnetic materials are non-uniformly surface-treated, a magnetic material not sufficiently surface-treated (i.e., strongly hydrophilic) tends to be present at toner particle surfaces and at the same time a part or the whole thereof may become liberated. Hence, the lower the liberation percentage of the iron and iron compound is, the more charge quantity the magnetic toner tends to have.

Meanwhile, when the liberation percentage is more than the upper limit of the above range, the charge may leak at too many points, resulting in a decrease in charge quantity of the magnetic toner. This tendency is remarkable especially in an environment of high temperature and high humidity. Also, a magnetic toner having a low charge quantity is not preferable because it may greatly cause fog and have a low transfer efficiency. Still also, the magnetic toner having such a high liberation percentage of the iron and iron compound may have a little poor fixing performance. This is presumably because a magnetic material having a large specific heat is present at the surfaces of magnetic toner particles, or present in the state it stands liberated from the magnetic toner particles and hence the heat is not sufficiently transmitted to the magnetic toner.

When on the other hand the liberation percentage of the iron and iron compound is less than 0.05%, it means that substantially the magnetic toner does not stand liberated from magnetic toner particles. Thus, the magnetic toner having such a low liberation percentage of the iron and iron compound has a high charge quantity. However, especially when images are reproduced on many sheets in an environment of low temperature and low humidity, such a toner tends to cause a decrease in image density ascribable to charge-up of the magnetic toner and cause coarse images. This is presumed to be due to the following.

In general, the magnetic toner carried on the toner-carrying member does not entirely participate in development on the photosensitive member, but some magnetic toner is present on the toner-carrying member also immediately after the development. This tends to occur remarkably, especially in jumping development making use of magnetic toners, showing not so a high transfer efficiency. Moreover, since as stated previously the magnetic toner having a high circularity is formed into uniform and fine ears at the developing zone, it is considered that the magnetic toner present at leading ends of the ears may first participate in development and the magnetic toner present in the vicinity of the toner-carrying member surface does not soon participate in development.

Hence, the magnetic toner present in the vicinity of the toner-carrying member surface may repeatedly triboelectrically be charged by the charging member to fall into the vicious circle that it can participate in development with difficulty more and more. Also, in such a state, the charging uniformity of the magnetic toner may be damaged to tend to cause coarse images.

Now, when the magnetic toner whose liberation percentage of the iron and iron compound is 0.05% or more is used, the magnetic material standing liberated or the magnetic material slightly present at the surfaces of magnetic toner particles can keep the magnetic toner from causing charge-up and at the same time promote the uniformity in charge quantity of the magnetic toner, so that the coarse images can be kept from being caused. For these reasons, the liberation percentage of the iron and iron compound may preferably be from 0.05 to 3.00% in order to attain a high charge quantity stably.

The magnetic toner of the present invention can have a very high transfer efficiency and also may very less cause fog, on account of a synergistic effect attributable to the uniformity in shape of the toner particles and the uniformly high charge quantity the magnetic toner can provide. Also, the magnetic toner may less scatter, and brings about an improvement in image quality. Moreover, such a magnetic toner may hardly cause selective development even when used over a long period of time, and may hardly cause differences in physical properties of the magnetic toner before and after its use, also bringing about an improvement in running performance. Meanwhile, as disclosed in Japanese Patent Applications Laid-Open No. 5-150539 and No. 8-22191, external addition of magnetite to the surfaces of amorphous magnetic toner particles may enable the charge-up of toner to be kept from occurring. However, any external addition of magnetite to the magnetic toner having an average circularity of 0.970 or more as in the present invention causes fog greatly and also makes charging performance poor especially in an environment of high temperature and high humidity. The reason therefor is unclear, and is presumed to be that a low-resistance material such as magnetite is present at the surfaces of magnetic toner particles in a large quantity and also that, when the toner having relatively smooth toner particles with an average circularity of 0.970 or more is used, shear is not well applied at the time of the mixing of magnetite, so that the magnetite does not deposit uniformly to toner particle surfaces, to cause a difference in deposit quantity between toner particles themselves.

In the image-forming method of the present invention, the magnetic toner may preferably have a weight-average particle diameter of from 3 to 10 $\mu$m, and more preferably from 4 to 9 μm, in order to develop minuter latent image dots for achieving much higher image quality.

In a magnetic toner having a weight-average particle diameter smaller than 3 μm, the transfer residual toner may remain on the photosensitive member in a large quantity because of a lowering of transfer efficiency, so that it may become difficult to prevent abrasion of, or melt-adhesion of toner to, the photosensitive member in the step of contact charging. Moreover, the magnetic toner may have a large surface area on the whole and, in addition thereto, it may have a low fluidity and agitatability required as a powder to make it difficult for individual magnetic toner particles to be uniformly charged. This tends to make fogging serious or make transfer performance poor, and tends to cause not only abrasion and melt-adhesion but also non-uniformity of images. Also, in the case of a magnetic toner having a weight-average particle diameter larger than 10 μm, spots around line images tend to occur in character and line images, making it difficult to attain a high resolution. Moreover, as apparatus have a higher resolution, such a toner of 10 μm or larger in size tends to make reproduction of individual dots poor.

The magnetic toner of the present invention may preferably have a ratio of weight-average particle diameter to number-average particle diameter (D4/D1), of 1.40 or less, and more respectively 1.35 or less. Having a ratio of weight-average particle diameter to number-average particle diameter of more than 1.40 means that fine powder particles and coarse powder particles are present in the toner in a large number, and is not preferable because selective development may tend to occur and also a broad charge quantity distribution may result.

On the other hand, the magnetic toner having a ratio of weight-average particle diameter to number-average particle diameter of 1.40 or less, in particular, 1.35 or less can rise in ears very uniformly at the developing zone to enable formation of images having a very good dot reproducibility, on account of a synergistic effect of the toner's shape factor that the magnetic toner has an average circularity of 0.970 or more and the particle size distribution that it has also a uniform particle diameter.

When the magnetic toner particles of the present invention are produced by suspension polymerization as a preferable process for producing the magnetic toner, the particle size distribution (D4/D1) of the magnetic toner can be controlled by controlling the uniformity of surface treatment of the magnetic material, its hydrophobicity, the amount of magnetic material and the conditions for granulation (such as the type of dispersant, granulation method and granulation time).

Here, the average particle diameter and particle size distribution of the magnetic toner can be measured with COULTER Counter Model TA-II or COULTER Multisizer (manufactured by Coulter Electronics, Inc.). In the present invention, COULTER Multisizer (manufactured by Coulter Electronics, Inc.) is used. An interface (manufactured by Nikkaki k. k.) that outputs number distribution and volume distribution and a personal computer PC9801 (manufactured by NEC.) are connected. As an electrolytic solution, an aqueous 1% NaCl solution is prepared using first-grade sodium chloride. For example, ISOTON R-II (available from Coulter Scientific Japan Co.) may be used.

Measurement is carried out by, e.g., adding as a dispersant from 0.1 to 5 ml of a surface active agent (preferably an alkylbenzene sulfonate) to from 100 to 150 ml of the above aqueous electrolytic solution, and further adding from 2 to 20 mg of a sample to be measured. The electrolytic solution in which the sample has been suspended is subjected to dispersion for about 1 minute to about 3 minutes in an ultrasonic dispersion machine. The volume distribution and number distribution are calculated by measuring the volume and number of toner particles with particle diameters of not smaller than 2 μm by means of the above COULTER Multisizer, using an aperture of 100 μm as its aperture. Then the volume-based, weight-average particle diameter (D4) determined from the volume distribution and the number-based, length-average particle diameter, i.e., number-average particle diameter (D1) determined from number distribution are determined. In Examples given later, too, the average particle diameter of the magnetic toner is measured in the same way.

The magnetic toner of the present invention may also be produced by pulverization. When it is produced by pulverization, any known method may be used. For example, components necessary as the magnetic toner, such as a binder resin, a magnetic material, a release agent, a charge control agent and optionally a colorant, and other additives are thoroughly mixed by mean of a mixer such as a Henschel mixer or a ball mill, thereafter the mixture obtained is melt-kneaded by means of a heat kneading machine such as a heat roll, a kneader or an extruder, and the resultant kneaded product is cooled to solidify, followed by pulverization, classification and optionally surface treatment to obtain toner particles. Either of the classification and the surface treatment may be first in order. In the step of classification, a multi-division classifier may preferably be used in view of the improvement of production efficiency.

The pulverization step may be carried out by any method making use of a known pulverizer such as a mechanical impact type or a jet type. In order to obtain the magnetic toner having the specific circularity according to the present invention, it is preferable to further apply heat to effect pulverization or to add mechanical impact auxiliarily. Also usable are, e.g., a hot-water bath method in which magnetic toner particles finely pulverized (and optionally classified) are dispersed in hot water, and a method in which the magnetic toner particles are passed through hot-air stream.

As means for applying mechanical impact force, available are, e.g., a method making use of a mechanical impact type pulverizer such as Kryptron system, manufactured by Kawasaki Heavy Industries, Ltd., or Turbo mill, manufactured by Turbo Kogyo K. K., and a method in which magnetic toner particles are pressed against the inner wall of a casing by centrifugal force by means of a high-speed rotating blade to impart mechanical impact to the magnetic toner particles by the force such as compression force or frictional force, as exemplified by apparatus such as a mechanofusion system manufactured by Hosokawa Mikuron K. K. or a hybridization system manufactured by Nara Kikai Seisakusho.

When such a mechanical impact method is used, thermo-mechanical impact where heat is applied at a temperature around glass transition temperature (Tg) of the magnetic toner particles (Tg±10° C.) as treatment temperature is preferred from the viewpoint of prevention of agglomeration and productivity. More preferably the heat may be applied at a temperature within ±5° C. of the glass transition temperature (Tg) of the magnetic toner particles, as being effective for the improvement of transfer efficiency.

As the binder resin used when the magnetic toner particles according to the present invention is produced by pulverization, it may include polystyrene; homopolymers of styrene derivatives such as polyvinyl toluene; styrene copolymers such as a styrene-propylene copolymer, a styrene-vinyltoluene copolymer, a styrene-vinylnaphthalene copolymer, a styrene-methyl acrylate copolymer, a styrene-ethyl acrylate copolymer, a styrene-butyl acrylate copolymer, a styrene-octyl acrylate copolymer, a styrene-dimethylaminoethyl acrylate copolymer, a styrene-methyl methacrylate copolymer, a styrene-ethyl methacrylate copolymer, a styrene-butyl methacrylate copolymer, a styrene-dimethylaminoethyl methacrylate copolymer, a styrene-methyl vinyl ether copolymer, a styrene-ethyl vinyl ether copolymer, a styrene-methyl vinyl ketone copolymer, a styrene-butadiene copolymer, a styrene-isoprene copolymer, a styrene-maleic acid copolymer and a styrene-maleate copolymer; and polymethyl methacrylate, polybutyl methacrylate, polyvinyl acetate, polyethylene, polypropylene, polyvinyl butyral, silicone resins, polyester resins, polyamide resins, epoxy resins, polyacrylic acid resins, rosins, modified rosins, terpene resins, phenolic resins, aliphatic or alicyclic hydrocarbon resins, aromatic petroleum resins, paraffin wax, and carnauba wax. Any of these may be used alone or in the form of a mixture. In particular, styrene copolymers and polyester resins are preferred in view of developing performance and fixing performance.

The magnetic toner may preferably have a glass transition temperature (Tg) of from 40° C. to 80° C., and more preferably from 45° C. to 70° C. If it has a Tg lower than 40° C., the magnetic toner may have a low storage stability. If it has a Tg higher than 80° C., it may have a low fixing performance. The glass transition temperature of the magnetic toner may be measured with, e.g., a differential scanning calorimeter of a highly precise, inner-heat input compensation type as exemplified by DSC-7, manufactured by Perkin-Elmer Corporation. The measurement is made according to ASTM D3418-8. In the present invention, the temperature of a sample is once raised to take a previous history and thereafter rapidly dropped. The temperature is again raised at a heating rate of 10° C./min within a temperature range of from 30 to 200° C., and the DSC curve measured in the course of temperature rise is used.

The magnetic toner particles according to the present invention may also be produced by the method as disclosed in Japanese Patent Publication No. 56-13945, in which a molten mixture is atomized in air by means of a disk or a multiple fluid nozzle to obtain spherical toner particles; a dispersion polymerization method in which toner particles are directly produced using an aqueous organic solvent capable of dissolving polymerizable monomers and not capable of dissolving the resulting polymer; and an emulsion polymerization method as typified by soap-free polymerization in which toner particles are produced by direct polymerization of polymerizable monomers in the presence of a water-soluble polar polymerization initiator.

The magnetic toner of the present invention may be produced by pulverization as described previously. However, the magnetic toner particles obtained by such pulverization commonly have an amorphous shape, and hence any mechanical and thermal or any special treatment must be made in order to attain the physical properties, the average circularity of 0.970 or more, which is an essential requirement for the magnetic toner according to the present invention, resulting in a correspondingly low productivity.

In the present invention, the magnetic toner particles may preferably be produced by suspension polymerization. In this suspension polymerization, a polymerizable monomer and magnetic fine particles, and also optionally a polymerization initiator, a cross-linking agent, a charge control agent and other additives are uniformly dissolved or dispersed to form a polymerizable monomer composition, and thereafter this polymerizable monomer composition is dispersed in a continuous phase (e.g., an aqueous phase) containing a dispersion stabilizer, by means of a suitable stirrer to simultaneously carry out polymerization to obtain magnetic toner particles having the desired particle diameters. In the magnetic toner particles obtained by this suspension polymerization (hereinafter "synthetic magnetic toner particles"), the individual toner particles stand uniform in a substantially spherical shape, and hence the magnetic toner which satisfies the requirement on physical properties, the average circularity of 0.970 or more and the mode circularity of 0.99 or more, which is essential for the present invention can be obtained with ease. Moreover, such a magnetic toner can also have a relatively uniform charge quantity distribution, and hence has a high transfer performance.

However, where usual magnetic fine particles are incorporated in the synthetic magnetic toner particles, the magnetic fine particles are present at magnetic toner particle surfaces in a large number to lower charging performance of the magnetic toner particles. In addition, because of a strong mutual action exerted between magnetic fine particles and water when the synthetic magnetic toner particles are produced, the magnetic toner particles having an average circularity of 0.970 or more may be obtained with difficulty and moreover the magnetic toner obtained may have a broad particle size distribution. This is presumed to be due to the fact that (1) the magnetic fine particles are commonly hydrophilic and hence tend to be present at magnetic toner particle surfaces, and (2) the magnetic fine particles move disorderly when the aqueous medium is stirred and the surfaces of suspended particles comprised of monomers are dragged correspondingly thereto, so that their shape is distorted to become round with difficulty. In order to solve such problems, it is important to modify the surface properties the magnetic fine particles have.

Proposals are made in a large number in regard to the surface modification of magnetic fine particles used in synthetic magnetic toners. As discussed previously, Japanese Patent Applications Laid-Open No. 59-200254, No. 59-200256, No. 59-200257 and No. 59-224102 disclose techniques for treating magnetic fine particles with silane coupling agents of various types. Japanese Patent Application Laid-Open No. 63-250660 discloses a technique for treating silicon-element-containing magnetic fine particles with a silane coupling agent. Such treatment enables the magnetic fine particles to be kept from liberation to a certain extent. However, there is a problem that it is difficult to make magnetic fine particle surfaces uniformly hydrophobic. Hence, it is hard to avoid mutual coalescence of magnetic fine particles and occurrence of magnetic fine particles not made hydrophobic, so that the magnetic fine particles tend to have a low dispersibility and also a broad particle size distribution.

As an example in which hydrophobic magnetic fine iron oxide particles is used, as disclosed in Japanese Patent Application Laid-Open No. 54-84731 a magnetic toner is proposed which contains magnetic fine iron oxide particles having been treated with an alkyltrialkoxysilane. The addition of such magnetic fine iron oxide particles has certainly brought about an improvement in electrophotographic performance of the magnetic toner. However, the magnetic fine iron oxide particles have a small surface activity originally, and have tended to caused coalesced particles at the stage of treatment to tend to be made non-uniformly hydrophobic. Also, use of magnetic particles having a small particle diameter makes it more difficult to make uniform treatment.

Accordingly, a further improvement must be made for them to be used in the present invention. In addition, although hydrophobicity can certainly be made higher when a treating agent is used in a large quantity or a highly viscous treating agent is used in order to improve enclosure of such magnetic particles, the particles tend to coalesce one another to tend to have a low dispersibility conversely.

The magnetic toner produced using such magnetic fine particles tends to be non-uniformly triboelectrically charged to tend to cause fog ascribable thereto and tend to have a low transfer performance.

Thus, in synthetic magnetic toners making use of conventional surface-treated magnetic fine particles, simultaneous achievement of both hydrophobicity and dispersibility has not necessarily been made. Even if such a synthetic magnetic toner is used in the image-forming method of the present invention, having the step of contact charging, it is difficult to obtain highly minute images stably.

Accordingly, it is preferable for the magnetic fine particles used in the magnetic toner of the present invention to have uniformly been hydrophobic-treated with a coupling agent. When the surfaces of magnetic fine particles are made hydrophobic, it is very preferable to use a method of making surface treatment in an aqueous medium while dispersing the magnetic fine particles so as to have a primary particle diameter and hydrolyzing the coupling agent. This method of hydrophobic treatment may less cause the mutual coalescence of magnetic fine particles than any treatment made in a gaseous phase. Also, charge repulsion acts between magnetic fine particles themselves as a result of hydrophobic treatment, so that the magnetic fine particles are surface-treated substantially in the state of primary particles.

The method of surface-treating the magnetic fine particles while hydrolyzing the coupling agent in an aqueous medium does not require any use of coupling agents which may generating gas, such as chlorosilnes and silazanes, and also enables use of highly viscous coupling agents which tend to cause mutual coalescence of magnetic fine particles in a gaseous phase and hence have ever made it difficult to make good treatment. Thus, a great effect of making hydrophobic is obtainable.

The coupling agent usable in the surface treatment of the magnetic fine particles according to the present invention may include, e.g., silane coupling agents and titanium coupling agents. Preferably used are silane coupling agents, which are those represented by Formula (I).

$$R_mSiY_n \quad (I)$$

wherein R represents an alkoxyl group; m represents an integer of 1 to 3; Y represents a hydrocarbon group such as an alkyl group, a vinyl group, a glycidoxyl group or a methacrylic group; and n represents an integer of 1 to 3; provided that m+n=4.

The silane coupling agents represented by Formula (1) may include, e.g., vinyltrimethoxysilane, vinyltriethoxysilane, vinyltris(β-methoxyethoxy)silane, β-(3,4-epoxycyclohexyl)ethyltrimethoxysilane, γ-glycidoxypropyltrimethoxysilane, γ-glycidoxypropylmethyldiethoxysilane, γ-aminopropyltriethoxysilane, N-phenyl-γ-aminopropyltrimethoxysilane, γ-methacryloxypropyltrimethoxysilane, vinyltriacetoxysilane, methyltrimethoxysilane, dimethyldimethoxysilane, phenyltrimethoxysilane, diphenyldimethoxysilane, methyltriethoxysilane, dimethyldiethoxysilane, phenyltriethoxysilane, diphenyldiethoxysilane, n-butyltrimethoxysilane, isobutyltrimethoxysilane, trimethylmethoxysilane, hyroxypropyltrimethoxysilane, n-hexadecyltrimethoxysilane and n-octadecyltrimethoxysilane.

Of these, an alkyltrialkoxysilane coupling agent represented by Formula (II) may more preferably be used.

$$C_pH_{2p+1}—Si—(OC_qH_{2q+1})_3 \quad (II)$$

wherein p represents an integer of 2 to 20, and q represents an integer of 1 to 3.

In the above formula, if p is smaller than 2, though hydrophobic treatment may be made with ease, it is difficult to provide a sufficient hydrophobicity, making it difficult to control the uncovering or liberation of the magnetic fine particles from the magnetic toner particles. If p is larger than 20, though hydrophobicity can be sufficient, the magnetic fine particles may greatly coalesce one another to make it difficult to disperse the magnetic fine particles sufficiently in the magnetic toner, tending to cause fog and lower transfer performance.

If q is larger than 3, the silane coupling agent may have a low reactivity to make it hard for the magnetic fine particles to be made sufficiently hydrophobic. It is particularly advantageous to use the alkyltrialkoxysilane coupling agent in which the p in the formula represents an integer of 2 to 20 (and preferably an integer of 3 to 15) and the q represents an integer of 1 to 3 (and preferably an integer of 1 or 2). In the treatment, the silane coupling agent may be used in an amount of from 0.05 to 20 parts by weight, preferably from 0.1 to 10 parts by weight, based on 100 parts by weight of the magnetic fine particles. The amount of such a treating agent may preferably be adjusted in accordance with the surface area of the magnetic fine particles and the reactivity of the coupling agent.

To treat the magnetic fine particles with the coupling agent in an aqueous medium to make surface treatment, a method may be available in which the magnetic fine particles and the coupling agent both added in appropriate quantities are stirred in an aqueous medium. They may be stirred by means of, e.g., a mixer having a stirring blade and may thoroughly be so stirred that the magnetic fine particles come to be primary particles in the aqueous medium.

Here, the aqueous medium is a medium composed chiefly of water. Stated specifically, the aqueous medium may be water itself and may further include those prepared by adding in water a surface-active agent in a small quantity, those prepared by adding a pH adjuster in water, and those prepared by adding an organic solvent in water. The surface-active agent may preferably include nonionic surface-active agents such as polyvinyl alcohol. The surface-active agent may be added in an amount of from 0.1 to 5% by weight based on the weight of the water. The pH adjuster may include inorganic acids such as hydrochloric acid. The organic solvent may include alcohols.

In the magnetic material thus obtained, no agglomeration of the magnetic fine particles is seen and the surfaces of individual particles have uniformly been hydrophobic-treated. Hence, when used as a material for the synthetic magnetic toner particles, the magnetic toner particles can have a good uniformity.

The magnetic fine particles used as the magnetic material in the magnetic toner of the present invention are composed chiefly of an iron oxide such as triiron tetraoxide or γ-iron oxide, which may contain any of elements such as phosphorus, cobalt, nickel, copper, magnesium, manganese, aluminum and silicon, any of which may be used alone or in combination of two or more types.

The magnetic material having these magnetic fine particles may preferably have a BET specific surface area, as measured by nitrogen gas absorption, of from 2 to 30 $m^2/g$, and particularly from 3 to 28 $m^2/g$, and also may preferably have a Mohs hardness of from 5 to 7. As the shape of such magnetic fine particles, they may be polyhedral, octahedral, hexahedral, spherical, acicular or flaky. Polyhedral, octahedral, hexahedral or spherical ones are preferred as having less anisotropy, which are preferable in order to improve image density. The shape of such magnetic fine particles can be ascertained by SEM (scanning electron microscopy) or the like.

The magnetic fine particles may preferably have a volume-average particle diameter of from 0.05 to 0.40 $\mu$m, and more preferably from 0.10 to 0.30 $\mu$m.

If the magnetic fine particles have a volume-average particle diameter smaller than 0.05 $\mu$m, they may have a low degree of black color and may provide a low coloring power when used as a colorant of black-and-white toners, and composite oxide particles may strongly agglomerate one another, resulting in a low dispersibility. Also, it may be difficult for such magnetic fine particles to be uniformly surface-treated, tending to make great the liberation percentage of the iron and iron compound. In addition, if the magnetic fine particles have a volume-average particle diameter smaller than 0.05 $\mu$m, the magnetic material itself may have a strongly reddish tint, so that the resultant images also tend to be formed in reddish black, resulting in a low image quality level.

If on the other hand the magnetic fine particles have a volume-average particle diameter larger than 0.40 $\mu$m, they may have an insufficient coloring power like the case of usual colorants. In addition, especially when used as a colorant for magnetic toners having a small particle, it may be difficult as a matter of probability to disperse the magnetic fine particles uniformly in individual magnetic toner particles, tending to result in a low dispersibility, also resulting in a poor running performance of the magnetic toner in some cases, undesirably.

The volume-average particle diameter of the magnetic material (magnetic fine particles) may be measured with a transmission electron microscope. Stated specifically, toner particles to be observed are sufficiently dispersed in epoxy resin, followed by curing for 2 days in an environment of temperature 40° C. to obtain a cured product, and then samples are cut out in slices by means of a microtome to measure the particle diameter of 100 magnetic fine particles in the visual field on a photograph taken at 10,000 to 40,000 magnifications, using a transmission electron microscope (TEM). The volume-average particle diameter is then calculated on the basis of the corresponding diameter of a circle having the same area as the projected area of the magnetic fine particle. It is measured in the same manner also in Examples given later.

In the present invention, in addition to the magnetic fine particles, other colorant may also be used in combination. The other colorant usable in combination may include magnetic or non-magnetic inorganic compounds and known dyes and pigments. Stated specifically, it may include, e.g., ferromagnetic metal particles such as cobalt and nickel, or alloys of any of these metals to which element(s) such as chromium, manganese, copper, zinc, aluminum and/or rare earth element(s) has or have been added; as well as hematite particles, titanium black, nigrosine dyes or pigments, carbon black, and phthalocyanines. These may also be used after their particle surface treatment.

The magnetic fine particles used in the present invention may preferably have a volume-average variation coefficient of 35 or less. Having a volume-average variation coefficient of more than 35 means that the magnetic fine particles have a broad particle size distribution. Use of such magnetic fine particles may lower the uniformity required when the magnetic fine particles are treated as described above, and also they tend to have a low dispersibility in the toner particles. Moreover, their use may make it hard for the magnetic fine particles to uniformly enter each particle of the toner particles at the time of granulation, tending to cause a great difference in content of the magnetic fine particles between individual toner particles, undesirably. Incidentally, in the present invention, the volume-average variation coefficient is defined to be a value found according to the following Equation (3).

Equation (3)

$$\text{Volume-average variation coefficient} = \frac{\text{Standard deviation of particle size distribution of magnetic fine particles}}{\text{Volume-average average particle diameter of magnetic fine particles}} \times 100$$

The magnetic material (magnetic fine particles) used in the present invention may preferably have a hydrophobicity of from 35 to 95%, and more preferably from 40 to 95%. The hydrophobicity is arbitrarily changeable depending on the type and quantity of the agent for treating the magnetic fine particle surfaces. The hydrophobicity shows how far the magnetic fine particles are hydrophobic, and those having a low hydrophobicity are meant to be highly hydrophilic. Hence, when magnetic fine particles having a low hydrophobicity are used, in the suspension polymerization preferably used when the magnetic toner of the present invention is produced, the magnetic fine particles may move to the aqueous medium during granulation, so that they may have a broad particle size distribution and also make the magnetic toner particles have a low average circularity. This may occur because magnetic fine particles insufficiently hydrophobic-treated tend to become uncovered to the magnetic toner particle surfaces. Also, those having a low hydrophobicity may make the liberation percentage of the iron and iron compound higher, undesirably. On the other hand, for those having a hydrophobicity higher than 95%, the agent for treating the magnetic fine particle surfaces must be used in a large quantity, and, being in such a state, the magnetic fine particles tend to coalesce to tend to damage the uniformity in treatment.

The hydrophobicity in the present invention is a value measured in the following way. The hydrophobicity of the magnetic fine particles is measured by methanol titration. The methanol titration is an experimental method by which the hydrophobicity of magnetic fine particles having surfaces made hydrophobic is ascertained. The measurement of hydrophobicity by using methanol is made in the following way. In 50 ml of water in a beaker of 250 ml in volume, 0.1 g of magnetic fine particles are added. Thereafter, in the liquid obtained, methanol is added little by little to effect titration. Here, the methanol is fed from the bottom of the liquid with gentle stirring. The end of sedimentation of the magnetic fine particles is judged at the point of time when any suspended matter of the magnetic fine particles is no longer seen at the liquid surface, and the hydrophobicity is expressed as volume percentage of the methanol at the time the sedimentation has reached its end point and of the methanol in its aqueous mixture. The hydrophobicity is measured in the same manner also in Examples given later.

The magnetic material (magnetic fine particles) used in the magnetic toner of the present invention may preferably be used in an amount of from 10 to 200 parts by weight based on 100 parts by weight of the binder resin. It may more preferably be used in an amount of from 20 to 180 parts by weight. If it is less than 10 parts by weight, the magnetic toner may have a low coloring power, making it difficult to keep fog from being caused. If on the other hand it is more than 200 parts by weight, the magnetic toner may be held on the toner-carrying member by magnetic force so strongly as to have a low developing performance, or not only it may be difficult for the magnetic fine particles to be uniformly dispersed in individual magnetic toner particles, but also the magnetic toner may have a low fixing performance.

The content of the magnetic material in the magnetic toner may be measured with a thermal analyzer TGA7, manufactured by Perkin-Elmer Corporation. As a measuring method, the magnetic toner is heated at a heating rate of 25° C./minute from normal temperature to 900° C. in an atmosphere of nitrogen. The weight loss in the course of from 100 to 750° C. is regarded as the weight of a component obtained by removing the magnetic material from the magnetic toner, and the residual weight is regarded as magnetic material weight.

The magnetic material used in the magnetic toner of the present invention is, in the case of magnetite for example, produced in the following way. To an aqueous ferrous salt solution, an alkali such as sodium hydroxide is added in an equivalent weight, or more than equivalent weight, with respect to the iron component to prepare an aqueous solution containing ferrous hydroxide. Into the aqueous solution thus prepared, air is blown while the pH of is maintained at pH 7 or above (preferably a pH of 8 to 14), and the ferrous hydroxide is made to undergo oxidation reaction while the aqueous solution is heated at 70° C. or above to first form seed crystals serving as cores of magnetic fine iron oxide particles.

Next, to a slurry-like liquid containing the seed crystals, an aqueous solution containing ferrous sulfate in about one equivalent weight on the basis of the quantity of the alkali previously added is added. The reaction of the ferrous hydroxide is continued while the pH of the liquid is maintained at 6 to 14 and air is blown, to cause magnetic fine iron oxide particles to grow about the seed crystals as cores. With progress of oxidation reaction, the pH of the liquid shifts on to acid side, but it is preferable for the pH of the liquid not to be made less than 6. At the termination of the oxidation reaction, the pH is adjusted, and the liquid is thoroughly stirred so that the magnetic fine iron oxide particles become primary particles. Then the coupling agent is added, and the mixture obtained is thoroughly mixed and stirred, followed by filtration, drying, and then light disintegration to obtain a powder of magnetic fine iron oxide particles having been hydrophobic-treated. Alternatively, the magnetic fine iron oxide particles obtained after the oxidation reaction is completed, followed by washing and filtration, may be again dispersed in a different aqueous medium without drying, and thereafter the pH of the dispersion again formed may be adjusted, where the silane coupling agent may be added with thorough stirring, to make coupling treatment.

As the ferrous salt, it is possible to use iron sulfate commonly formed as a by-product in the manufacture of titanium by the sulfuric acid method, or iron sulfate formed as a by-product as a result of surface washing of steel sheets, and is also possible to use iron chlorides. In the process of producing the magnetic fine iron oxide particles by the aqueous solution method, taking account of preventing viscosity from increasing at the time of reaction and because of solubility of the iron sulfate, it is commonly used in an iron concentration of from 0.5 to 2 mol/l. Commonly, the lower the concentration of iron sulfate is, the finer particle size the products tend to have. Also, in the reaction, the more the air is and the lower the reaction temperature is, the finer particles tend to be formed.

Use of the magnetic toner having as a material the hydrophobic magnetic material produced in this way makes it possible to attain a stable toner's charging performance and to achieve a high transfer efficiency and also a high image quality and a high stability.

The magnetic toner of the present invention may preferably be a magnetic toner having a magnetization intensity of from 10 to 50 $Am^2/kg$ (emu/g) under application of a magnetic field of 79.6 kA/m (1,000 oersteds). That is, a magnetic-force generation means is provided in the developing assembly, whereby not only the magnetic toner can be prevented from leaking and the magnetic toner can be improved in transport performance or agitation performance, but also the magnetic-force generation means, which is so provided that the magnetic force acts on the toner-carrying member, contributes to further improvement in transfer residual toner collection performance and also makes it easy to prevent the magnetic toner from scattering in order that the magnetic toner can be formed into ears at the developing zone. However, if the magnetic toner has a magnetization intensity lower than 10 $Am^2/kg$ under application of a magnetic field of 79.6 kA/m, the above effect is not obtainable, and, where a magnetic force is made to act on the toner-carrying member, the magnetic toner may unstably be formed into ears, tending to cause faulty images such as fog and uneven image density and faulty collection of transfer residual toner which are ascribable to non-uniform charging to the magnetic toner. If on the other hand the magnetic toner has a magnetization intensity higher than 50 $Am^2/kg$ under application of a magnetic field of 79.6 kA/m, the magnetic toner may have a low fluidity because of magnetic agglomeration to cause a lowering of developing performance, and the magnetic toner tends to be damaged to tend to cause its deterioration. Also, because of the magnetic agglomeration of the magnetic toner, the toner may have a poor running performance. Still also, its transfer performance may lower to leave transfer residual toner in a large quantity, undesirably.

The magnetization intensity (saturation magnetization) of the magnetic toner is arbitrarily changeable depending on the quantity of the magnetic material contained and the magnitude of saturation magnetization of the magnetic material.

The magnetic material may also preferably have a saturation magnetization of from 30 to 120 $Am^2/kg$ under application of a magnetic field of 796 kA/m.

In the present invention, the magnetization intensity (saturation magnetization) of the magnetic toner is measured with a vibration type magnetic-force meter VSM P-1-10 (manufactured by Toei Kogyo K. K.) under application of an external magnetic field of 79.6 kA/m at room temperature of 25° C. As to the magnetic properties of the magnetic material, too, they may be measured with the vibration type magnetic-force meter VSM P-1-10 (manufactured by Toei Kogyo K. K.) under application of an external magnetic field of 796 kA/m at room temperature of 25° C.

The magnetic toner of the present invention contains a release agent in order to improve fixing performance, which may preferably be contained in an amount of from 1 to 30% by weight based on the weight of the binder resin. It may more preferably be contained in an amount of from 3 to 25% by weight. If the release agent is in a content less than 1% by weight, the effect of adding the release agent may lower and also the effect of controlling offset may lower. If on the other hand it is in a content more than 30% by weight, the magnetic toner may have a low long-term storage stability to tend to have a low dispersibility of the release agent and magnetic material in toner materials to cause a lowering of fluidity of the magnetic toner and a lowering of image characteristics. Also, release agent components may ooze out to lower running performance in an environment of high temperature and high humidity. Still also, enclosure of a wax as the release agent in a large quantity tends to make the shape of magnetic toner particles distorted.

In general, magnetic toner images transferred onto a transfer material are thereafter fixed onto the transfer material by the aid of energy such as heat and/or pressure, thus a semipermanent image is obtained. Here, heat-roll fixing is commonly in wide use. As stated previously, very highly minute images can be obtained using a magnetic toner having a weight-average particle diameter of 10 $\mu$m or smaller. However, magnetic toner particles having such a small particle diameter may enter the gaps of fiber of paper when a transfer materials such as paper is used, so that the heat may be correspondingly less received from a heat-fixing roller to tend to cause low-temperature offset. However, in the magnetic toner of the present invention, the release agent is incorporated in an appropriate quantity, preferably in an amount of from 1% to 30% by weight based on the weight of the binder resin, and also the liberation percentage of the iron and iron compound is controlled as described previously, whereby both high image quality and fixing performance can simultaneously be achieved.

The release agent usable in the magnetic toner of the present invention may include petroleum waxes and derivatives thereof such as paraffin wax, microcrystalline wax and petrolatum, montan wax and derivatives thereof, hydrocarbon waxes obtained by Fischer-Tropsch synthesis and derivatives thereof, polyolefin waxes typified by polyethylene wax and derivatives thereof, and naturally occurring waxes such as carnauba wax and candelilla wax and derivatives thereof. The derivatives include oxides, block copolymers with vinyl monomers, and graft modified products. Also usable are higher aliphatic alcohols, fatty acids such as stearic acid and palmitic acid, or compounds thereof, acid amide waxes, ester waxes, ketones, hardened caster oil and derivatives thereof, vegetable waxes, and animal waxes.

Of these release agent components, those having an endothermic peak at 40 to 110° C. as measured by differential thermal analysis are preferred. More specifically, preferred are those having a maximum endothermic peak within the temperature range of from 40 to 110° C. at the time of temperature rise, in the DSC curve as measured with a differential scanning calorimeter. Those having a maximum endothermic peak within the temperature range of from 45 to 90° C. are more preferred. The component having a maximum endothermic peak within the above temperature range greatly contributes to low-temperature fixing and also effectively exhibits releasability. If the maximum endothermic peak is at a temperature lower than 40° C., the release agent component may have a weak self-cohesive force, resulting in low high-temperature anti-offset properties. Also, the release agent tends to ooze out to cause a decrease in charge quantity of the magnetic toner and also a lowering of running performance in an environment of high temperature and high humidity. If on the other hand the maximum endothermic peak is at a temperature higher than 110° C., fixing temperature may become higher to tend to cause low-temperature offset. Also, in the case when the magnetic toner is directly obtained by polymerization by carrying out granulation and polymerization in an aqueous medium, problems may occur undesirably such that the release agent component may precipitate during granulation if the endothermic peak is at a high temperature.

The endotherm and the maximum endothermic peak temperature of the release agent are measured according to ASTM D3418-8. For the measurement, for example, DSC-7, manufactured by Perkin-Elmer Corporation is used. The temperature at the detecting portion of the device is corrected on the basis of melting points of indium and zinc, and the amount of heat is corrected on the basis of heat of fusion of indium. The sample is put in a pan made of aluminum and an empty pan is set as a control, to make measurement. A DSC curve is used which is measured when the sample is heated once up to 200° C. and, after heat history is removed, cooled rapidly, then again heated at a heating rate of 10° C./min in the temperature range of from 30 to 200° C. The measurement is made in the same manner also in Examples given later.

The magnetic toner of the present invention may preferably have a peak top of the main peak in the region of molecular weight of from 5,000 to 50,000, and more preferably in the region of from 8,000 to 40,000, in its molecular weight distribution of the THF-soluble matter as measured by gel permeation chromatography (GPC). If the peak top is at a molecular weight less than 5,000, the toner may have a low storage stability, or the toner tends to deteriorate when printed on a large number of sheets. If on the other hand the peak top is at a molecular weight more than 50,000, the toner may have a low low-temperature fixing performance, and, because of an abrupt increase in droplet viscosity during polymerization of monomers, it may become difficult to control the average circularity of the toner to 0.970 or more.

The molecular weight of a resin component soluble in THF may be measured by GPC in the following way.

A solution prepared by dissolving the magnetic toner in THF at room temperature over a period of 24 hours at rest is filtered with a solvent-resistant membrane filter of 0.2 $\mu$m in pore diameter to obtain a sample solution, which is then measured under conditions shown below. To prepare the sample, the quantity of THF is so controlled that the component soluble in THF is in a concentration of from 0.4 to 0.6% by weight.

Apparatus: High-speed GPC HLC8120 GPC (manufactured by Toso Co., Ltd.)

Columns: Combination of seven columns, SHODEX KF-801, 802, 803, 804, 805, 806 and 807 (available from Showa Denko K. K.

Eluent: THF

Flow rate: 1.0 ml/min.

Oven temperature: 40.0° C.

Amount of sample injected: 0.10 ml

To calculate the molecular weight of the sample, a molecular weight calibration curve is used which is prepared using a standard polystyrene resin (available from Toso Co., Ltd., TSK Standard Polystyrene F-850, F-450, F-288, F-128, F-80, F-40, F-20, F-10, F-4, F-2, F-1, A-5000, A-2500, A-1000, A-500).

The resin component of the magnetic toner in the present invention has a tetrahydrofuran (THF)-insoluble matter, which may be in an amount of from 3 to 60% by weight, and preferably from 5 to 50% by weight, based on the weight of the resin component. If the THF-insoluble matter is less than 3% by weight, high-temperature offset tends to occur, tending to result in no good fixing performance. Also, the toner itself tends to have a low strength, and the toner tends to have a low long-term running performance in an environment of high temperature and high humidity. In addition, in the case when the magnetic toner particles are produced by suspension polymerization, which is the preferable process for producing the magnetic toner of the present invention, the viscosity of droplets may less increase during polymerization to tend to cause agglomeration of the magnetic fine particles or localization of the release agent in droplets, and consequently may cause localization of the magnetic fine particles or release agent in the toner particles, undesirably. If on the other hand the THF-insoluble matter is more than 60% by weight, the release agent may be inhibited from oozing out at the time of fixing and also the toner particles themselves may become hard, tending not to ensure any good low-temperature fixing performance.

The magnetic toner is greatly improved in fixing performance and running performance when it has the liberation percentage of the iron and iron compound of from 0.05 to 3.00% and the THF-insoluble matter in an amount of from 3 to 60% by weight. This is presumed to be a synergistic effect of the feature that the developing performance and fixing performance are improved by controlling the liberation percentage of the iron and iron compound to be 0.05 to 3.00% and the feature that fixing performance and also running performance are improved by controlling the THF-insoluble matter of the resin component of the toner to be 3 to 60% by weight, as stated above.

The THF-insoluble matter of the resin component of the magnetic toner is measured in the following way.

The magnetic toner or magnetic toner particles is/are precisely weighed in an amount of 1 g, which is/are then put in a cylindrical filter paper and is subjected to Soxhlet extraction for 20 hours using 200 ml of THF. Thereafter, the cylindrical filter paper is taken out, and then vacuum-dried at 40° C. for 20 hours to measure the weight of residues. The THF-insoluble matter is calculated according to the following Equation (4). The resin component of toner refers to the component obtained by removing the magnetic material, charge control agent, release agent component, external additive and pigment from the toner. In the measurement of the THF-insoluble matter, whether or not these contents are soluble or insoluble in THF is taken into account, and the THF-insoluble matter on the basis of the resin component is calculated.

Equation (4)

$$\text{THF-insoluble matter } (\%)=[(W_2-W_3)/(W_1-W_3-W_4)]100$$

(wherein $W_1$ represents the weight of toner; $W_2$ represents the weight of residues; $W_3$ represents the weight of components insoluble in THF, other than the resin component of toner; and $W_4$ represents the weight of components soluble in THF, other than the resin component of toner.)

The molecular weight of toner and the THF-insoluble matter of the resin component of toner are arbitrarily changeable depending on the type of binder resin and the condition of kneading in the case when the magnetic toner particles are produced by pulverization. In the case when produced by polymerization, they are also arbitrarily changeable depending on the types of initiator and cross-linking agent used and combination with their amount and so forth. The content of the THF-insoluble matter is also adjustable by using a chain transfer agent.

The binder resin of the magnetic toner may contain a styrene-acrylic copolymer, which may be crosslinked. The binder resin may contain a styrene-acrylic copolymer and a polyester resin, which is a saturated or an unsaturated polyester resin.

The magnetic toner of the present invention may also be mixed with a charge control agent to stabilize the charge characteristics. As the charge control agent, any known charge control agent may be used. In particular, a charge control agent having a high charging speed and also capable of maintaining a constant charge quantity stably are preferred. In the case when the magnetic toner particles are directly produced by polymerization, it is preferable to use charge control agents having a low polymerization inhibitory action and free of any solubilizate to the aqueous dispersion medium. As specific compounds, they may include, as negative charge control agents, metal compounds of aromatic carboxylic acids such as salicylic acid, alkylsalicylic acids, dialkylsalicylic acids, naphthoic acid and dicarboxylic acid; metal salts or metal complexes of azo dyes or azo pigments; polymer type compounds having sulfonic acid group or carboxylic acid group in the side chain; as well as boron compounds, urea compounds, silicon compounds, and carixarene. As positive charge control agents, they may include quaternary ammonium salts, polymer type compounds having such a quaternary ammonium salt in the side chain, guanidine compounds, nigrosine compounds, and imidazole compounds.

As methods for making magnetic toner particles contain the charge control agent, there are a method of internally adding it into the magnetic toner particles and a method of externally adding it to the magnetic toner particles. The quantity of the charge control agent used depends on the type of the binder resin, the presence of any other additives, and the manner by which the toner is produced, inclusive of the manner of dispersion, and can not be absolutely specified. Preferably, when internally added, the charge control agent may be used in an amount ranging from 0.1 to 10 parts by weight, and more preferably from 0.1 to 5 parts by weight, based on 100 parts by weight of the binder resin. When externally added to the magnetic toner particles, it may preferably be added in an amount of from 0.005 to 1.0 part by weight, and more preferably from 0.01 to 0.3 part by weight, based on 100 parts by weight of the toner.

In the magnetic toner of the present invention, the addition of the charge control agent is not essential. The triboelectric charging of toner with a toner layer thickness regulation member or the toner-carrying member may intentionally be utilized, thus the magnetic toner need not necessarily contain the charge control agent.

A process for producing the synthetic magnetic toner of the present invention by suspension polymerization is described below. Usually, to a toner composition, i.e., a polymerizable monomer to be formed into binder resin, the magnetic material, the release agent, a plasticizer, the charge control agent, a cross-linking agent, and optionally a colorant, which are components necessary for toners, and other additives (e.g., a high polymer and a dispersant) are added, followed by uniform dissolution or dispersion by means of a dispersion machine to form a polymerizable monomer composition, which is then suspended in an aqueous phase containing a dispersion stabilizer.

In the production of the synthetic magnetic toner of the present invention, the polymerizable monomer constituting the polymerizable monomer composition may include the following.

The polymerizable monomer may include styrene; styrene monomers such as o-methylstyrene, m-methylstyrene, p-methylstyrene, p-methoxystyrene and p-ethylstyrene; acrylic esters such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate and phenyl acrylate; methacrylic esters such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; and monomers such as acrylonitrile, methacrylonitrile and acrylamides. Any of these monomers may be used alone or in the form of a mixture. Of the foregoing monomers, styrene or a styrene derivative may preferably be used alone or in the form of a mixture with other monomer, in view of developing performance and running performance of the toner.

In the production of the synthetic magnetic toner of the present invention, the polymerization may be carried out by adding the resin in a polymerizable monomer composition. For example, a polymerizable monomer component containing a hydrophilic functional group such as an amino group, a carboxylic group, a hydroxyl group, a sulfonic acid group, a glycidyl group or a nitrile group can not be used because it is water-soluble as a monomer and hence dissolves in an aqueous suspension to cause emulsion polymerization. When such a polymerizable monomer component should be introduced into toner particles, it may preferably be used in the form of a copolymer such as a random copolymer, a block copolymer or a graft copolymer, of any of these with a vinyl compound such as styrene or ethylene, in the form of a polycondensation product such as polyester or polyamide, or in the form of a polyaddition product such as polyether or polyimine. Where the high polymer containing such a polar functional group is made present together in the toner particles, the wax component described previously can be phase-separated, and can more firmly be included into particles, so that magnetic toner particles having good anti-blocking properties and developing performance can be obtained.

Of these resins, incorporation of a polyester resin can especially be greatly effective. This is presumed to be for the following reason. The polyester resin contains many ester linkages, which are functional groups having a relatively high polarity, and hence the resin itself has a high polarity. On account of this polarity, a strong tendency that the polyester localizes at droplet surfaces of the polymerizable monomer composition is shown in the aqueous dispersion medium, and the polymerization proceeds in that state kept as it is, until toner particles are formed. Hence, the polyester resin localizes at toner particle surfaces to provide uniform surface state and surface composition, so that the toner can have a uniform charging performance and also, because of a synergistic effect with the good enclosure of the release agent, can enjoy very good developing performance.

As the polyester resin used in the present invention, a saturated polyester resin or an unsaturated polyester resin, or the both, may be used under appropriate selection in order to control performances of the toner, such as charging performance, running performance and fixing performance.

As the polyester resin used in the present invention, conventional ones may be used which are constituted of an alcohol component and an acid component. The both components are as exemplified below.

As the alcohol component, it may include ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, cyclohexane dimethanol, butenediol, octenediol, cyclohexene dimethanol, hydrogenated bisphenol A, a bisphenol derivative represented by the following Formula (III):

(III)

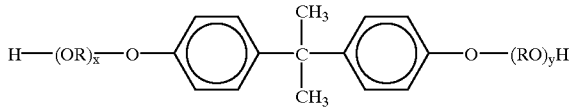

wherein R represents an ethylene group or a propylene group, x and y are each an integer of 1 or more, and an average value of x+y is 2 to 10;

or a hydrogenated product of the compound of Formula (III), and a diol represented by the following Formula (IV):

(IV)

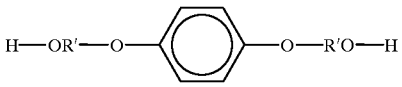

wherein R' represents $—CH_2CH_2—$, $—CH_2CH(CH_3)—$, or $—CH_2–C(CH_3)_2—$;

or a hydrogenated diol of the compound of Formula (IV).

As a dibasic carboxylic acid, it may include benzene dicarboxylic acids or anhydrides thereof, such as phthalic acid, terephthalic acid, isophthalic acid and phthalic anhydride; alkyldicarboxylic acids such as succinic acid, adipic acid, sebacic acid and azelaic acid, or anhydrides thereof, or succinic acid or its anhydride substituted with an alkyl group having 6 to 18 carbon atoms or an alkenyl group having 6 to 18 carbon atoms; and unsaturated dicarboxylic acids such as fumaric acid, maleic acid, citraconic acid and itaconic acid, or anhydrides thereof.

The alcohol component may further include polyhydric alcohols such as glycerol, pentaerythritol, sorbitol, sorbitan, and oxyakylene ethers of novolak phenol resins. The acid component may further include polycarboxylic acids such as trimellitic acid, pyromellitic acid, 1,2,3,4-butanetetracarboxylic acid, benzophenonetetracarboxylic acid and anhydrides thereof.

Of the above polyester resins, preferably used is an alkylene oxide addition product of the above bisphenol A, which has superior chargeability and environmental stability and is well balanced in other electrophotographic performances. In the case of this compound, the alkylene oxide may preferably have a average addition molar number of from 2 to 10 in view of fixing performance and running performance.

The polyester resin in the present invention may preferably be composed of from 45 to 55 mol % of the alcohol component and from 55 to 45 mol % of the acid component in the whole components.

The polyester resin may preferably have an acid value of from 0.1 to 50 mg.KOH/1 g of resin, in order for the resin to become present at magnetic toner particle surfaces in the production of the magnetic toner of the present invention and for the resultant toner particles to exhibit a stable charging performance. If it has an acid value less than 0.1 mg.KOH/1 g of resin, it may be present at the toner particle surfaces in an absolutely insufficient quantity. If it has an acid value more than 50 mg.KOH/1 g of resin, it tends to adversely affect the charging performance of toner. In the present invention, it may more preferably have the acid value in the range of from 5 to 35 mg.KOH/1 g of resin.

In the present invention, as long as physical properties of the magnetic toner particles obtained are not adversely affected, it is also preferable to use two or more types of polyester resins in combination or to regulate physical properties of the polyester resin by modifying it with, e.g., a silicone compound or a fluoroalkyl-group-containing compound.

In the case when a high polymer containing such a polar functional group is used, those having an average molecular weight of 5,000 or more may preferably be used. Those having an average molecular weight less than 5,000, especially 4,000 or less, are not preferable because a low-molecular weight component of the high polymer tends to concentrate in the vicinity of the surfaces of toner particles to tend to adversely affect developing performance, anti-blocking properties and so forth.

For the purpose of improving dispersibility of materials, fixing performance or image characteristics, a resin other than the foregoing may also be added in the monomer composition. Resins usable therefor may include polystyrene; homopolymers of styrene derivatives such as polyvinyl toluene: styrene copolymers such as a styrene-propylene copolymer, a styrene-vinyltoluene copolymer, a styrene-vinylnaphthalene copolymer, a styrene-methyl acrylate copolymer, a styrene-ethyl acrylate copolymer, a styrene-butyl acrylate copolymer, a styrene-octyl acrylate copolymer, a styrene-dimethylaminoethyl acrylate copolymer, a styrene-methyl methacrylate copolymer, a styrene-ethyl methacrylate copolymer, a styrene-butyl methacrylate copolymer, a styrene-dimethylaminoethyl methacrylate copolymer, a styrene-methyl vinyl ether copolymer, a styrene-ethyl vinyl ether copolymer, a styrene-methyl vinyl ketone copolymer, a styrene-butadiene copolymer, a styrene-isoprene copolymer, a styrene-maleic acid copolymer and a styrene-maleate copolymer; and polymethyl methacrylate, polybutyl methacrylate, polyvinyl acetate, polyethylene, polypropylene, polyvinyl butyral, silicone resins, polyester resins, polyamide resins, epoxy resins, polyacrylic acid resins, rosins, modified rosins, terpene resins, phenolic resins, aliphatic or alicyclic hydrocarbon resins, and aromatic petroleum resins, paraffin wax, and carnauba wax. Any of these may preferably be added in an amount of from 1 to 20 parts by weight based on 100 parts by weight of the polymerizable monomer. Its addition in an amount less than 1 part by weight may be low effective. On the other hand, its addition in an amount more than 20 part by weight tends to make it difficult to design various physical properties of the synthetic magnetic toner particles.

In addition, a polymer having a molecular weight outside the range of molecular weight of the toner particles obtained by polymerizing the polymerizable monomer may be dissolved to carry out polymerization. This enables production of toner particles having a broad molecular weight distribution and a high anti-offset properties.

As the polymerization initiator used in the production of the synthetic magnetic toner particles of the present invention, a polymerization initiator having a half-life of from 0.5 to 30 hours may be added at the time of polymerization, in an amount of from 0.5 to 20 parts by weight based on 100 parts by weight of the polymerizable monomer to carry out polymerization. This enables production of a polymer whose peak top of the main peak is in the region of molecular weight of from 5,000 to 50,000.

The polymerization initiator used in the present invention may include conventionally known azo type polymerization initiators and peroxide type polymerization initiators. The azo type polymerization initiators are exemplified by 2,2'-azobis-(2,4-dimethylvaleronitrile), 2,2'-azobisisobutyronitrile, 1,1 -azobis-(cyclohexane-1-carbonitrile), 2,2'-azobis-4-methoxy-2,4-dimethylvaleronitrile and azobisisobutyronitrile. The peroxide type polymerization initiators may include peroxyesters such as t-butyl peroxyacetate, t-butyl peroxylaurate, t-butyl peroxypivarate, t-butyl peroxy-2-ethyl hexanoate, t-butyl peroxyisobutyrate, t-butyl peroxyneodecanoate, t-hexyl peroxyacetate, t-hexyl peroxylaurate, t-hexyl peroxypivarate, t-hexyl peroxy-2-ethyl hexanoate, t-hexyl peroxyisobutyrate, t-hexyl peroxyneodecanoate, t-butyl peroxybenzoate, α,α'-bis(neodecanoylperoxy) diisopropylbenzene, cunyl peroxyneodicanoate, 1,1,3,3-tetramethylbutyl peroxy-2-ethylhexanoate, 1,1,3,3-tetramethylbutyl peroxyneodicanoate, 1-cyclohexyl-1-methyethyl peroxyneodicanoate, 2,5-dimethyethyl-2,5-bis (2-ethylhexanoylperoxy)hexane, 1-cyclohexyl-1-methylethyl peroxy-2-ethylhexanoate, t-hexyl peroxyisopropyl monocarbonate, t-butyl peroxyisopropyl monocarbonate, t-butyl peroxy-2-hexyl monocarbonate, t-hexyl peroxybonzoate, 2,5-dimethyethyl-2,5-bis (benzoylperoxy)hexane, t-butyl peroxy-m-toluoyl benzoate, bis(t-butylperoxy)isophthalate, t-butyl peroxymaleic acid, t-butyl peroxy-3,5,5-trimethyl hexanoate, and 2,5-dimethyl-2,5-bis(m-toluoylperoxy)hexane; diacyl peroxides such as benzoyl peroxide, lauroyl peroxide, and isobutyryl peroxide; peroxydicarbonates such as diisopropyl peroxydicarbonate, and bis(4-t-butylcyclohexyl) peroxydicarbonate; peroxyketals such as 1,1-di-t-butyl peroxycyclohexane, 1,1-di-t-hexyl peroxycyclohexane, 1,1-di-t-butyl peroxy-3,3,5-trimethylcyclohexane, and 2,2-di-t-butyl peroxy butane; dialkyl peroxides such as di-t-butyl peroxide, dicumyl peroxide, and t-butylcumyl peroxide; and t-butyl peroxyallyl monocarbonate. Any of these initiators may be used in combination of two or more types.

When the magnetic toner particles of the magnetic toner of the present invention is produced by polymerization, it is important to add a cross-linking agent so as to form the THF-insoluble matter. Such a cross-linking agent may be added in an amount of from 0.001 to 15% by weight based on 100 parts by weight of the polymerizable monomer.

Here, as the cross-linking agent, compounds chiefly having at least two polymerizable double bonds may be used. It may including, e.g., aromatic divinyl compounds such as divinyl benzene and divinyl naphthalene; carboxylic acid esters having two double bonds such as ethylene glycol diacrylate, ethylene glycol dimethacrylate and 1,3-butanediol dimethacrylate; divinyl compounds such as divinyl aniline, divinyl ether, divinyl sulfide and divinyl sulfone; and compounds having at least three vinyl groups. Any of these may be used alone or in the form of a mixture.

In the process of producing the magnetic toner particles according to the present invention by polymerization, a composition containing at least the magnetic material, polymerizable monomer and release agent described previously is dissolved or dispersed by means of a dispersion machine such as a homogenizer, a ball mill, a colloid mill or an ultrasonic dispersion machine to form a polymerizable monomer composition, which is then suspended in an aqueous medium containing a dispersion stabilizer. Here, a high-speed dispersion machine such as a high-speed stirrer or an ultrasonic dispersion machine may be used to make the magnetic toner particles have the desired particle size without delay, and this can more readily make the resultant toner particles have a sharp particle size distribution.

As the time at which the polymerization initiator is added, it may be added simultaneously when other additives are added in the polymerizable monomer, or may be mixed immediately before they are suspended in the aqueous medium. Also, a polymerization initiator having been dissolved in the polymerizable monomer or solvent may be added before the polymerization is initiated.

After granulation, agitation may be carried out using a usual agitator in such an extent that the state of particles is maintained and also the particles can be prevented from floating and settling.

In the case when the magnetic toner particles according to the present invention are produced by the polymerization, any known surface-active agents or organic or inorganic dispersants may be used as the dispersion stabilizer. In particular, the inorganic dispersants may hardly cause any harmful ultrafine powder and they attain dispersion stability on account of their steric hindrance. Hence, even when reaction temperature is changed, they may hardly loose the stability, can be washed with ease and may hardly adversely affect toners, and hence they may preferably be used. As examples of such inorganic dispersants, they may include phosphoric acid polyvalent metal salts such as calcium phosphate, magnesium phosphate, aluminum phosphate and zinc phosphate; carbonates such as calcium carbonate and magnesium carbonate; inorganic salts such as calcium metasilicate, calcium sulfate and barium sulfate; and inorganic oxides such as calcium hydroxide, magnesium hydroxide, aluminum hydroxide, silica, bentonite and alumina.

When these inorganic dispersants are used, they may be used as they are. In order to obtain finer particles, particles of the inorganic dispersant may be formed in the dispersion medium. For example, in the case of calcium phosphate, an aqueous medium phosphate solution and an aqueous calcium chloride solution may be mixed under high-speed agitation, whereby water-insoluble calcium phosphate can be formed and more uniform and finer dispersion can be made. Here, water-soluble sodium chloride is simultaneously formed as a by-product. However, the presence of such a water-soluble salt in the aqueous medium keeps the polymerizable monomer from being dissolved in water to make any ultrafine toner particles become formed with difficulty by emulsion polymerization, and hence this is more favorable. Since its presence may be an obstacle when residual polymerizable monomers are removed at the termination of polymerization reaction, it is better to exchange the aqueous medium or desalt it with an ion-exchange resin. The inorganic dispersant can substantially completely be removed by dissolving it with an acid or an alkali after the polymerization is completed.

Any of these inorganic dispersants may preferably be used alone in an amount of from 0.2 to 20 parts by weight based on 100 parts by weight of the polymerizable monomer. These may hardly cause ultrafine particles, but are weak in making toner particles finer. Accordingly, a surface-active agent may be used in combination in an amount of from 0.001 to 0.1 part by weight.

Such a surface-active agent may include, e.g., sodium dodecylbenzenesulfate, sodium tetradecyl sulfate, sodium pentadecyl sulfate, sodium octyl sulfate, sodium oleate, sodium laurate, sodium stearate and potassium stearate.

In the step of polymerization, the polymerization may be carried out at a polymerization temperature set at 40° C. or above, and commonly at a temperature of from 50 to 90° C. Where the polymerization is carried out in this temperature range, the release agent or wax to be enclosed in particles becomes deposited by phase separation and more perfectly enclosed in particles. In order to consume residual polymerizable monomers, the reaction temperature may be raised to 90 to 150° C. if it is done at the termination of polymerization reaction.

The synthetic magnetic toner particles are, after the polymerization is completed, may be filtered, washed and dried by conventional methods, and an inorganic fine powder may optionally be mixed so as to be deposited on the magnetic toner particle surfaces, thus the magnetic toner of the present invention can be obtained. Also, it is a preferred embodiment that the step of classification is added to the production process to remove any coarse powder and fine powder.

In the present invention, it is also a preferred embodiment that the magnetic toner has an inorganic fine powder having a number-average primary particle diameter of from 4 to 80 nm which is added as a fluidity improver. The inorganic fine powder is added in order to improve the fluidity of the magnetic toner and make the charging of the magnetic toner particles uniform, where it is also a preferred embodiment that the inorganic fine powder is treated, e.g., hydrophobic-treated so as to be endowed with the function to regulate the charge quantity of toner and improve the environmental stability of toner.

If the inorganic fine powder has a number-average primary particle diameter larger than 80 nm or where the inorganic fine powder of 80 nm or smaller in diameter is not added, the transfer residual toner tends to stick or cling to the charging member when it adheres to the charging member, tending to make it difficult to attain a good charging performance stably. Also, it may be hard to attain a good fluidity of the magnetic toner, so that the magnetic toner particles tend to be non-uniformly charged to tend to cause problems of fogging greatly, a decrease in image density and toner scatter. If the inorganic fine powder has a number-average primary particle diameter smaller than 4 nm, the inorganic fine powder may be strongly susceptible to agglomerate, and tends to behave not as primary particles but as agglomerates having a broad particle size distribution which are so strongly agglomerative as to break up with difficulty even by disintegration treatment, so that the agglomerates may scratch the image-bearing member or toner-carrying member to tend to cause faulty images. In order to more uniform the charge quantity distribution of the magnetic toner particles, the inorganic fine powder may more preferably have a number-average primary particle diameter of from 6 to 35 $\mu$m.

In the present invention, as a method for measuring the number-average primary particle diameter of the inorganic fine powder, it may be measured in the following way. On a photograph of toner particles, magnified with a scanning electron microscope, and further comparing it with a photograph of toner particles mapped with elements the inorganic fine powder contains, by an elemental analysis means such as XMA (X-ray microanalyzer) attached to the scanning electron microscope, at least 100 primary particles of the inorganic fine powder which are present in the state they adhere to or liberate from toner particle surfaces are observed to measure their number-based average primary particle diameter to determine the number-average primary particle diameter.

As the inorganic fine powder used in the present invention, fine silica powder, fine titanium oxide powder, fine alumina powder or the like may be used, which may be used alone or in combination of some types. As the fine silica powder, usable are, e.g., fine silica powder which is what is called dry-process silica or fumed silica produced by vapor phase oxidation of silicon halides and fine silica powder which is what is called wet-process silica produced from water glass, either of which may be used. The dry-process silica is preferred, as having less silanol groups on the surface and inside of the fine silica powder and leaving less production residues such as $Na_2O$ and $SO_3^{2-}$. In the dry-process silica, it is also possible to use, in its production step, other metal halide compound such as aluminum chloride or titanium chloride together with the silicon halide to give a composite fine powder of silica with other metal oxide.

The inorganic fine powder having a number-average primary particle diameter of from 4 to 80 nm may preferably be added in an amount of from 0.1 to 3.0% by weight based on the weight of the magnetic toner particles. In its addition in an amount less than 0.1% by weight, it can be effective with difficulty. Its addition in an amount more than 3.0% by weight may cause a lowering of fixing performance.

The content of the inorganic fine powder can be determined by fluorescent X-ray analysis and using a calibration curve prepared from a standard sample.

In the present invention, in view of performances in an environment of high temperature and high humidity, the inorganic fine powder may preferably be a powder having been hydrophobic-treated. Where the inorganic fine powder added to the magnetic toner has moistened, the magnetic toner particles may be charged in a greatly low quantity to tend to cause toner scatter.

As a treating agent used for such hydrophobic treatment, usable are a silicone varnish, a modified silicone varnish of various types, a silicone oil, a modified silicone oil of various types, a silane coupling agent, other organic silicon compound and an organic titanium compound, any of which may be used alone or in combination for the treatment.

In particular, an inorganic fine powder having been treated with a silicone oil is preferred. Those obtained by subjecting the inorganic fine powder to treatment with a silicone oil simultaneously with or after the hydrophobic treatment with a silane compound are more preferred in order to maintain the charge quantity of the magnetic toner particles at a high level even in an environment of high temperature and high humidity and to prevent toner scatter.

As a method for such treatment of the inorganic fine powder, for example the inorganic fine powder may be treated, as first-stage reaction, with the silane compound to effect silylation reaction to cause silanol groups to disappear by chemical coupling, and thereafter, as second-stage reaction, with the silicone oil to form hydrophobic thin films on particle surfaces.

The silicone oil may preferably be those having a viscosity at 25° C. of from 10 to 200,000 $mm^2/s$, and more preferably from 3,000 to 80,000 $mm^2/s$. If its viscosity is lower than 10 $mm^2/s$, the inorganic fine powder may have no stability, and the image quality tends to lower because of thermal and mechanical stress. If its viscosity is higher than 200,000 $mm^2/s$, it tends to be difficult to make uniform treatment.

As the silicone oil used, particularly preferred are, e.g., dimethylsilicone oil, methylphenylsilicone oil, α-methylstyrene-modified silicone oil, chlorophenylsilicone oil and fluorine-modified silicone oil.

As a method for treating the inorganic fine powder with the silicone oil, for example the inorganic fine powder having been treated with a silane compound and the silicone oil may directly be mixed by means of a mixer such as a Henschel mixer, or a method may be used in which the silicone oil is sprayed on the inorganic fine powder. Alternatively, a method may be used in which the silicone oil is dissolved or dispersed in a suitable solvent and thereafter the inorganic fine powder is added and mixed, followed by removal of the solvent. In view of an advantage that agglomerates of the inorganic fine powder may less occur, the method making use of a sprayer is preferred.

The silicone oil may be used for the treatment in an amount of from 1 to 40 parts by weight, and preferably from 3 to 35 parts by weight, based on 100 parts by weight of the inorganic fine powder. If the silicone oil is in a too small quantity, any the inorganic fine powder can not be made well hydrophobic. If it is in a too large quantity, difficulties such as fogging tend to occur.

The inorganic fine powder used in the present invention may preferably be fine silica powder, fine alumina powder or fine titanium oxide powder as stated above, in order to endow the magnetic toner with a good fluidity. In particular, fine silica powder is preferred. It is more preferable to use fine silica powder having a specific surface area ranging from 20 to 350 $m^2/g$, and more preferably from 25 to 300 $m^2/g$, as measured by the BET method utilizing nitrogen absorption.

The specific surface area is measured according to the BET method, where nitrogen gas is adsorbed on sample surfaces using a specific surface area measuring device AUTOSOBE 1 (manufactured by Yuasa Ionics Co.), and the specific surface area is calculated by the BET multiple point method.

In the present invention, in the case when the fine silica powder is used as the inorganic fine powder, the fine silica powder may preferably stand liberated from the magnetic toner particles in a liberation percentage of from 0.1 to 2.0%, and more preferably from 0.1 to 1.50%. The liberation percentage of fine silica powder is measured with the particle analyzer described previously. As a specific measuring method, carbon atoms are measured in channel 1, and silicon atoms in channel 2 (measurement wavelength: 288.160 nm; a recommended value is used as K-factor), and the liberation percentage of fine silica powder is determined from the following equation.

Liberation percentage (%) of fine silica powder=100×[(the number of light emissions of only silicon atoms)/(the number of light emissions of silicon atoms having emitted light simultaneously with carbon atoms+the number of light emissions of only silicon atoms)]

Investigation made by the present inventors have revealed that, when the liberation percentage of fine silica powder is less than 0.1%, serious fog and coarse images tend to occur in the latter half of a many-sheet image reproduction test, especially in an environment of high temperature and high humidity. It is commonly considered that, in the environment of high humidity, external additives tend to be buried in toner particles because of stress applied by any regulation member and so forth and, after printing on many sheets, toners may come to have a fluidity inferior to that at the initial stage, tending to cause the above problems. However, such problems may hardly occur when the liberation percentage of fine silica powder is 0.1% or more. This is presumably because the presence of fine silica powder standing liberated to a certain degree brings about an improvement in the fluidity of the magnetic toner and hence the fine silica powder may hardly be buried in the magnetic toner particles during the reproduction running and also, even when the fine silica powder adhering to the magnetic toner particles is buried therein because of stress, the fine silica powder standing liberated comes to adhere to the magnetic toner particles to make the fluidity of toner less lower.

On the other hand, if the liberation percentage of fine silica powder is more than 2.00%, the fine silica powder standing liberated may contaminate the charging regulation member to tend to cause serious fog, undesirably. Also, in such a state, the toner charging uniformity tends to be damaged to tend to cause a lowering of transfer efficiency. Accordingly, it is important for the liberation percentage of fine silica powder to be from 0.1 to 2.0%.

The magnetic toner of the present invention may also preferably further have a conductive fine powder having a volume-average particle diameter which is smaller than the weight-average particle diameter of the toner, and may more preferably have a conductive fine powder having a volume-average particle diameter which is larger than the number-average primary particle diameter of the above mentioned inorganic fine powder and is smaller than the weight-average particle diameter of the toner.

This is because the magnetic toner having the conductive fine powder can be improved in its developing performance and can attain a high image density. Also, its effect can be remarkable when the conductive fine powder stands liberated from the magnetic toner particles at a liberation percentage of from 5.0 to 50.0%. The reason therefor is unclear, and is presumed to be that the presence of the conductive fine powder standing liberated makes the magnetic toner particles chargeable more uniformly and further the conductive fine powder adhering to the magnetic toner particles behaves like a microcarrier to bring about an improvement in developing performance. Accordingly, this effect can not be sufficient if the liberation percentage of conductive fine powder is less than 5.0%. If on the other hand the liberation percentage of conductive fine powder is more than 50.0%, the conductive fine powder may less uniformly adhere to the magnetic toner particles, undesirably.

The liberation percentage of conductive fine powder is measured with the particle analyzer described previously. As a specific measuring method, the element the conductive fine powder has is measured in channel 3 (measurement wavelength differs depending on the kind of metallic element. For example, when zinc oxide is used as the conductive fine powder, measurement wavelength is 334.500 nm; a recommended value is used as K-factor), and the liberation percentage of conductive fine powder is determined from the following equation.

Liberation percentage (%) of conductive fine powder=100×[(the number of light emissions of only metal the conductive fine powder has)/(the number of light emissions of metal the conductive fine powder has, having emitted light simultaneously with carbon atoms+the number of light emissions of only metal the conductive fine powder has)]

The conductive fine powder also plays an important role when the magnetic toner of the present invention is applied in the image-forming method making use of the development-cleaning system.

Here, a description is made as to the behavior of the magnetic toner particles and the conductive fine powder in the image-forming method in which the conductive fine powder is externally added to the magnetic toner particle.

The conductive fine powder contained in the magnetic toner is moved to the side of the image-bearing member in an appropriate quantity together with the magnetic toner particles when an electrostatic latent image on the side of the image-bearing member is developed in the developing step. The magnetic toner image on the image-bearing member is transferred to the side of the transfer material in the transfer step. The conductive fine powder on the image-bearing member is partly adhered to the transfer material, while the remaining portion of the conductive fine powder is adhered to and retained on the image bearing member to remain there. When the toner image is transferred upon the application of a transfer bias with the opposite polarity to that of the magnetic toner, the magnetic toner is attracted to the side of the transfer material and positively moved to the transfer material, while the conductive fine powder on the image-bearing member is not positively moved to the transfer material side because of its conductivity, so that the conductive fine powder is partly adhered to the transfer material side, but the remaining portion of the conductive fine powder is adhered to and retained on the image-bearing member to remain there.

As to the image-forming method using no cleaner, the transfer residual toner which remains on the image-bearing member surface after the transfer and the remaining conductive fine powder as described above are transported as they stand to the contact zone between the image-bearing member and the contact charging member, serving as a charging zone, with the aid of the movement of the image bearing member surface, and adhered to or incorporated with the contact charging member. Accordingly, the contact charging of the image bering member is carried out in the condition that the conductive fine powder is interposed between the image-bearing member and the contact charging member and present at the contact zone.

The presence of the conductive fine powder enables the contact charging member to maintain the close contacting with and the contact resistance to the image-bearing member, regardless of the contamination of the contact charging member due to the adherence and incorporation of the transfer residual toner in the case where a small amount of the transfer residual toner is moved to the contact charging member. As a result, the image-bearing member can satisfactorily be charged with the contact charging member.

Also, the transfer residual toner having adhered to and gotten mixed with the contact charging member is charged by a charging bias applied from the charging member to the image-bearing member so as to have with the same polarity as that of the charging bias and discharged gradually onto the image-bearing member from the contact charging member and then carried to the developing portion with the movement of the image-bearing member and further cleaned (recovered) in the development step.

Since, with the image formation repeated, the conductive fine powder contained in the magnetic toner is successively fed to the charging zone in such a manner that the conductive fine powder is moved to the image-bearing member surface in the developing zone and carried to the charging zone by way of the transfer zone with the movement of the image-bearing member surface, the charging performance can be prevented from lowering even if the conductive fine powder decreases in its amount due to its coming off in the charging step and becomes deteriorated, and as a result, satisfactory charging performance is maintained stably.

The liberation percentage of the conductive fine powder may preferably be 5.0 to 50.0%. With the liberation percentage of more than 50.0%, a larger quantity of the conductive fine powder tends to be collected in the development-cleaning step, and the conductive fine powder tends to accumulate within the developing assembly, tending to cause a deterioration of the charging properties and developing performance of the toner, which is not desirable.

With the liberation percentage of the conductive fine powder of less than 5.0%, the above-mentioned technical advantages may hardly be achieved.

The conductive fine powder may preferably have a resistivity of $1\times10^9$ Ωcm or below for the purpose of accelerating the uniformity in the charge quantity of the magnetic toner. If the conductive fine powder has a resistivity larger than $1\times10^9$ Ωcm, its effect of accelerating the charging to obtain a satisfactory charging performance may hardly be achieved even when the conductive fine powder is present between the charging member and the image-bearing member at the contact zone or its vicinity as the charging zone to maintain the close contacting properties of the contact charging member with the image-bearing member through the conductive fine powder interposed. To make the conductive fine powder sufficiently display its charging accelerating effect to achieve a good charging performance in a stable manner, the conductive fine powder may preferably have a resistance smaller than that of the surface portion of the contact charging member or the contact zone between the contact charging member and the image-bearing member. More preferably, the conductive fine powder may have a resistivity of $1\times10^8$ Ωcm or below since the image-bearing member may better be charged regardless of hinderance of charging due to the adherence and incorporation of the insulating transfer residual toner to the contact charging member.

In the present invention, the conductive fine powder may preferably be contained in the magnetic toner in an amount of 0.5 to 10% by weight based on the total weight of the magnetic toner. With the content of the conductive fine powder in the total magnetic toner of less than 0.5% by weight, a sufficient quantity of the conductive fine powder to achieve a good charging of the image-bearing member regardless of the hinderance of charging due to the adhesion and incorporation of the insulating transfer residual toner to the contact charging member may hardly be caused to be present at the contact zone between the charging member and the image-bearing member or in its vicinity, serving as the charging zone, tending to cause a lowering of the charging performance and a faulty charging. On the other hand, with the content of the conductive fine powder of larger than 10% by weight, the conductive fine powder is collected in a too much amount in the development-cleaning step to tend to lower the charging ability and developing performance of the toner in the developing zone, tending to lower the image density and cause toner scatters. The conductive fine powder may more preferably be contained in the magnetic toner in an amount of 0.5 to 5% by weight based on the total weight of the magnetic toner.

As to the particle diameter of the conductive fine powder, the conductive fine powder may preferably have a volume-average particle diameter of not less than 0.1 μm and preferably be smaller than the weight-average particle diameter of the magnetic toner. If the volume-average particle diameter of the conductive fine powder is smaller, the conductive fine powder should be contained in the magnetic toner at a lower level to prevent the developing performance of the toner from lowering. When the volume-average particle diameter of the conductive fine powder is less than 0.1 μm, an effective amount of the conductive fine powder may not be ensured, and in the development step, a sufficient quantity of the conductive fine powder to achieve a good charging of the image-bearing member regardless of the hindered charging due to the adhesion and incorporation of the insulating transfer residual toner to the contact charging member may hardly be caused to be present at the contact zone or in its vicinity as the charging zone between the charging member and the image-bearing member, tending to cause a faulty charging.

When the conductive fine powder has a volume-average particle diameter larger than the weight-average particle diameter of the magnetic toner, the conductive fine powder may come off from the charging member to intercept or disperse an exposure light to form an electrostatic latent image, resulting in the formation of faulty latent image and the deterioration of image quality. Further, when the conductive fine powder has a larger volume-average particle diameter, the number of the particles per unit weight may decrease, and accordingly, the conductive fine powder should be contained in the magnetic toner in a larger amount for the purpose of successively feeding the conductive fine powder to the contact zone between the charging member and the image-bearing member or in its vicinity as the charging zone to cause the conductive fine powder to be interposed therebetween in view of the decrease and deterioration of the conductive fine powder due to its coming off from the charging member, and of maintaining the close contacting performance of the contact charging member with the image-bearing member through the interposed conductive fine powder to obtain a good charging performance stably. However, if the content of the conductive fine powder is made too much, the charging ability and developing performance of the magnetic toner as a whole may be deteriorated especially in an environment of a high humidity, thereby tending to lower the image density and cause the toner scatters. In view of the above, the conductive fine powder may preferably have a volume-average of not more than 5 μm.

Also, the conductive fine powder may preferably be transparent, white or light color since it may not be conspicuous as fog when it is transferred to the transfer material. The conductive fine powder may preferably be a transparent, white or light color powder in such a sense that the conductive fine powder may not hinder the exposed light in the latent image-forming step. More preferably, the conductive fine powder may have a transmittance to the exposed light of not less than 30%.

In the present invention, the light transmitting properties of the conductive fine powder can be measured in the following manner. The measurement of the transmittance is carried out in the condition in which the conductive fine powder is fixed in one layer on a transparent film having an adhesive layer on one side. A light is irradiated to film in the direction perpendicular to the sheet, and the light having transmitted therethrough and reached the back side of the film is collected to measure the light quantity. The light quantity in the case of using the film only and that in the case of using the film to which the conductive fine powder is adhered are determined to obtain a net light quantity so that the transmittance of the conductive fine powder is calculated. Practically, a transmitting type densitometer (Model 310T commercially available from X-Rite Co.) can be used for measuring the transmittance.

The volume-average particle diameter and particle size distribution of the conductive fine powder of the present invention is measured by using a laser diffraction type particle size distribution measuring unit (Model LS-230, commercially available from Coulter Co.) mounted with a liquid module, within a measuring range of 0.04 to 2,000 μm. Specifically, a trace amount of surface-active agent is added to 10 ml of pure water, to which 10 mg of a sample of the conductive fine powder is added, which is then dispersed with a ultrasonic dispersing machine (ultrasonic homogenizer) for 10 minutes, and thereafter, the measurement is carried out under the conditions that the measuring period of time is 90 seconds and the number of times for measurement is one.

In the present invention, the particle size and particle size distribution of the conductive fine powder may be controlled by setting the preparation method and the preparation conditions so as to obtain a desired particle size and particle size distribution of the primary particles of the conductive fine powder when prepared, and other methods are also available including a method of causing smaller particles of the primary particles to agglomerate, a method of pulverizing larger particles of the primary particles, and a method of classifying the primary particles. Moreover, a method of causing the conductive fine powder to adhere to or fixing the conductive fine powder on a portion or the whole of the surface of base material particles (particles acting as nucleus to which the conductive material is adhered or fixed when the conductive fine powder is prepared) with a desired particle size and particle size distribution, and a method of using a conductive fine powder in the form in which the conductive component is dispersed into particles with a desired particle size and particle size distribution are also possible. if desired, those methods may be used in a combination to control the particle size and particle size distribution of the conductive fine powder.

The particle diameter of the particles of the conductive fine powder as formed existing as an agglomerated matter is defined as an average particle diameter for the agglomerated matter. It does not matter whether the conductive fine powder exists in the state of primary particle or in the state of secondary particle as agglomerated. The conductive fine powder may be used irrespective of its agglomeration state or form as long as it is present as the agglomerated matter at the contact zone as the charging zone between the charging member and the image-bearing member or in its vicinity to realize the functions as a charging aid or charging accelerator.

In the present invention, the resistance of the conductive fine powder may be measured by the tablet method and normalized. About 0.5 g of a sample of the powder is placed within a cylinder with a base area of 2.26 $cm^2$, and a pressure of 15 kg is applied to the electrodes at the upper and lower positions simultaneously with applying a voltage of 100 V to measure the resistance value, which is then normalized to calculate the resistivity.

The conductive fine powder may preferably be non-magnetic, including for example, fine carbon powder such as carbon black and graphite; fine metal powder such as of copper, gold, silver, aluminum and nickel; fine metal oxide powder such as zinc oxide, titanium oxide, tin oxide, aluminum oxide, indium oxide, silicon oxide, magnesium oxide, barium oxide, molybdenum oxide and tungsten oxide; fine metal compound powder such as molybdenum sulfide, cadmium sulfide and potassium titanate; or compound oxide of these. These materials may be controlled to have a desired particle size and particle size distribution if necessary. Of these materials, a fine powder of inorganic oxide such as zinc oxide, tin oxide and titanium oxide may be particularly preferable.

Metal oxides doped with an element such as antimony or aluminum, and fine powder of particles having a conductive material on the surface may be used for the purpose of controlling the resistance value of the conductive fine powder. Such materials include, for example, a fine titanium oxide powder of particles the surface of which is treated with tin and antimony oxides, a fine stannic oxide powder doped with antimony, and a fine stannic oxide powder.

The conductive fine titanium oxide powder as treated with tin and antimony oxides commercially available includes, for example, EC-300 (manufactured by Titanium Kogyo K. K.), ET-300, HJ-1, HI-2 (these being manufactured by Ishihara Sangyo K. K.) and W-P (manufactured by Mitsubishi Material K. K.).

The conductive tin oxide doped with antimony commercially available includes, for example, T-1 (manufactured by Mitsubishi Material K. K.) and SN-100P (Ishihara Sangyo K. K.). The stannic oxide commercially available includes, for example, SH-S (Nippon Kagaku Sangyo K. K.).

As one of preferred embodiments of the present invention, inorganic or organic fine particle with a nearly spherical form having a primary average particle diameter exceeding 30 nm (preferably specific surface area of less than 50 $m^2/g$), and more preferably 50 nm or above (preferably specific surface area of less than 30 $m^2/g$) may further be added to the magnetic toner for the purpose of improving the cleaning property. For example, spherical silica particles, spherical polymethylsesquioxane particle and spherical resin particles may preferably used for that purpose.

To the magnetic toner used in the present invention may be added other additives as long as they do not have a bad influence on the toner. Such additives include, for example, lubricant powder such as Teflon powder, zinc stearate powder and polyvinylidene fluoride powder; abrasive material such as cerium oxide powder, silicon carbide powder and strontium titanate powder; fluidity providing material such as silica powder, titanium oxide powder and aluminum oxide powder; caking preventives, organic fine particles with an opposite polarity and inorganic fine particles as a developing performance improver in a small amount. These additives also may be made hydrophobic at the surface for use.

The inorganic fine powder and the conductive fine powder may be externally added to the magnetic toner particle by mixing those fine powders with the toner followed by agitating. Specifically, a mechanofusion system, I type mill, hybridizer, turbo mill, and Henschel mixer may be used. The use of the Henschel mixer may especially be preferred in view of prevention of coarse particles from occurring.

When the inorganic fine powder such as silica fine powder and the conductive fine powder are externally added to the magnetic toner, the conditions for the external addition such as temperature, strength of adding force and time period required may preferably be controlled in order to control the liberation percentage of the inorganic and the conductive fine powder. By way of example, when a Henschel mixer is used, the tank may preferably be controlled at a temperature of not higher than 50° C. in its inside when the powder is externally added. With this temperature or higher, the external additives may abruptly be buried into the toner particles due to heat and coarse particles may tend to occur undesirably. The Henschel mixer may preferably be regulated to have a peripheral speed of 10 to 80 m/sec from the viewpoint of controlling the liberation percentage of the external additive.

The magnetic toner of the present invention is excellent in the durability and provides images with less fog and further has a high transfer property. Hence, the magnetic toner can preferably be used for the image-forming method making use of the contact charging step, and moreover, it can be used for the cleanerless image-forming method using no cleaner. In the image-forming method as constituted of the contact charging step, the magnetic toner to be moved to the charging step without having being transferred (i.e., transfer residual toner) and fogging toner should be decreased, which is the key technique, and the using of the magnetic toner of the present invention makes it possible to obtain better images which are also more excellent in the environmental stability for a long period of time.

In the cleanerless image-forming method, the transfer residual toner is caused to slip through the charging step and collected into the developing assembly in the developing step. Such a toner may have an inferior charging property in almost cases so that it may be accumulated into the developing assembly as the image reproduction is conducted, tending to result in deterioration of the image characteristics. When a magnetic toner having an inadequate transfer property is used, the toner may remain in a large amount on the image-bearing member surface after the transfer of image, so that the toner may hinder the realization of uniform charging in the charging step, thereby making it very difficult to obtain satisfactory images. This tendency may conspicuously be seen in the toner having an inferior durability, which is undesirable. However, as to the magnetic toner of the present invention, it has good image characteristics and high durability. Accordingly, even when the magnetic toner of the present invention is used in the cleanerless image-forming method, it can enable images to be formed with a high image quality in a stable way for a long period of time. Hence, the image-forming method of the present invention can be achieved by making use of such magnetic toner.

(2) Image-Forming Method of the Present Invention

The image-forming method of the present invention is described below.

The image-forming method of the present invention comprises a charging step, an electrostatic latent image-forming step, a developing step, and a transfer step. The magnetic toner of the present invention is used as the toner in the developing step. In the charging step, an image-bearing member is electrostatically charged by applying a voltage to a contact charging member which is brought into contact with the image-bearing member, forming a contact zone between them.

An embodiment of the image-forming method is described in detail by reference to the drawings without limiting the present invention.

Figure 2:
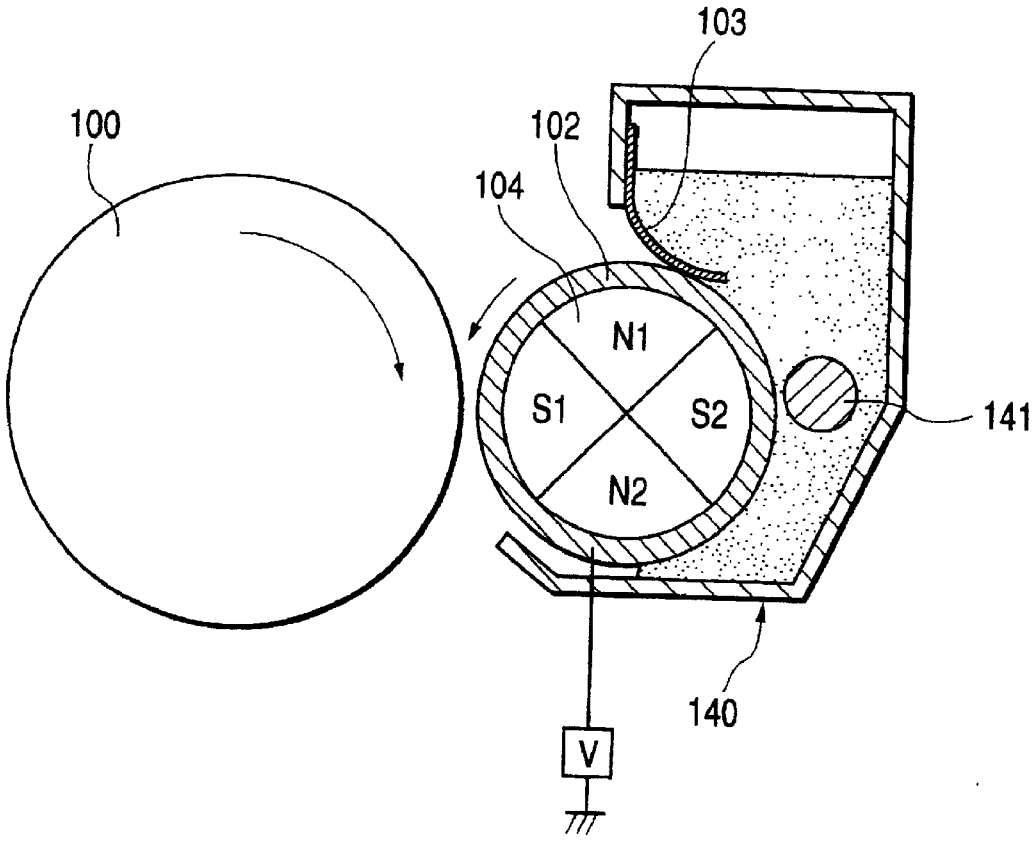
FIG. 2 illustrates an example of a developing assembly for one-component development.

In FIG. 1, there are provided a primary charging roller 117 as the contact charging member, a developing assembly 140, a transfer roller 114, a cleaner assembly 116, a registration roller 124, and so forth around a photosensitive member 100 as the image-bearing member. The photosensitive member 100 is electrostatically charged up to −700 V by the primary charging roller 117 (charging voltage: AC voltage of −2.0 kvpp (Vpp: voltage between peaks) and DC voltage of −700 Vdc). A laser light beam 123 is projected from a laser beam scanner 121 onto the photosensitive member 100. The electrostatic latent image thus formed on the photosensitive member 100 is then developed with a one-component magnetic toner comprising magnetic toner particles and an external additive by means of the developing assembly 140. The thus developed toner image is transferred onto a transfer material by means of a transfer roller 114 brought into contact with the photosensitive member 100 via the transfer material. The transfer material P bearing the toner image thereon is delivered by a delivery belt 125 to a fixing assembly 126, and the toner image is fixed on the transfer material P. A remaining portion of the magnetic toner left on the photosensitive member after the image transfer is cleaned off by the cleaner assembly 116. As shown in FIG. 2, the developing assembly 140 has a cylindrical toner-carrying member 102 (occasionally called a "developing sleeve") made of a non-magnetic metal such as aluminum and stainless steel. This developing sleeve 102 is disposed close to the photosensitive member 100. The photosensitive member 100 and the developing sleeve 102 are kept apart with a predetermined space or gap, for example about 230 μm by means of a sleeve/photosensitive member space-retaining member not shown in the drawing. This space or gap may be varied as necessary. Inside the developing sleeve 102, a magnet roller 104 is disposed fixedly and concentrically with the developing sleeve 102. The developing sleeve 102 is rotatable. The magnetic roller 104 has a plurality of magnetic poles as shown in the drawing: S1 serving for development, N1 controlling the amount of the toner coat, S2 serving for intake/delivery of the toner, and N2 preventing blowout of the toner. An elastic blade 103 is provided as a member for regulating the amount of the magnetic toner which is adhered to and delivered by the developing sleeve 102. The amount of the toner delivered to the developing zone is controlled by a contact pressure of the elastic blade 103 against the developing sleeve 102. In the developing zone, a development bias (V1) composed of a DC voltage and an AC voltage is applied between the photosensitive member 100 and the developing sleeve 102, whereby the toner particles on the developing sleeve 102 are caused to fly and deposit to the photosensitive member 100 on the electrostatic latent image to render it a visible image.

In the image-forming method of the present invention, the developing step may be a developing-cleaning step which also performs a cleaning step for recovering the magnetic toner remaining on the photosensitive member after transfer of the toner image onto the transfer material, or a so-called cleanerless step which does not have any cleaner.

Further, the image-forming method employing the development-cleaning step or employing the cleanerless step may comprise a developing step in which an electrostatic latent image on an image-bearing member is developed by use of a toner, and a charging step in which the image-bearing member is electrostatically charged by application of a voltage to a charging member brought into contact with the image-bearing member, forming a contact zone between them, and a conductive fine powder contained in the magnetic toner of the present invention, having been adhered to the image-bearing member in the developing step and partly remained and left on the image-bearing member even after the transfer step, is transported at least to the contact zone and/or in the vicinity thereof between the charging member and the image-bearing member so as to be interposed therebetween.

In the charging step in the image-forming method of the present invention, a conductive charging member (a contact charging member, a contact charger) is brought into contact with a photosensitive member which is to be charged and is also an image-bearing member, forming a contact zone between them. The charging member may include, in addition to the aforementioned primary charging roller of roller type as shown in FIG. 1, other conductive charging member of types of a fur brush, a magnetic brush, and a blade (charging blade). A prescribed charging bias (V2) is applied to the contact charging member to electrostatically charge the photosensitive member surface at a prescribed potential and polarity. Such contact charging members bring about advantages of enabling a high voltage to be unnecessary and decreasing the generation of ozone.

With a charging roller employed as shown in FIG. 1, preferred process conditions may include a contact pressure of the roller ranging from 4.9 to 490 N/m (5 to 500 g/cm), and the application of a DC voltage or of superposition of a DC voltage and an AC voltage. The superposition of DC and AC voltages may preferably be composed of AC of a voltage of 0.5 to 5 kVpp and a frequency of 50 Hz to 5 KHz, and DC of a voltage of ±0.2 to ±5 kV.

The AC voltage may preferably have a peak voltage of lower than 2×Vth (V) (Vth: discharge start voltage under application of direct voltage). It is preferable that the peak voltage of the AC voltage superimposed to the DC voltage is lower than 2×Vth because the potential on the image-bearing member becomes stabilized. More preferably, the AC voltage of the bias voltage to be superimposed to the DC voltage may have a peak voltage of less than 1×Vth. In this case, the image-bearing member can be electrically charged without causing discharge phenomenon.

The waveform of the AC voltage employed in the charging step may suitably be selected from a sinusoidal waveform, a rectangular waveform, and a triangular waveform. It also may be a pulse waveform which is formed by periodical operation of turn-on and turn-off of a DC voltage. As the waveform of the AC voltage may be used a bias in which the voltage value is varied periodically.

In the image-forming method of the present invention, especially in the cleanerless image-forming method, the charging member may preferably be elastic in view of providing a contact zone between the charging member and the image-bearing member, at which the conductive fine powder is interposedly present at least at the contact zone between the charging member and the image-bearing member, and/or in the vicinity thereof, and may preferably be conductive in view of charging the image-bearing member by application of a voltage thereto. The charging member therefore may preferably be a conductive elastic roller; a magnetic brush contact charging member which has a magnetic brush as formed by magnetically restraining magnetic particles and brought into contact with the photosensitive member; or a brush constructed from conductive fibers.

In the present invention, the conductive elastic roller member used as the contact charging member may preferably have an Asker-C hardness of 50 degrees or less. However, with a too lower hardness, the shape of the roller member may be less stable to render insufficient the contact thereof with the body to be charged, and the conductive fine powder caused to be interposed between the charging member and the image-bearing member at the contact zone is liable to abrade or scratch the surface layer of the roller member to attain a stable charging performance with difficulty. On the other hand, with a too higher hardness, the desired contact portion for charging may not be ensured satisfactorily between the roller member and the body to be charged, and the microscopic contacting with the surface of the body to be charged may tend to lower. More preferably, the roller member may have Asker-C hardness ranging from 25 degrees to 50 degrees. The Asker-C hardness is measured by means of an Asker Hardness Tester (Type C, manufactured by Kobunshi Keiki K. K.) under a load condition of 500 g.

It is important that the roller member is endowed with an elasticity enough to come into sufficient contact with the body to be charged and at the same time, the roller member is capable of serving as an electrode having a sufficient low resistance to charge the moving body to be charged. On the other hand, when the body to be charged has a defective site like a pinhole, the voltage should be prevented from leaking at the defective site. Generally, the charging member has a volume resistivity of from $1\times10^3$ Ω.cm to $1\times10^8$ Ω.cm. When a photosensitive member is used as the body to be charged, the roller member as the charging member may preferably have a volume resistivity ranging from $1\times10^3$ to $1\times10^8$ Ω.cm, and more preferably from $1\times10^4$ to $1\times10^7$ Ω.cm.

The volume resistivity of the roller member is measured by pressing the roller against a cylindrical aluminum drum of 30 mm diameter with a total pressure of 1 kg applied to the core metal of the roller, and applying a voltage of 100 V between the core metal and the aluminum drum.

In the present invention, the roller member may be prepared, for example, by forming a medium-resistance layer of a rubber or a cellular material as a flexible member on the core metal of the roller member. The medium-resistance layer is formed from a formulation composed of a resin (e.g., polyurethane), conductive particles (e.g., carbon black), a vulcanizer, and a blowing agent and provided in a shape of roller on the core metal. If necessary, it may then be machined or polished at the surface to correct its shape to make up a roller member. The roller member may preferably have fine cells or irregularities on the surface to make the conductive fine powder to be present between the roller member and the image-bearing member.

The cells may preferably be hollows or concavities having an average cell diameter ranging preferably from 5 to 300 μm in terms of that of spheres. The roller member may preferably have a surface void volume ratio ranging from 15% to 90% with the concavities regarded as voids. The average cell diameter in the surface of the roller member of less than 5 μm is not preferred since it may cause insufficient supply of the conductive fine powder, whereas the average cell diameter in the surface of more than 300 μm is also not preferred since it may cause excessive supply of the conductive fine powder: in either case, the image-bearing member may tend to have a non-uniform charging potential disadvantageously. The void volume ratio of less than 15% is not preferred since it may cause insufficient supply of the conductive fine powder, whereas the void volume ratio of more than 90% is also not preferred since it may cause excessive supply of the conductive fine powder; in either case, the charging potential of the image-bearing member is liable to become non-uniform disadvantageously.

The material for constituting the roller member is not limited to the elastic cellular materials. Preferable material of the elastic body may include rubbery materials such as ethylene-propylene-diene polyethylenes, polyurethanes, butadiene-acrylonitrile rubbers, silicone rubbers, and isoprene rubbers in which conductive particles of carbon black, metal oxide, or the like are dispersed for adjusting the resistivity; and foamed products of the above rubbery materials. In place of or in addition to the dispersed conductive particles, an ionic conductive material may be used for the resistivity adjustment. The material of the core metal used for the roller member may include aluminum and stainless steel.

The roller member is disposed so as to be brought into press-contact with a body to be charged as the image-bearing member at a prescribed press pressure against the elasticity to form a contacting portion between the roller member and the image-bearing member. The breadth of the contacting portion is not specially limited, but may preferably be not less than 1 mm, and more preferably not less than 2 mm for achieving a close contact of the roller member with the image-bearing member.

The brush member used as the contact charging member may be a generally used charging brush made of a fiber having a conductive material dispersed therein for resistivity adjustment. The fiber may include generally known fibers such as nylon fibers, acrylic fibers, rayon fibers, polycarbonate fibers, and polyester fibers. The conductive material may include generally known conductive materials: conductive metal such as nickel, iron, aluminum, gold, and silver; oxides of a conductive metal such as iron oxide, zinc oxide, tin oxide, antimony oxide, and titanium oxide; and conductive powder such as carbon black. The conductive material may be surface-treated for hydrophobicity or resistivity adjustment. The conductive material is selected for use in consideration of the dispersibility in the fiber, and the productivity.

The charging brush as the contact charging member includes stationary type brushes and rotatable roll type brushes. The roll type charging brush may be prepared, for example, by winding spirally a tape made of a piled conductive fiber around a metallic core. The conductive fiber may preferably have a fineness in the range of 1 to 20 deniers (fiber diameter of about 10 to 500 $\mu$m), and a length of 1 to 15 mm. The brush density may preferably be 10,000 to 300,000 fibers per square inch (about $1.5\times10^7$ to $4.5\times10^8$ fibers per square meter).

The charging brush may preferably have a possible highest brush density: one fiber may preferably be constituted of several to several hundred fine fibers. For example, 50 fine fibers of 300 denier may be bundled and made into one fiber as represented by 300 denier/50 filaments, and then the bundled fibers may be implanted. In the present invention, the charging points of the direct injection charging are determined mainly depending on the density of the conductive fine powder interposed at the contact zone or in the vicinity thereof between the charging member and the image-bearing member. Owing to this, the charging member can be selected from a large variety of charging members.

The core metal for the charging brush may be the same as the one employed for the charging roller.

The material for constituting the charging brush may include conductive rayon fibers REC-B, REC-C, REC-M1, and REC-10 (Unitika Ltd.); SA-7 (Toray Industries, Inc.); THUNDERON (Nippon Sanmou K. K.); BELLTRON (Kanebo, Ltd.); CLACARBO (rayon containing dispersed carbon, Kuraray Co., Ltd.); and ROVAL (Mitsubishi Rayon Co., Ltd.). Of these, REC-B, REC-C, REC-M1, and REC-M10 are especially preferred in view of environmental stability.

The contact charging member may preferably have a flexibility because the flexibility can improve the chances of contacting of the conductive fine powder with the image-bearing member at the contact zone between the contact charging member and the image-bearing member and gives good contact state therebetween and further bring about an improvement in the direct injection charging performance. In other words, the contact charging member comes into close contact with the image-bearing member through the conductive fine powder interposed, and the conductive fine powder held at the contact zone between the contact charging member and the image-bearing member is caused to rub the surface of the image-bearing member without gap, whereby the charging of the image-bearing member by the contact charging member is conducted mainly by the direct injection charging in the presence of such charging accelerating particles in a stably and safely manner without using electric discharge phenomenon. As a result, a high charging efficiency can be achieved which is not obtainable by a conventional roller charging, and a potential nearly equal to the voltage applied to the contact charging member can be applied to the image-bearing member.

Preferably, a relative speed difference may be provided between the movement speed of the surface of the charging member and that of the surface of the image-bearing member, forming the contact zone or portion therebetween, because the chances of contacting of the conductive fine powder with the image-bearing member may be remarkably increased to obtain higher contact efficiency, bringing about an improvement in the direct injection charging efficiency.

In the present invention, such a speed difference may be provided without a remarkable increase in the torque between the contact charging member and the image-bearing member and without causing significant scraping of the contact charging member and the image-bearing member surface since the conductive fine powder is interposed between the contact charging member and the image-bearing member at the contact zone and produces a lubricating effect (friction-reducing effect) to enable velocity difference.

The contact charging member and the image-bearing member may preferably be cause to move each other in reverse directions at their contact zone to recover by the contact charging member temporarily the transfer residual toner on the image-bearing member carried to the charging zone. For example, the contact charging member may preferably designed so that it may be driven for rotation and its rotating direction may be made reverse to the moving direction of the image-bearing member surface at the contact zone. Thereby, the charging may be performed with the transfer residual toner once pulled apart from the image-bearing member due to the rotation in the reverse direction, thereby enabling the direct injection charging to be effected on the image-bearing member advantageously.

Otherwise, the charging member surface may be moved in the same direction as the movement direction of the image-bearing member surface with a surface speed difference given. However, the charging performance of the direct injection charging depends on the ratio of the peripheral speed of the image-bearing member to the peripheral speed of the charging member. When the charging member is moved in the same direction as that of the image-bearing member, to obtain the same peripheral speed ratio as that with the reverse movement direction, the rotation speed of the charging member should be larger than that with the reverse movement direction. In view of the rotation speed, it is advantageous to move the charging member in the reverse direction.

The surface speed difference between the image-bearing member and the contact charging member may be attained by rotating the contact charging member. The peripheral speed ratio herein is defined by the equation below:

$$\text{Peripheral speed ratio (\%)} = (\text{Peripheral speed of charging member}) \div (\text{Peripheral speed of image-bearing member}) \times 100$$

The conductive elastic roller member or the rotatable charging brush roll which is a flexible charging member as described above as the contact charging member may preferably be used in order to recover temporarily the transfer residual toner on the image-bearing member and to hold the conductive fine powder to conduct the direct injection charging advantageously.

The amount of the conductive fine powder interposed at the contact zone between the image-bearing member and the contact charging member should be not deficient or not excessive. With a deficient amount of the conductive fine powder, the lubrication effect by the particles of the powder is not sufficiently achieved, making it difficult to rotate the contact charging member with a desired speed different from the image-bearing member owing to the increased friction between the image-bearing member and the contact charging member. Specifically, the driving torque becomes larger, and if the contact charging member is forced to rotate, the contact charging member or the image-bearing member surface may tend to be scraped. Additionally, the increase in the chances of contact by the conductive fine powder may not be achieved, which may cause insufficient charging performance. On the other hand, with an excessive amount of the conductive fine powder interposed, coming-off of the conductive fine powder from the contact charging member increases significantly, which may cause bad influence on the image formation.

Therefore, the amount of the conductive fine powder particles interposed between the charging member and the image-bearing member at least at the contact zone may preferably be $1\times10^3$ particles/mm$^2$ or more, and more preferably $1\times10^4$ particles/mm$^2$ or more. With the fine particles in an amount of less than $1\times10^3$ particles/mm$^2$, the sufficient lubrication and increase of the chance of the contact may not be achieved, tending to lower the charging performance. With the fine particles in an amount of less than $1\times10^4$ particles/mm$^2$, the charging performance tends to be lowered when the toner remains in a larger amount after the image transfer.

The method is described for measuring the amount of the conductive fine powder interposed at the contact zone, and the amount of the conductive fine powder on the image-bearing member in the step of forming latent images. It is preferable to directly measure the amount of the interposed conductive fine powder in the contact area between the contact charging member and the image-bearing member. However, in the case where a speed difference are given between the surface of the contact charging member and the surface of the image-forming member, forming the contact zone, most of the particles present on the image-bearing member before coming into contact with the contact charging member are scraped off by the charging member while moving in contact in the reverse direction. In the present invention, therefore, the amount of the particles on the contact charging member surface just before the arrival at the contact area is measured as the amount of the interposed particles.

Specifically in the measurement, the rotation of the image-bearing member and the conductive elastic roller member is stopped with the charging bias turned off, and the surfaces of the image-bearing member and of the conductive elastic roller member are photographed by a video-microscope (Model: OVM1000N, manufactured by Olympus Co.) with a digital still recorder (Model: SR-3100, manufactured by Deltis Co.). For measurement of particles on the conductive elastic roller member, the conductive elastic roller member is brought into contact with a slide glass under the same conditions as that for the contact with the image-bearing member, and the contact surface is photographed from the opposite side of the slide glass at ten or more points with the video-microscope with an object lens of magnification of 1000×. The digital image is subjected to a binary treatment with a threshold value for regional separation of the individual particles, and the number of the regions of existing particles is counted with an image processing software. Similarly, as to the amount of the particles on the image-bearing member, the surface of the image-bearing member is photographed by a video-microscope in the same manner as above, and the image is treated in the same manner.

The photosensitive member employed in the image-forming method of the present invention employs a photoconductive substance such as a-Se, CdS, $ZnO_2$, OPC (organic photosensitive substance), and a-Si. The photosensitive member may preferably have a surface layer.

For example, an inorganic photosensitive member such as of selenium or amorphous silicon may be provided with a protective layer composed mainly of a resin; a function-separation type organic image-bearing member may be provided with a charge transport layer as a surface layer composed of a charge transport substance and a resin; and such image-bearing member may be provided further with the above described protective layer formed on the charge transport layer. The image-bearing member may have an outermost surface layer which is a resin layer in which at least one lubricant fine particles selected from fluorine resin particles, silicone resin particles and polyolefin resin particles have been dispersed. Release properties may be imparted to the surface layer by:

(1) using a material of low surface energy as the resin itself to form the layer,
(2) adding an additive for imparting water-repellency or lipophilic property, or
(3) dispersing a material having high release properties in a powder state.

For example, in method (1), a fluorine-containing substituent and/or a silicone-containing substituent is introduced into the resin structure; in method (2), a surfactant is used as the additive; and in method (3), a fluorine atom-containing compound such as polytetrafluoroethylene, polyvinylidene fluoride, carbon fluoride, or the like is used.

By such a method, the contact angle of water of the photosensitive member surface may be adjusted to 85 degrees or more, so that the transferability of the toner and the durability of the photosensitive member are improved more. The contact angle to water may preferably be not less than 90 degrees.

Of the above methods, the method (3) is advantageous in which a releasing powder like a fluorine-containing resin is dispersed in the outermost layer. As the fluorine-containing resin, polytetrafluoroethylene is especially advantageous.

Such a powder may be incorporated into the surface by forming a layer composed of the powder dispersed in a binder resin on the outermost face of the photosensitive member, or in case of an organic photosensitive member originally constituted mainly of a resin, by dispersing the powder in its outermost layer without providing an additional surface layer. The amount of the powder added may preferably range from 1% to 60% by weight, and more preferably from 2% to 50% by weight based on the total weight of the surface layer. With the amount of less than 1% by weight, the transferability of the toner may lower and the improvement in durability of the photosensitive member may be insufficient, whereas with the amount of more than 60% by weight, the strength of the film may lower or the quantity of light introduced to the photosensitive member may be decreased disadvantageously.

The contact angle is measured by means of a dropping type contact angle tester (e.g., contact angle tester, Model CA-X, manufactured by Kyowa Kaimen Kagaku K. K.). The contact angle is defined as the angle formed, at the point which the free surface of the water comes into contact with the photosensitive member, by the liquid surface and the photosensitive member surface, (angle inside the liquid). The measurement is conducted at room temperature (about 25° C.). In the Examples described later, the measurement is conducted in such a manner.

The image-forming method of the present invention is a direct charging method in which the charging means is brought into direct contact with a photosensitive member. The direct charging method generates less ozone, which is advantageous, and a load applied to the photosensitive member surface is heavy in comparison with a method making use of the corona discharge in which the charging member is not in contact with the photosensitive member. In this respect, the above described constitution of the invention produces advantageous effects of improving remarkably the service life of the photosensitive member, and is one of the preferred embodiments.

A more preferable embodiment of the photosensitive member employed in the present invention is described below. The volume resistivity of the outermost surface layer of the photosensitive member may preferably range from $1\times10^{9}$ to $1\times10^{14}$ Ωcm because it may bring about more preferable charging performance in the present invention. In the charging system based on the direct injection of charge, the electric charge can be injected and released efficiently by lowering the resistance of the photosensitive member as the body to be charged. For this purpose, the volume resistivity of the outermost surface layer is preferably not higher than $1\times10^{14}$ Ωcm. On the other hand, in order to make the image-bearing member hold the latent image for a certain time, the volume resistivity of the outermost surface layer is preferably not lower than $1\times10^{9}$ Ωcm. The outermost surface layer may more preferably have a volume resistivity ranging from $1\times10^{9}$ to $1\times10^{14}$ Ωcm since it gives also sufficient charging performance even to an apparatus of higher processing speed.

The photosensitive member may have, as one of the preferred examples of construction, a photosensitive layer of a multi-layer type structure in which a charge generation layer and a charge transport layer are formed on a conductive substrate in the order named.

The conductive substrate may be in the form of a cylinder or a film made of a metal such as aluminum or stainless steel; a plastic having a coating layer of aluminum alloy or indium oxide-tin oxide alloy; paper or plastic which is impregnated with conductive particles; or a plastic having a conductive polymer.

On the conductive substrate of these materials may be provided a subbing layer for the purpose of improving the adhesion of the photosensitive layer, improving the coating property of the photosensitive layer, protecting the substrate, covering the defects on the substrate, improving injection of charges from the substrate and shielding the photosensitive layer against the electric breakdown. The subbing layer may be formed, for example, of a material such as polyvinyl alcohol, poly-N-vinylimidazole, polyethylene oxide, ethyl cellulose, methyl cellulose, nitro cellulose, ethylene-acrylic acid copolymer, polyvinyl butyral, phenolic resin, casein, polyamide, copolymerized nylon, varnish, gelatin, polyurethane and aluminum oxide. In general, the subbing layer may have a thickness of 0.1 to 10 μm, preferably 0.1 to 3 μm.

The charge generation layer may be formed of a charge generating material such as azo pigments, phthalocyanine pigments, indigo pigments, perylene pigments, polycyclic quinone pigments, squarilium pigments, pyrylium salts, thiopyrylium salts, triphenylmethane pigments; and inorganic materials such as selenium and amorphous silicon. These materials may be dispersed in a suitable binder, and the thus prepared dispersion may be coated or applied by means of the vapor deposition to form the charge generation layer. The binder may be selected from a wide variety of binder resins. The binder resin includes, for example, polycarbonate resins, polyester resins, polyvinyl butyral resins, polystyrene resins, acrylic resins, methacrylic resins, phenolic resins, silicone resins, epoxy resins and vinyl acetate resins. The amount of the binder contained in the charge generation layer may preferably be 80% by weight or less, and more preferably 0 to 40% by weight. The charge generation layer may preferably have a thickness of 5 μm or less, more preferably 0.05 to 2 μm.

The charge generation layer has the function of receiving charge carriers from the charge generation layer in the presence of an electric field and transporting the charge carriers. The charge transport layer may be formed in such a manner that a suitable charge transporting material may be dissolved in a solvent, if desired, together with a binder resin followed by coating the solution. The thickness of the charge transport layer may usually be in a range of 5 to 40 μm. The charge transporting material includes, for example, polycyclic aromatic compounds having a moiety such as biphenylene, anthracene, pyrene or phenanthrene at the main chain or side chain; nitrogen-containing cyclic compounds such as indole, carbazole, oxadiazole and pyrazoline; hydrazone compounds, styryl compounds, selenium, selenium-tellurium, amorphous silicon, and cadmium sulfide. The binder resin for dispersion of the charge transporting material includes, for example, resins such as polycarbonate resins, polyester resins, polymethacrylic acid ester resins, polystyrene resins, acrylic resins and polyamide resins; and organic photoconductive polymers such as poly-N-vinylcarbazole and polyvinylanthracene.

Also, a protective layer may be formed as a surface layer. The protective layer may be formed of resins such as polyester resins, polycarbonate resins, acrylic resins, epoxy resins, phenolic resins or hardened products of these resins. These resins may be used alone or in a combination of two or more resins. Conductive fine particles may be dispersed into the resin of the protective layer to adjust the volume resistivity. The conductive fine particle may be exemplified by those of metals or metal oxides, preferably ultrafine particles such as those of zinc oxide, titanium oxide, tin oxide, antimony oxide, indium oxide, bismuth oxide, titanium oxide coated with tin oxide, indium oxide coated with tin, tin oxide coated with antimony and zirconium oxide. These materials may be used alone or in a combination of two or more materials.

In general, when the conductive fine particles are dispersed in the protective layer, the particles should preferably have a particle diameter smaller than the wavelength of incident light in order to prevent the incident light from scattering due to the presence of the dispersed particles. Accordingly, the conductive fine particle as dispersed in the protective layer of the present invention may preferably have a particle diameter of not larger than 0.5 μm. The content of the conductive fine particles may preferably be 2 to 90% by weight, and more preferably 5 to 80% by weight based on the total weight of the protective layer. The protective layer may preferably have a thickness of 0.1 to 10 μm, and more preferably 1 to 7 μm.

The surface layer may be formed by coating methods such as spray coating, beam coating or penetrating (dipping) coating of the resin dispersion liquid.

The method of measuring the volume resistivity of the outermost surface layer of the image-bearing member in the present invention may include a method in which a layer having the same composition of the outermost surface layer of the image-bearing member is formed on a polyethylene terephthalate (PET) film having a gold deposited on the surface, and the resistivity of the layer is measured by means of a volume resistance measuring apparatus (4140B pA MATER, manufactured by Hewlett Packard Co., Ltd.) in an environment of 23° C. and 65% with a voltage of 100 V applied.

Specific description of the contact transfer step preferably applied to the image-forming method of the present invention is given below. In the present invention, the transfer material to receive toner images as transferred from the image-bearing member may be an intermediate transfer member such as a transfer drum. In that case, the toner images may be retransferred from the intermediate transfer member to a transfer material such as paper to obtain toner images. What is meant by the contact transfer step refers to a step in which an image of magnetic toner is electrostatically transferred to a transfer material while the photosensitive member is brought into contact with the transfer member through the intervening transfer material. The transfer member may preferably have a linear pressure of not lower than 2.9 N/m (3 g/cm) as contact pressure, and more preferably not lower than 19.6 N/m (20 g/cm), and still more preferably in a range of 19.6 N/m (20 g/cm) to 78.4 N/m (80 g/cm). If the linear pressure as the contact pressure is lower than 2.9 N/m (3 g/cm), misregistration in the transportation of the transfer medium and faulty transfer may undesirably tend to occur.

Figure 3:
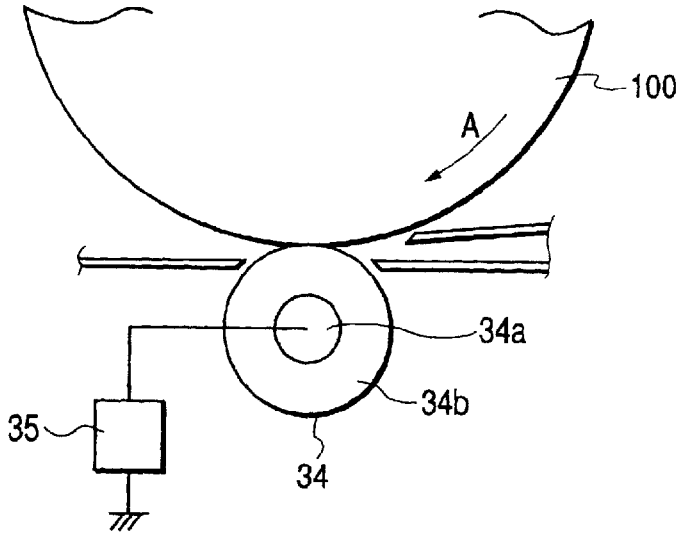
FIG. 3 schematically illustrates an example of a contact transfer member.

The transfer member in the contact transfer step may be a transfer roller or a transfer belt. An example of the construction of the transfer roller is shown in FIG. 3. A transfer roller 34 is constituted at least of a mandrel 34*a* and a conductive elastic layer 34*b*. The conductive elastic layer 34*b* is made of an elastic material such as urethane rubber, epichlorohydrin rubber and so forth in which a conductive material such as carbon is dispersed, having a volume resistivity of about $10^6$ to $10^{10}$ Ωcm, and a transfer bias is applied with a transfer bias power source 35.

The contact transfer method of the present invention is particularly effective to the image-forming apparatus making use of a photosensitive member having an organic compound on the surface. This is because when the surface layer of the photosensitive member is formed of an organic compound, the photosensitive member may have a stronger adhesion to the binder resin in the toner particles than other photosensitive members making use of an inorganic material, tending to lower the transfer property.

Also, in a case where the contact transfer method of the present invention is applied, the organic compound as the surface material of the photosensitive member includes, for example, silicone resins, vinylidene chloride, ethylene-vinyl chloride, styrene-acrylonitrile, styrene-methylmethacrylate, styrene, polyethylene terephthalate and polycarbonate. The surface material is not limited to these materials, and copolymers or blend materials thereof with other monomers or the aforementioned binder resins may be used.

The image-forming method of the present invention making use of the contact transfer method is particularly effective to the image-forming apparatus employing a photosensitive member with a diameter as small as 50 mm or below. This is because the photosensitive member having a small diameter may be provided with a large curvature relative to the same linear pressure to tend to cause the concentration of pressure at the contact zone. Although the same phenomenon may be considered to occur also in the belt like photosensitive member, the present invention is also effective to the image-forming apparatus employing the photosensitive member having a curvature radius of not larger than 25 mm in the transfer zone. Also, in the image-forming method of the present invention, for the purpose of obtaining high quality images free of fog, a coat layer of magnetic toner may preferably be formed on the magnetic toner carrying member so as to have a layer thickness smaller than the closest distance (between S-D) between the magnetic toner carrying member and the photosensitive member, and the toner images may be developed in the developing step in which the development is carried out with an alternating voltage applied. That is, the layer thickness of the toner layer to be formed on the toner carrying member may be made smaller than the closest gap between the photosensitive member and the toner carrying member by means of a layer thickness regulating member for regulating the amount of the magnetic toner on the toner carrying member, and the layer thickness regulating member may be controlled by an elastic member provided in contact with the toner carrying member through the magnetic toner interposed, which may be particularly preferable in view of achieving the uniform charging of the magnetic toner.

In the light of the above, the magnetic toner may preferably be formed into a layer of 5 to 50 g/m$^2$ on the toner carrying member. If the toner amount on the toner carrying member is smaller than 5 g/m$^2$, a sufficient image density may be obtained with difficulty, and further, unevenness in the layer of magnetic toner attributable to the excessive charging of the magnetic toner may occur. On the other hand, if the toner amount on the toner carrying member is larger than 50 g/m$^2$, the toner scatters may tend to occur.

The toner carrying member used in the present invention may preferably be a conductive cylinder (developing roller) made of metals or alloys such as aluminum or stainless steel. The conductive cylinder may be formed of a resin composition having a sufficient mechanical strength and conductivity, and a roller made of conductive rubber may be used. The toner carrying member is not limited to the cylinder as mentioned above and may be in the form of endless belt which is driven for rotation.

The toner carrying member used in the present invention may preferably have a surface roughness in a range of 0.2 to 3.5 μm in terms of JIS centerline average roughness (Ra). With the value of Ra of less than 0.2 μm, the charge quantity on the toner carrying member may tend to be higher and to cause a lowering of the developing performance. With Ra exceeding 3.5 μm, the toner coat layer on the toner carrying member may tend to be uneven, thereby giving rise to the non-uniform density on the images reproduced. More preferably, the surface roughness may be in a range of 0.5 to 3.0 μm.

In the present invention, the surface roughness Ra of the toner carrying member corresponds to the centerline average roughness as measured in accordance with JIS Surface Roughness "JIS B 0601" by means of a surface profile analyzer (tradename: SURFCORDER SE-30H, manufactured by Kabushiki Kaisha Kosaka Kenkyusho). More specifically, a portion of 2.5 mm is drawn out of the roughness curve, setting a measurement length a in the direction of its centerline. When the centerline of this drawn-out portion is represented by X axis, the direction of lengthwise magnification by Y axis, and the roughness curve by y=f(x), the value determined according to the following expression and indicated in micrometer (μm) is the surface roughness Ra.

$$Ra = 1/a \int_0^a |f(x)| dx$$

The surface roughness Ra of the toner carrying member in the present invention may be controlled to the above-mentioned range, for example, by changing the abrasive state of the surface layer of the toner carrying member, or by adding spherical carbon particles, fine carbon particles or graphite to the surface layer of the toner carrying member.

Since the magnetic toner of the present invention has a high charging ability, the total charge quantity of the toner may preferably be controlled at the time of development. The toner carrying member of the present invention may preferably have a surface as covered with a resin layer in which conductive fine particles and/or lubricant is dispersed.

The conductive fine particles contained in the coat or covering layer of the toner carrying member may preferably have a resistivity of not larger than 0.5 Ωcm after having been pressed under a pressure of 11.7 Mpa (120 kg/cm$^2$). The conductive fine particles may preferably be carbon fine particles, a mixture of carbon fine particles and crystalline graphite, or crystalline graphite. Further, the conductive fine particles may preferably have a particle diameter of 0.005 to 10 μm.

The resin used for the resin layer includes, for example, thermoplastic resins such as styrene resins, vinyl resins, polyether sulfone resins, polycarbonate resins, polyphenylene oxide resins, polyamide resins, fluorine resins, cellulose resins and acrylic resins; and thermosetting resins or photocurable resins such as epoxy resins, polyester resins, alkyd resins, phenolic resins, melamine resins, polyurethane resins, urea resins, silicone resins and polyimide resins.

Among them, preferable resins may be those having a release property such as silicone resins and fluorine resins, or those having excellent mechanical properties such as polyether sulfone, polycarbonate, polyphenylene oxide, polyamide, phenolic resins, polyester, polyurethane and styrene resins. Phenolic resins may be particularly preferable.

The conductive fine particles may preferably be used in an amount of 3 to 20 parts by weight based on the 10 parts by weight of the resin component. When fine carbon particles and graphite particles are used in a combination, the fine carbon particles may preferably be used in an amount of 1 to 50 parts by weight based on 10 parts by weight of the graphite particles. The resin layer of the magnetic toner carrying member in which the conductive fine particles are dispersed may preferably have a volume resistivity of $10^{-6}$ to $10^{6}$ Ωcm.

In the present invention, the toner carrying member surface on which the magnetic toner is carried may be moved in the same direction as, or in the opposite direction to that of the image-bearing member surface. When the moving direction of the toner carrying member is the same as the direction of the image-bearing member surface, the former may preferably be 100% or more relative to the latter in terms of ratio. If the former is less than 100%, the quality of the images obtained tends to lower. The higher the moving speed ratio is, the larger the quantity of the toner fed to the developing zone is, and the higher the frequency of the toner adhesion to and removal from latent images is. The toner is scraped off from the unnecessary zone on the image-bearing member and imparted to the necessary zone, and as a result of repetitive scraping and imparting the toner, images faithful to the latent images can be obtained. More specifically, the moving speed of the toner carrying member surface may preferably be 1.05 to 3.0 times that of the image-bearing member surface.

The toner carrying member may preferably be disposed in opposed to the image-bearing member with a gap or space of 100 to 1,000 μm. If the space between the toner carrying member and the image-bearing member is less than 100 μm, it may be difficult to mass-produce image-forming apparatus satisfying stable imaging properties because the developing properties of the toner may be largely influenced by a minute change in the space. If the space between the toner carrying member and the image-bearing member is larger than 1,000 μm, the toner may not satisfactorily follow the latent image on the image-bearing member, thereby tending to give rise to a deterioration in the resolution performance, a decrease in the image density and a lowering of the image quality. More preferably, the space may be 120 to 500 μm.

In the image-forming method of the present invention, the developing step may preferably comprise applying an alternating electric field as a developing bias ($V_1$) to the toner carrying member and causing the toner to move to the latent image on the photosensitive member to form a toner image. In this case, the developing bias to be applied may be a voltage as formed by superimposing an alternating electric field to an direct voltage.

The alternating electric field used may have a waveform such as sine waveform, rectangular waveform, triangular waveform, or the like. Also, a pulse wave may be used which is formed by periodically turning on or turning off the direct current power source. Hence, the waveform of the alternating electric field may be a bias in which the voltage value is periodically changed.

Also, the alternating electric field may preferably be applied as the developing voltage at least with a peak-to-peak electric field intensity of $3\times10^6$ to $10\times10^6$ V/m and a frequency of 500 to 5,000 Hz between the toner carrying member carrying the toner and the image-bearing member.

In the present invention, the step of forming electrostatic latent images on the charged surface of the image-bearing member may preferably be carried out with the image exposure means. The image exposure means to form electrostatic latent images is not limited to the laser scanning exposure means to form digital latent images, and may be not only other light-emitting elements such as usual analog image exposure and LED, but also a combination of a light-emitting element such as fluorescent lamp and a liquid crystal shutter as long as they are able to form electrostatic latent images corresponding to the image information.

EXAMPLES

Hereinafter, the present invention will be described further specifically in detail along with production examples and examples. However, these production examples and examples are not at all intended to restrict the present invention. The number of parts in mixtures are all parts-by-weight basis.

<1> Magnetic Material

Production example 1 of a surface-treated magnetic material

An aqueous solution containing ferrous hydroxide was produced by mixing a sodium hydroxide solution with an aqueous ferrous sulfate solution in an amount 1.0 to 1.1 equivalent to ferrous ions.

While the pH of the aqueous solution being kept about 9, air was blown to carry out oxidation reaction at 80 to 90° C. to prepare a slurry solution for seed crystal production.

Next, after an aqueous ferrous sulfate solution was added to the resultant slurry solution in an amount 0.9 to 1.2 equivalent to the initial alkali quantity (the sodium component of sodium hydroxide), the oxidation reaction was further allowed to proceed by blowing air while the slurry being kept at pH about 8, and the magnetic iron oxide fine particle obtained after the oxidation reaction was washed, filtered, and once taken out. At that time, a small amount of a water-containing sample was taken and the water content was measured. Next, without being dried, the water-containing sample was again dispersed in another aqueous medium and pH of the re-dispersed solution was adjusted at about 6. While being sufficiently stirred, a silane coupling agent [n—$C_{10}H_{21}Si(OCH_3)_3$] was added in 2.0 parts by weight to 100 parts by weight of the magnetic iron oxide fine particle (the quantity of the magnetic iron oxide fine particle was calculated by subtracting the weight of the contained water from the weight of the water-containing sample) to carry out coupling treatment. The produced hydrophobic iron oxide fine particle was washed, filtered, and dried in a conventional manner, and then a slightly agglomerating fine particle was pulverized to obtain surface-treated magnetic material 1. The hydrophobicity of the magnetic material was 85%.

Production example 3 of a surface-treated magnetic material

A surface-treated magnetic material 3 was obtained in the same manner as in production example 1 except that n—$C_{18}H_{37}Si(OCH_3)_3$ was used as a silane coupling agent in production example 1 of a surface-treated magnetic material. The hydrophobicity of the obtained magnetic material was 93%.

Production example 4 of a surface-treated magnetic material

A surface-treated magnetic material 4 was obtained in the same manner as in production example 1 except that the addition amount of the coupling agent was 1.7 parts by weight in production example 1 of a surface-treated magnetic material. The hydrophobicity of the obtained magnetic material was 75%.

Production example 5 of a surface-treated magnetic material

A surface-treated magnetic material 5 was obtained in the same manner as in production example 1 except that the addition amount of the coupling agent was 1.5 parts by weight in the production example 1 of a surface-treated magnetic material. The hydrophobicity of the obtained magnetic material was 69%.

Production example 6 of a surface-treated magnetic material

A surface-treated magnetic material 6 was obtained in the same manner as in production example 1 except that the addition amount of the coupling agent was 1.3 parts by weight in the production example 1 of a surface-treated magnetic material. The hydrophobicity of the obtained magnetic material was 62%.

Production example 7 of a surface-treated magnetic material

A surface-treated magnetic material 7 was obtained in the same manner as in production example 1 except that the addition amount of the coupling agent was 1.0 part by weight in production example 1 of a surface-treated magnetic material. The hydrophobicity of the obtained magnetic material was 55%.

Production example 8 of a surface-treated magnetic material

A surface-treated magnetic material 8 was obtained in the same manner as in production example 1 except that the addition amount of the coupling agent was 0.7 parts by weight in the production example 1 of a surface-treated magnetic material. The hydrophobicity of the obtained magnetic material was 42%.

Production example 9 of a surface-treated magnetic material

A surface-treated magnetic material 9 was obtained in the same manner as in production example 1 of the surface-treated magnetic material except that the addition amount of the aqueous ferrous sulfate solution was increased and the amount of blowing air was decreased at the time of synthesis of the magnetic iron oxide particle. The hydrophobicity of the obtained magnetic material was 78%.

Production example 10 of a surface-treated magnetic material

A surface-treated magnetic material 10 was obtained in the same manner as in production example 1 of the surface-treated magnetic material except that the addition amount of the sodium hydroxide solution and the reaction conditions were adjusted and that the addition amount of the coupling agent was 1.0 part by weight in production example 1 of a surface-treated magnetic material. The hydrophobicity of the obtained magnetic material was 86%.

Production example 11 of a surface-treated magnetic material

A surface-treated magnetic material 11 was obtained in the same manner as in production example 10 of the surface-treated magnetic material except that the addition amount of the sodium hydroxide solution and the reaction conditions were further adjusted and that the addition amount of the coupling agent was 0.8 parts by weight in production example 10 of a surface-treated magnetic material. The hydrophobicity of the obtained magnetic material was 82%.

Production example 12 of a surface-treated magnetic material

A magnetic material was obtained by performing the oxidation reaction, and washing, filtering, and drying the produced magnetic fine particle on completion of the oxidation reaction, and then pulverizing the agglomerating particle in the same manner as in production example 1 of the surface-treated magnetic material. After that, 100 parts by weight of the obtained magnetic material was treated with 0.7 parts by weight of n—$C_{10}H_{21}Si(OCH_3)_3$ in a vapor phase to obtain surface-treated magnetic material 12. The treating agent and the hydrophobicity of the obtained surface-treated magnetic material are shown in Table 1.

Production example 13 of a surface-treated magnetic material

A magnetic material was obtained by performing the oxidation reaction while adjusting the addition amount of the sodium hydroxide solution and the reaction conditions in production example 1 of the surface-treated magnetic material and then washing, filtering, and drying the produced magnetic fine particle on completion of the oxidation reaction. After that, 100 parts by weight of the obtained magnetic material were dispersed in a toluene solution containing 5.0 parts by weight of γ-methacryloxypropyltrimethoxysilane coupling agent and subjected to heating treatment at 100° C. for 3 hours and drying treatment to obtain surface-treated magnetic material 13. The treating agent and the hydrophobicity of the obtained surface-treated magnetic material are shown in Table 1.

Production example 14 of a surface-treated magnetic material

A magnetic material was obtained by performing the oxidation reaction and washing, filtering, and drying the produced magnetic fine particle on completion of the oxidation reaction in the same manner as in production example 1 of the surface-treated magnetic material. After that, the obtained magnetic material was charged into another aqueous medium, pH of the resultant aqueous medium was adjusted at about 6, n—$C_{10}H_{21}Si(OCH_3)_3$ was added in 0.7 parts by weight to 100 parts by weight of the magnetic material, while being sufficiently stirred for coupling treatment, and then the produced surface-treated magnetic material was washed, filtered, and dried in a conventional manner. The agglomerating fine particle was then pulverized to obtain surface-treated magnetic material 14. The treating agent and the hydrophobicity of the obtained surface-treated magnetic material are shown in Table 1.

Production example A of a magnetic material

Magnetic material A was obtained by performing the oxidation reaction, and washing, filtering, and drying the produced magnetic material on completion of the oxidation reaction, then pulverizing the agglomerating particle in the same manner as in production example 1 of the surface-treated magnetic material.

<2> Conductive Fine Powder

Conductive fine powder example 1

The conductive fine powder 1 was a finely granular zinc oxide (resistance 1,500 Ωcm) with a volume-average particle diameter of 2.6 μm and of which 3.8% by volume had a particle diameter of 0.5 μm or smaller and 0% by number had a particle diameter of 5 μm or larger in the particle distribution and which was obtained by air-classifying a finely granular zinc oxide (produced by granulating a zinc oxide primary particle with resistance 80 Ωcm and primary particle diameter of 0.1 to 0.3 μm by pressure, white color) with a volume-average particle diameter of 3.9 μm and of which 5.4% by volume had a particle diameter of 0.5 μm or smaller and 9% by number had a particle diameter of 5 μm or larger in the particle distribution.

The conductive fine powder 1 was composed of the zinc oxide primary particle of 0.1 to 0.3 μm and agglomerates of 1 to 5 μm by observation with a scanning electron microscope in 3,000 and 30,000 times magnification.

The transmittance of conductive fine powder 1 was found about 35% by measuring the transmittance in a wavelength region of 740 nm with a 310 T transmission type densitometer produced by X-Rite Co. and using a light source of emitting light of 740 nm corresponding to the exposure light with 740 nm wavelength of a laser beam scanner to be employed for light exposure of images in an image forming apparatus.

Conductive fine powder example 2

A gray white conductive fine powder (resistance 40 Ωcm) with a volume-average particle diameter of 3.3 μm and of which 0.3% by volume had a particle diameter of 0.5 μm or smaller and 1% by number had a particle diameter of 5 μm or larger in the particle distribution was obtained by air-classifying aluminum borate surface-treated with antimony-tin oxide with a volume-average particle diameter of 2.6 μm to remove coarse particles and then repeating dispersion in an aqueous medium and filtration to remove fine particle. The obtained conductive fine powder was set to be conductive fine powder 2.

<3> Magnetic Toner

Production of magnetic toner 1

An aqueous medium containing $Ca_3(PO_4)_2$ was produced by adding 451 g of an aqueous 0.1 M—$Na_3PO_4$ solution to 709 g of ion-exchanged water, heating the resultant solution to 60° C., and then adding 67.7 g of an aqueous 1.0 M—$CaCl_2$ solution.

| | |
|---|---|
| Styrene | 78 parts |
| n-Butyl acrylate | 22 parts |
| Divinylbenzene | 0.5 parts |
| Saturated polyester resin (number average molecular weight of 10,000: acid value of 10 mgKOH/g) | 5 parts |
| Negative charge controlling agent (a monoazo dye type Fe compound | 1 part |
| Surface-treated magnetic material 1 | 90 parts |

The foregoing materials were evenly dispersed and mixed using an attriter produced by Mitsui Miike Chemical Engineering Machinery Co., Ltd. The monomer composition was heated to 60° C. and further 10 parts of ester wax (the maximum temperature value 72° C. for the highest heat absorption peak of DSC) was mixed, stirred, and dissolved in the composition and further 5 parts by weight of a polymerization initiator 2,2'-azobis(2,4-dimethylvaleronitrile) was dissolved [under the conditions of t½=140 minutes at 60° C.].

The foregoing polymerizable monomer system was added to the foregoing aqueous medium, stirred for 15 minutes at 10,000 rpm under conditions of 60° C. and $N_2$ atmosphere with a TK type homomixer (produced by Tokushukika Co., Ltd.) to carry out granulation. After that, reaction of the resultant mixture was carried out at 60° C. for 6 hours while being continuously stirred by paddle type stirring blades. After that, the liquid temperature was increased to 80° C. and the mixture was continuously stirred for 4 hours. On completion of the reaction, distillation at 80° C. for 2 hours was performed and then the resultant suspension was cooled, mixed with hydrochloric acid to dissolve the dispersant, and subjected to filtering, washing, and drying treatment to obtain magnetic toner particle 1 with a weight average particle diameter of 7.3 μm.

Magnetic toner 1 with a weight average particle diameter ($D_4$) of 7.3 μm was produced by mixing 100 parts of the obtained magnetic toner particle, 1.0 part of a hydrophobic silica fine powder produced by treating a silica fine powder with a number average primary particle diameter of 9 nm with hexamethyldisilazane and then with a silicone oil and having BET value of 200 $m^2/g$ after the treatment, and 1.5 parts of a conductive fine powder 1 by a Henshel mixer (Mitsui Miike Chemical Engineering Machinery Co., Ltd.) for 3 minutes at 40 m/sec peripheral speed of stirring blades. The physical properties of the magnetic toner 1 are shown in Table 2. The ratio ($D_4/D_1$) of the weight average particle diameter ($D_4$) and the number average particle diameter ($D_1$) of magnetic toner 1 was 1.22.

Production of magnetic toner 2

Magnetic toner 2 was produced in the same manner as the production example of the magnetic toner 1 except that conductive fine powder 2 was used instead of conductive fine powder 1. The physical properties of magnetic toner 2 are shown in Table 2.

Production of magnetic toner 3

A magnetic toner 3 was produced in the same manner as the production example of the magnetic toner 1 except that conductive fine powder 1 was not used. The physical properties of magnetic toner 3 are shown in Table 2.

Production of magnetic toner 5

A magnetic toner 5 was produced in the same manner as in the production example of magnetic toner 3 except that surface-treated magnetic powder 3 was used. The physical properties of magnetic toner 5 are shown in Table 2.

Production of magnetic toner 6

A magnetic toner 6 was produced in the same manner as in the production example of magnetic toner 3 except that the surface-treated magnetic powder 4 was used. The physical properties of magnetic toner 6 are shown in Table 2.

Production of magnetic toner 7

A magnetic toner 7 was produced in the same manner as in the production example of magnetic toner 3 except that surface-treated magnetic powder 5 was used. The physical properties of magnetic toner 7 are shown in Table 2.

Production of magnetic toner 8

A magnetic toner 8 was produced in the same manner as in the production example of magnetic toner 3 except that surface-treated magnetic powder 6 was used. The physical properties of magnetic toner 8 are shown in Table 2.

Production of magnetic toner 9

A magnetic toner 9 was produced in the same manner as in the production example of magnetic toner 3 except that surface-treated magnetic powder 7 was used. The physical properties of magnetic toner 9 are shown in Table 2.

Production of magnetic toner 10

A magnetic toner 10 was produced in the same manner as in the production example of magnetic toner 3 except that surface-treated magnetic powder 8 was used. The physical properties of magnetic toner 10 are shown in Table 2.

Production of magnetic toner 11

A magnetic toner 11 was produced in the same manner as in the production example of magnetic toner 3 except that the surface-treated magnetic powder 9 was used. The physical properties of magnetic toner 11 are shown in Table 2.

Production of magnetic toner 12

A magnetic toner 12 was produced in the same manner as in the production example of magnetic toner 3 except that surface-treated magnetic powder 10 was used. The physical properties of magnetic toner 12 are shown in Table 2.

Production of magnetic toner 13

An aqueous medium containing $Ca_3(PO_4)_2$ was produced by adding 501 g of an aqueous 0.1 M—$Na_3PO_4$ solution to 809 g of ion-exchanged water, heating the resultant solution to 60° C., and then gradually adding 67.7 g of an aqueous 1.07 M—$CaCl_2$ solution.

| | |
|---|---|
| Styrene | 80 parts by weight |
| n-Butyl acrylate | 20 parts by weight |
| Divinylbenzene | 0.5 parts by weight |
| Unsaturated polyester resin (number average molecular weight of 18,000: acid value of 10 mgKOH/g) | 2 parts by weight |
| Saturated polyester resin (number average molecular weight of 17,000: acid value of 10 mgKOH/g) | 3 parts by weight |
| Negative charge controlling agent (a monoazo dye type Fe compound) | 1 part by weight |
| Surface-treated magnetic material 10 | 90 parts by weight |
| Ester wax (the temperature value 72° C. for the highest heat absorption peak of DSC) | 5 parts by weight |

The above described materials were evenly dispersed and mixed with an attriter (produced by Mitsui Miike Chemical Engineering Machinery Co., Ltd.).

The resultant monomer composition was heated to 60° C. and further 6 parts of ester wax (the temperature value 72° C. for the highest heat absorption peak of DSC) was mixed, stirred, and dissolved in the composition and further 3 parts by weight of a polymerization initiator 2,2'-azobis(2,4-dimethylvaleronitrile) was dissolved [under the conditions of t½=140 minutes at 60° C.].

The foregoing polymerizable monomer system was added to the foregoing aqueous medium, stirred for 15 minutes at 10,000 rpm under conditions of 60° C. and $N_2$ atmosphere with a TK type homomixer (produced by Tokushukika Co., Ltd.) to carry out granulation. After that, reaction of the resultant mixture was carried out at 60° C. for 6 hours while being continuously stirred by paddle type stirring blades. After that, the liquid temperature was increased to 80° C. and the mixture was continuously stirred for 4 hours. On completion of the reaction, distillation at 80° C. for 2 hours was performed and then the resultant suspension was cooled, mixed with hydrochloric acid to dissolve the dispersant, and subjected to filtering, washing, and drying treatment to obtain a magnetic toner particle with a weight average particle diameter of 6.8 μm.

A magnetic toner 13 was produced by mixing 100 parts by weight of the obtained magnetic toner particle with 1.0 part by weight of silica used in the production of the magnetic toner 1 by a Henshel mixer (Mitsui Miike Chemical Engineering Machinery Co., Ltd.) for 3 minutes at 40 m/sec peripheral speed of stirring blades. The physical properties of magnetic toner 13 are shown in Table 2.

Production of magnetic toner 14

An aqueous medium containing $Ca_3(PO_4)_2$ was produced by adding 501 g of an aqueous 0.1 M—$Na_3PO_4$ solution to 809 g of ion-exchanged water, heating the resultant solution to 60° C., and then gradually adding 67.7 g of an aqueous 1.07 M—$CaCl_2$ solution.

| | |
|---|---|
| Styrene | 78 parts by weight |
| n-Butyl acrylate | 22 parts by weight |
| Divinylbenzene | 0.3 parts by weight |
| Unsaturated polyester resin (number average molecular weight of 18,000: acid value of 10 mgKOH/g) | 1 part by weight |
| Saturated polyester resin (number average molecular weight of 17,000: acid value of 10 mgKOH/g) | 4 parts by weight |
| Negative charge controlling agent (a monoazo dye type Fe compound) | 1 part by weight |
| Surface-treated magnetic material 10 | 100 parts by weight |

The above described materials were evenly dispersed and mixed with an attriter (produced by Mitsui Miike Chemical Engineering Machinery Co., Ltd.). The resultant monomer composition was heated to 60° C. and further 10 parts by weight of ester wax (the maximum temperature value 72° C. for the highest heat absorption peak of DSC) was mixed, stirred, and dissolved in the composition and further 3 parts by weight of a polymerization initiator 2,2'-azobis(2,4-dimethylvaleronitrile) was dissolved [under the conditions of t½=140 minutes at 60° C.].

The foregoing polymerizable monomer system was added to the foregoing aqueous medium, stirred for 15 minutes at 10,000 rpm under conditions of 60° C. and $N_2$ atmosphere with a TK type homomixer (produced by Tokushukika Co., Ltd.) to carry out granulation. After that, reaction of the resultant mixture was carried out at 60° C. for 6 hours while being continuously stirred by paddle type stirring blades. After that, the liquid temperature was increased to 80° C. and the mixture was continuously stirred for 4 hours. On completion of the reaction, distillation at 80° C. for 2 hours was performed and then the resultant suspension was cooled, mixed with hydrochloric acid to dissolve the dispersant, and subjected to filtering, washing, and drying treatment to obtain a magnetic toner particle with a weight average particle diameter of 7.0 μm.

A magnetic toner 14 was produced by mixing 100 parts by weight of the obtained magnetic toner particle with 1.0 part by weight of silica used in the production of the magnetic toner 1 by a Henshel mixer (Mitsui Miike Chemical Engineering Machinery Co., Ltd.) for 3 minutes at 40 m/sec peripheral speed of stirring blades. The physical properties of magnetic toner 14 are shown in Table 2.

Production of magnetic toner 15

A magnetic toner 15 was produced in the same manner as in the production example of magnetic toner 3 except that surface-treated magnetic material 11 was used. The physical properties of magnetic toner 15 are shown in Table 2.

Production of magnetic toner 16

| | |
|---|---|
| Styrene | 65.0 parts by weight |
| 2-Ethylhexyl acrylate | 35.0 parts by weight |
| Divinylbenzene | 0.5 parts by weight |
| Magnetic material 1 | 98.0 parts by weight |
| Saturated polyester used for magnetic toner 1 | 10 parts by weight |

The above described materials were evenly dispersed and mixed with an attriter. After that, the resultant composition was heated to 60° C. and further 10 parts by weight of ester wax used for the production of the magnetic toner 1 and 3.5 parts by weight of 2,2'-azobis(isobutyronitrile) were mixed, stirred, and dissolved in the composition.

Next, after 650 parts by weight of an aqueous colloidal solution of 4% by weight of tricalcium phosphate were heated to 60° C., 222 parts by weight of the foregoing polymerizable monomer system were added and the resultant mixture was emulsified at 10,000 rpm rotation speed for 3 minute with a TK type homomixer at a room temperature.

After that, reaction of the resultant mixture was carried out at 85° C. for 10 hours while being continuously stirred in nitrogen atmosphere, and then cooled to a room temperature to obtain a magnetic toner particle dispersion.

Next, 13.0 parts by weight of styrene, 7.0 parts by weight of 2-ethylhexyl acrylate, 0.4 parts by weight of 2,2'-azobis (isobutyronitrile), 0.2 parts by weight of divinylbenzene, and 0.1 parts by weight of sodium lauryl sulfate were added to 20 parts by weight of water and dispersed using an ultrasonic homogenizer to obtain 40.7 parts by weight of an aqueous emulsion.

The obtained emulsion was dropwise added to the foregoing magnetic toner particle dispersion to swell the particles. After that, the mixture was stirred in a nitrogen atmosphere and reaction was carried out at 85° C. for 10 hours. Then, the resultant suspension was cooled, mixed with hydrochloric acid to dissolve the dispersion medium, and subjected to filtering, washing, and drying treatment to obtain magnetic toner particle 2 with a weight average particle diameter of 7.8 $\mu$m.

A magnetic toner 16 was produced by mixing 100 parts by weight of the obtained magnetic toner particle 2 with 0.2 parts by weight of magnetic material 1 and 1.0 part by weight of silica used in the production of the magnetic toner 1 by a Henshel mixer (Mitsui Miike Chemical Engineering Machinery Co., Ltd.). The physical properties of the magnetic toner 16 are shown in Table 2.

Production of magnetic toner 17 (comparative example)

A magnetic toner 17 was produced by mixing 100 parts by weight of the obtained magnetic toner particle 2 obtained by production of magnetic toner 16 with 1.0 part by weight of silica used in the production of magnetic toner 1 with a Henshel mixer (Mitsui Miike Chemical Engineering Machinery Co., Ltd.). The physical properties of magnetic toner 17 are shown in Table 2.

Production of magnetic toner 18 (comparative example)

A magnetic toner 18 was produced in the same manner as in production example of the magnetic toner 3 except that surface-treated magnetic material 12 was used. The physical properties of magnetic toner 18 are shown in Table 2.

Production of magnetic toner 19 (comparative example)

A magnetic toner 19 was produced in the same manner as in the production example of magnetic toner 3 except that surface-treated magnetic material 13 was used. The physical properties of magnetic toner 19 are shown in Table 2.

Production of magnetic toner 20 (comparative example)

A magnetic toner 20 was produced in the same manner as in the production example of the magnetic toner 3 except that surface-treated magnetic material 14 was used. The physical properties of magnetic toner 20 are shown in Table 2.

Production of magnetic toner 21 (comparative example)

| | |
|---|---|
| Styrene/n-butyl acrylate copolymer (weight ratio 78/22) | 100 parts by weight |
| Saturated polyester resin (number average molecular weight of 10,000: acid value of 10 mgKOH/g) | 5 parts by weight |
| Negative charge controlling agent (a monoazo dye type Fe compound) | 1 part by weight |
| Surface-treated magnetic material 1 | 90 parts by weight |
| Ester wax used for example 1 | 10 parts by weight |

A toner particle with a weight average particle diameter of 8.4 $\mu$m was produced by mixing the above described materials using a blender, melting and kneading the mixture by a twin-screw extruder heated at 110° C., coarsely crushing the cooled kneaded material by a hammer mill, finely pulverized the coarsely crushed mixture by a jet mill, and air-classifying the resultant finely pulverized material. Magnetic toner 21 was produced by mixing 1.0 part by weight of silica used for production example 1 of the magnetic toner with 100 parts by weight of the obtained toner particle by a Henshel mixer at 40 m/sec peripheral speed of the stirring blades for 3 minutes. The physical properties of magnetic toner 21 are shown in Table 2.

The intensity of the magnetism of the foregoing respective magnetic toners in a magnetic field of 79.6 kA/m was all within 24 to 26 $Am^2/kg$. The THF-insoluble matter of-the resin components of each magnetic toner was 15 to 30%, and all of the toners had a molecular weight of the peak top of the main peak of the molecular weight distribution by GPC within 17,000 to 30,000.

Production of magnetic toner 22

A magnetic toner 22 was produced by mixing 0.8 parts of hydrophobic silica fine powder produced by treating silica with a number average primary particle diameter of 7 nm with hexamethyldisilazane and having BET value of 280 $m^2/g$ after the treatment with 100 parts of toner particle 1 produced by the production of magnetic toner 1 by a Henshel mixer (Mitsui Miike Chemical Engineering Machinery Co., Ltd.) for 3 minutes at 40 m/sec peripheral speed of stirring blades. The physical properties of magnetic toner 22 are shown in Table 3.

Production of magnetic toner 23

A magnetic toner 23 was produced by mixing 2.5 parts of a hydrophobic silica fine powder produced by treating a silica with a number average primary particle diameter of 45 nm with hexamethyldisilazane and having BET value of 40 $m^2/g$ after the treatment with 100 parts of toner particle 1 produced by the production of magnetic toner 1 by a Henshel mixer (Mitsui Miike Chemical Engineering Machinery Co., Ltd.) for 3 minutes at 40 m/sec peripheral speed of stirring blades. The physical properties of magnetic toner 23 are shown in Table 3.

Production of magnetic toner 24

A magnetic toner 24 was produced by mixing 4.0 parts of a hydrophobic silica fine powder produced by treating silica with the number average primary particle diameter of 90 nm with hexamethyldisilazane and having BET value of 25 $m^2/g$ after the treatment with 100 parts of toner particle 1 produced by the production of magnetic toner 1 by a Henshel mixer (Mitsui Miike Chemical Engineering Machinery Co., Ltd.) for 3 minutes at 40 m/sec peripheral speed of stirring blades. The physical properties of magnetic toner 24 are shown in Table 3.

Production of magnetic toner 25

A magnetic toner 25 was produced in the same manner as in the production of the magnetic toner 1 except that the peripheral speed of the stirring blades of the Henshel mixer was controlled at 30 m/sec and mixing was carried out for 2 minutes. The physical properties of the magnetic toner 25 are shown in Table 3.

Production of magnetic toner 26

A magnetic toner 26 was produced in the same manner as in the production of magnetic toner 1 except that the peripheral speed of the stirring blades of the Henshel mixer was controlled at 20 m/sec and mixing was carried out for 1 minute. The physical properties of magnetic toner 26 are shown in Table 3.

Production of magnetic toner 27

A magnetic toner 27 was produced in the same manner as in the production of magnetic toner 1 except that the peripheral speed of the stirring blades of the Henshel mixer was controlled at 40 m/sec and mixing was carried out for 10 minutes. The physical properties of magnetic toner 27 are shown in Table 3.

Production of magnetic toner 28

A magnetic toner 28 was produced in the same manner as in the production of the magnetic toner 3 except that the amount of the surface-treated magnetic material was adjusted to be 40 parts by weight. The physical properties of magnetic toner 28 are shown in Table 3.

Production of magnetic toner 29

A magnetic toner 29 was produced in the same manner as in the production of the magnetic toner 3 except that the amount of the surface-treated magnetic material was adjusted to 160 parts by weight. The physical properties of magnetic toner 29 are shown in Table 3.

The intensity of the magnetism of the foregoing respective magnetic toners in a magnetic field of 79.6 kA/m was 16.1 $Am^2/kg$ for magnetic toner 28 and 36.0 $Am^2/kg$ for the magnetic toner 29 and within 24 to 26 $Am^2/kg$ for the rest of the toners. The THF-insoluble matter of each magnetic toner was 15 to 30% and all of the toners had a molecular weight of the peak top of the main peak of the molecular weight distribution measured by GPC within 17,000 to 30,000.

Production of magnetic toner 30

A magnetic toner 30 was produced in the same manner as in the production of magnetic toner 3 except that the amount of the ester wax was adjusted to 0.8 parts by weight. The physical properties of magnetic toner 30 are shown in Table 4.

Production of magnetic toner 31

A magnetic toner 31 was produced in the same manner as in the production of the magnetic toner 3 except that the amount of the ester wax was adjusted to be 35 parts by weight. The physical properties of magnetic toner 31 are shown in Table 4.

Production of magnetic toner 32

A magnetic toner 32 was produced in the same manner as in the production of the magnetic toner 3 except that 4 parts by weight of polyethylene wax were used instead of 10 parts by weight of the ester wax. The physical properties of magnetic toner 32 are shown in Table 4.

Production of magnetic toner 33

A magnetic toner 33 was produced in the same manner as in the production of the magnetic toner 3 except that 10 parts by weight of polyethylene wax were used instead of 10 parts by weight of the ester wax. The physical properties of magnetic toner 33 are shown in Table 4.

Production of magnetic toner 34

A magnetic toner 34 was produced in the same manner as in the production of the magnetic toner 3 except that the amount of divinylbenzene was adjusted to 0.1 parts by weight. The physical properties of magnetic toner 34 are shown in Table 4.

Production of magnetic toner 35

A magnetic toner 35 was produced in the same manner as in the production of the magnetic toner 3 except that the amount of divinylbenzene was adjusted to 0.2 parts by weight. The physical properties of magnetic toner 35 are shown in Table 4.

Production of magnetic toner 36

A magnetic toner 36 was produced in the same manner as in the production of magnetic toner 3 except that the amount of divinylbenzene was adjusted to 1.0 part by weight. The physical properties of magnetic toner 36 are shown in Table 4.

Production of magnetic toner 37

A magnetic toner 37 was produced in the same manner as in the production of magnetic toner 3 except that the amount of divinylbenzene was adjusted to 1.2 parts by weight. The physical properties of magnetic toner 37 are shown in Table 4.

Production of magnetic toner 38 (comparative example)

A magnetic toner 38 was produced in the same manner as in the production of magnetic toner 3 except that the amount of divinylbenzene was adjusted to 1.5 parts by weight. The physical properties of magnetic toner 38 are shown in Table 4.

Production of magnetic toner 39 (comparative example)

A magnetic toner 39 was produced in the same manner as in the production of magnetic toner 3 except that no divinylbenzene was added and 1 part by weight of an unsaturated polyester was added. The physical properties of magnetic toner 39 are shown in Table 4.

The intensity of the magnetism of the foregoing respective magnetic toners in a magnetic field of 79.6 kA/m was within 24 to 26 $Am^2/kg$. Each toner had a molecular weight of the peak top of the main peak of the molecular weight distribution measured by GPC within 12,000 to 36,000.

Example 1

Image Reproduction Test

Production of photosensitive member 1

Figure 4:
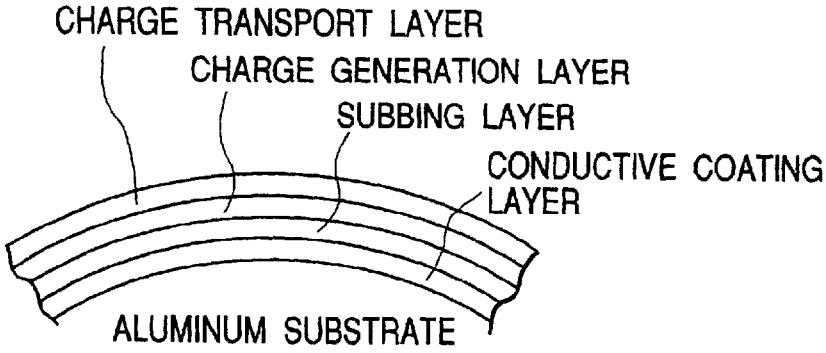
FIG. 4 schematically illustrates layer construction of a photosensitive member.

An Al cylinder with 30 mm diameter was used as a base for a photosensitive member. A photosensitive member 1 was produced by forming the following layers of the structure as shown in FIG. 4 by successively carrying out immersion application:

(1) Conductive coating layer: Mainly composed of a dispersion powdery tin oxide and titanium oxide in a phenol resin and having a film thickness of 15 $\mu$m.

(2) Subbing layer: Mainly composed of modified nylon and copolymerized nylon and having a film thickness of 0.6 $\mu$m.

(3) Charge generation layer: Mainly composed of a dispersion of an azo pigment having absorption in a long wavelength region in a butyral resin and having a film thickness of 0.6 $\mu$m.

(4) Charge transport layer: Mainly composed of an dispersion produced by dissolving a triphenylamine compound having a hole transporting property in a polycarbonate resin (molecular weight 20,000 based on Ostwald's viscosity equation) in 8:10 weight ratio and further adding and evenly dispersing poly(tetrafluoroethylene) powder (particle diameter of 0.2 μm) in 10 parts by weight of a total solid matter in the resultant solution, and having a film thickness of 25 μm and the contact angle to water at 95 degrees.

The contact angle was measured using pure water by a contact angle meter CA-X type produced by Kyowa Interface Science Co., Ltd.

Image Forming Apparatus

As an image forming apparatus, a laser beam printer LBP-1760 manufactured by Canon was brought into remodeling and the one shown for the above described example as in FIG. 1 was used. The above described photosensitive member 1 was used for photosensitive member 100 as the image bearing member.

To this photosensitive member, a rubber roller charger 117 in which conductive carbon was dispersed and which was coated with a nylon resin was brought into contact (with contact pressure of 60 g/cm) as a charging member, and a bias in which an alternate voltage 2.0 kVpp overlapped with a direct-current voltage −680 Vdc was applied so that the surface of the photosensitive member was evenly charged. Following charging, an image portion was exposed to a laser light so that an electrostatic latent image was formed. At this time, the dark portion potential was Vd=−680 V while the light portion potential was VL=−150 V.

The gap between the photosensitive drum and the developing sleeve was set to be 230 μm, and as a toner carrier of the magnetic toner, a developing sleeve 102 in which a resin layer of the below described configuration with a layer thickness of approximately 7 μm, and JIS central line average roughness (Ra) of 1.0 μm was formed on an aluminum cylinder with a diameter of 16 mm the surface of which was blasted was used, and a blade made of urethane of developing magnetic pole 85 mT (850 Gauss), thickness of 1.0 mm as a toner controlling member, and free length of 0.5 mm was brought into contact at line pressure of 39.2 N/m (40 g/cm).

| | |
|---|---|
| Phenol resin | 100 parts |
| Graphite (particle diameter of approximately 7 βm) | 90 parts |
| Carbon black | 10 parts |

Subsequently, a developing bias of direct current voltage Vdc=−450 V, an overlapping alternate electric field of $5.22\times 10^6$ V/m, and a frequency of 2,400 Hz were used. In addition, the periphery velocity of the developing sleeve was set at speed (218 mm/sec) that is 110 percent in the forward direction toward the periphery velocity (198 mm/sec) of the photosensitive member.

In addition, as a transfer member 114, a transfer roller (made of ethylene propylene rubber in which conductive carbon was dispersed, having a volume resistant value of the conductive elastic layer being $10^8$ Ωcm, surface rubber hardness being 24°, diameter being 20 mm and contact pressure being 59 N/m (60 g/cm)) as in FIG. 3 was caused to go at the same speed as the photosensitive member periphery velocity (94 mm/sec) in the direction of A in FIG. 3, and the transfer bias was a direct current 1.5 kV.

As a fixing method, a fixing apparatus 126, which lacks an oil apply function and is systemized to proceed with heating and pressuring with a heater via a film, was used. The pressure roller having a surface layer of fluorine-based resin was used and the diameter of the roller was 30 mm. In addition, the fixing temperature and the nip width were set at 240° C. and at 7 mm, respectively.

Firstly, using magnetic toner 1, an imaging test on 6000 sheets was implemented with an image pattern consisting only of vertical lines in printing rate of 4 percent in an environment of ordinary temperature and ordinary humidity (23° C. and 60% RH), in an environment of low temperature and low humidity (15° C. and 10% RH), and in an environment of high temperature and high humidity (30° C. and 80% RH). Paper of 75 g/m$^2$ was used as the transferring material and the toner's quantity of filling was 400 g. In addition, in the environment of low temperature and low humidity, after image reproduction during the initial step, a half-tone image was obtained using Fox River Bond paper to assess fixing performance.

As a result, magnetic toner 1 showed high transfer performance during the initial step, and a good image without causing blank area by poor transfer, any ghost, and any fog onto the non-image portion was obtained. Its fixing performance was also good and no offset occurred. The assessment results are shown in Table 5, Table 6, and Table 7.

Assessment items and their judgment standards described in the examples of the present invention as well as comparative examples will be described below.

Image density

Forming a solid image portion, image density was measured with a Macbeth reflective density meter (manufactured by Macbeth Corp.) on this solid image.

Transfer efficiency

Transfer efficiency was calculated by a following equation in an approximate fashion with a Macbeth density value for the one involving transfer residual toner on the photosensitive member after solid black image transfer which underwent taping and was stripped off and stuck onto the paper being C, Macbeth density for the one involving post-transfer pre-fixing toner put onto paper to which a MYLAR tape was stuck being D, and Macbeth density for the Mylar tape which was stuck onto unused paper being E.

$$\text{Transfer efficiency (\%)} = \frac{D-C}{D-E}\times 100$$

The transfer efficiency obtained by the above described calculation results were judged on the following standards:

A: Transfer efficiency being not less than 96%.

B: Transfer efficiency being not less than 92% and less than 96%.

C: Transfer efficiency being not less than 89% and less than 92%.

D: Transfer efficiency being less than 89%.

Image quality

Judgment standards of image quality were obtained by comprehensively assessing uniformity of image and fine-line reproducing performance.

Uniformity of image is judged by uniformity of a solid black image as well as a halftone image.

A: A clear image that is excellent in fine-line reproducing performance and uniformity of image.

B: A good image although it is a little inferior in fine-line reproducing performance and uniformity of image.

C: Image quality without any problems for practical use.

D: practically unfavorable image with poor fine-line reproducing performance and uniformity of image.

Fog

As for measurement of fog, a REFLECTMETER MODEL TC-6DS manufactured by Tokyo Denshoku Technical Center Co., Ltd. was used for measurement. As for a filter, a green filter was used and fog was calculated by the following equation:

Fog (reflecting ratio) (%)=reflecting ratio of standard paper (%)−reflecting ratio of sample non-image portion Judgment standards of fog are as follows:

A: Extremely good (less than 1.5%)

B: Good (not less than 1.5% and less than 2.5%)

C: Normal (not less than 2.5% and less than 4.0%) (not problematic practically)

D: Poor (not less than 4%).

Fixing performance

Fixing performance was assessed by applying weight of 50 g/cm$^2$ onto the halftone image obtained in an environment of low temperature and low humidity, employing a fixed image on soft thin paper that was caused to reciprocally slide 5 times, and taking a drop rate (%) in image density before and after sliding.

A: Less than 10%

B: Not less than 10% and less than 20%

C: Not less than 20% and less than 30%

D: Not less than 30%

Anti-offset properties

Anti-offset properties were assessed with levels of stains on an image as well as on a rear surface thereof after running test.

A: No stains appear.

B: Slight stains are visible.

C: A few stains are visible.

D: Remarkable stains appear.

Examples 2, 3, and 5–16

As toner, magnetic toners 2, 3, and 5–16 were used and under conditions similar to those in the example 1 image reproduction tests as well as assessment on running performance were implemented. As a result, image characteristics of the initial step were not problematic and for each environment, a result without any big problems up to 6,000 sheets of printing was obtained. The results are shown in Tables 5 to 7.

Comparative Examples 1 to 5

As toner, magnetic toners 17 to 21 were used and image reproduction tests as well as assessment on running performance were implemented by the image forming method as in example 1. As a result, during running tests, image density as well as transfer efficiency dropped, and fog, ghost, and aggravation of image quality took place. This seems to be caused by high liberation percentage of iron as well as iron compounds or by low average circularity of the magnetic toner. The results are shown in Tables 5 to 7.

Examples 17 to 24

Magnetic toners 22 to 29 were used and under conditions similar to those in example 1 image reproduction tests as well as assessment on running performance were implemented. As a result, none of image characteristics of the initial step were problematic, and for each environment, a result without any big problems up to 6,000 sheets of printing with respect to any of toners was obtained. The assessment results are shown in Tables 8 to 10.

Examples 25 to 32

Magnetic toners 30 to 37 were used and under conditions similar to those in example 1 image reproduction tests as well as assessment on running performance were implemented. As a result, none of image characteristics of the initial step were problematic and for each environment, a result without any big problems up to 6,000 sheets of printing with respect to any of toners was obtained. In addition, fixing performance and anti-offset properties were also on levels without any big problems. The assessment results are shown in Tables 11 to 12.

Comparative Examples 6 and 7

Magnetic toners 38 and 39 were used and under conditions similar to those in example 1 image reproduction tests as well as assessment on running performance were implemented. As a result, with the magnetic toner 38, image characteristics of the initial step were not problematic and for each environment, a result without any big problems up to 6,000 sheets of printing was obtained. With the magnetic toner 39, under the environment with high temperature and high humidity, image density dropped and aggravation of transfer performance took place due to deteriorated running. In addition, with any of toners, fixing performance or anti-offset properties were poor, and practically unfavorable. The assessment results are shown in Tables 11 to 13.

Example 33

The magnetic toner of the present invention is applicable to a cleanerless image forming method or an image forming method having a developing cleaning (recovery) step as well. The image forming method of the present invention will be described by way of concrete examples as follows, but the present invention will not be limited to these to any extent.

Manufacture of photosensitive member 2

Figure 5:
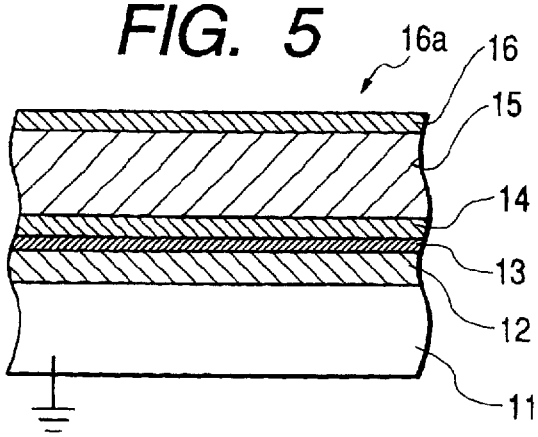
FIG. 5 schematically illustrates an example of the construction of a photosensitive member used in the present invention.

A photosensitive member 2 is a photosensitive member in which organic light conductive substance for negative charging was used and which used an aluminum cylinder with a diameter of 30 mm as a base member. To this, layers configured as shown in FIG. 5 and as described below were sequentially laminated by immersion application so that the photosensitive member 2 was produced.

(1) The first layer is a conductive layer, or a conductive particle dispersed resin layer (with powder of tin oxide as well as titanium oxide dispersed into a phenol resin as a main component) of 20 $\mu$m thickness which has been provided in order to relieve defects in the aluminum base and to prevent moire from taking place due to reflection of laser light.

(2) The second layer is a positive charge injection prevention layer (subbing layer), and acts a role to prevent the positive charge injected from the aluminum base from canceling the negative charge which is charged onto the surface of the photosensitive member, and is a medium resistant layer of thickness of approximately 1 $\mu$m which undergoes resistant adjustment to give $10^6$ Ωcm with methoxy-methylated nylon.

(3) The third layer is a charge generating layer, is a layer of thickness of approximately 0.3 $\mu$m in which disazo-based pigments are dispersed into a butyral resin, and receives laser exposure to generate a positively and negatively charged pair.

(4) The fourth layer is a charge transportation layer, is a layer of thickness of approximately 25 $\mu$m in which a hydrazone compound is dispersed into a polycarbonate resin, and is a P-type semiconductor, and accordingly the negative charges which are charged onto the surface of the photosensitive member cannot move in this layer, but can transport to the surface of the photosensitive member only positive charges which are generated in the charge generating layer.

(5) The fifth layer is a charge injection layer in which conductive tin oxide super fine powder and tetrafluoroethylene resin particles of particle size of approximately 0.25 μm are dispersed into the photocuring acryl resin. In particular, 100% by weight of tin oxide particles with particle size of approximately 0.03 μm in which antimony undergoes doping to become low resistant toward the resin, moreover 20% by weight of tetrafluoroethylene resin particles, and 1.2% by weight of a dispersant are dispersed. Thus prepared coating liquid is coated to attain a thickness of approximately 2.5 μm by a spray coating method, and subjected to hardening by way of light radiation to provide a charge injected layer.

Resistant on the front surface of the obtained photosensitive member is $5\times10^{12}$ Ωcm and the contact angle toward water on the front surface of the photosensitive member was 102 degrees.

Manufacturing of charging member

With an SUS roller of diameter 6 mm and length 264 mm being treated as a metal core, and on the metal core, a urethane layer with medium resistant in which urethane resin, carbon black as conductive particles, a sulfurizing agent, and a foaming agent, etc. were compounded was formed in a shape of a roller, which further undergoes cut-grinding to adjust a shape as well as surface outcome to prepare a charging roller being a bendable member of diameter 12 mm and length of 234 mm.

Figure 6:
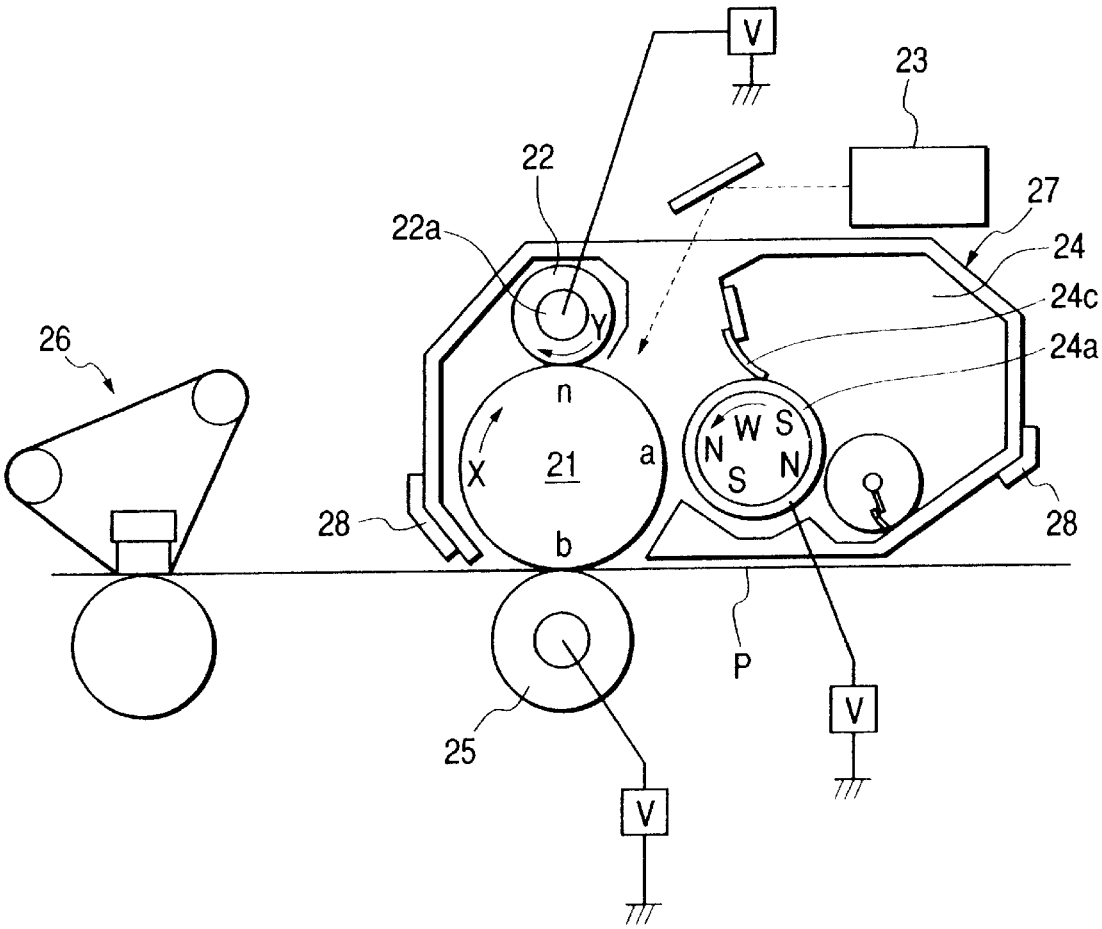
FIG. 6 schematically illustrates the construction of an image-forming apparatus used in Example 33.

The obtained charging roller had a resistance of $10^5$ Ωcm and hardness of 30 degrees by Asker-C hardness. In addition, as a result of observation with a scanning electron microscope on the surface of this charging roller, it was found that the average cell diameter was approximate 100 μm, and the gap percentage was 60%. Image forming apparatus FIG. 6 is a schematic configuration model view of an example of an image forming apparatus according to the present invention.

The image forming apparatus used in example 33 is a laser printer (a recording apparatus) of a cleaning process simultaneous with developing (cleanerless system) utilizing the transfer system electrophotographic process. Exemplified is a non-contact developing in which a process cartridge in which a cleaning unit having a cleaning member such as a cleaning blade, etc. is removed, magnetic toner 1 is used as a magnetic toner, and the toner layer on the magnetic toner carrier and the image bearing member are not brought into contact.

(1) Holistic schematic configuration of printer of the present example

A rotary drum type OPC photosensitive member 21 using the above described photosensitive member 2 as an image bearing member is rotary-operated at a peripheral velocity (process speed) of 198 mm/sec in the direction of an arrow X.

A charging roller 22 being the above described charging member as a contact charging member was installed by being brought into press contact with the photosensitive member 21 against elasticity at a predetermined pressing force n is a contacting portion between the photosensitive member 21 and the charging roller 22. In the present example, the charging roller 22 is rotary-operated at 100% in the opposite direction (in the direction of an arrow Y) in the contact portion n being a contact surface between the charging roller 22 and the photosensitive member 21. That is, the surface of the charging roller 22 as a contact charging member is caused to have velocity difference against the surface of the photosensitive member 21. In addition, on the surface of the charging roller 22, the above described conductive fine powder 1 was applied evenly with an application quantity of approximately $1\times10^4$ units/mm$^2$.

Onto the metal core 22*a* of the charging roller 22, a direct current voltage of −700V was arranged to be applied from a charging bias applying power supply as charging bias. In the present example, the surface of the photosensitive member 21 evenly receives charging processing at a potential (−680 V) approximately equal to the applied voltage toward the charging roller 22 in a direct injection charging system. This will be described later.

The reference numeral 23 denotes a laser beam scanner (exposing device) comprising a laser diode polygon mirror, etc. This laser beam scanner outputs a laser light which undergoes intensity modulation corresponding to chronological electric digital pixel signals on the target image information, and with the laser light, the evenly charged surface of the above described photosensitive member 21 undergoes scanning exposure L. This scanning exposure L causes an electrostatic latent image corresponding to the target image information to be formed on the surface of the rotary photosensitive member 21.

The reference numeral 24 denotes a developing device. The electrostatic latent image on the surface of the photosensitive member 21 is developed as a toner image with this developing device. In the developing apparatus 24 of the present example, as the magnetic toner, it is a non-contact type reversal developing apparatus that utilizes the magnetic toner 1 used in the example 1 as a magnetic toner. To the magnetic toner 1, the conductive fine powder 1 is added externally.

The gap between the photosensitive drum 21 and the developing sleeve 24*a* was arranged to be 230 μm, and a blade made of urethane of thickness 1.0 mm and free length 0.5 mm as a toner controlling member 24*c* was brought into contact at a line pressure of 39.2 N/m (40 g/cm) with an aluminum cylinder of diameter 16 mm which used a developing sleeve having a resin layer (layer thickness of approximately 7 μm) of JIS center line average roughness (Ra) of 1.0 μm configured as described below to be formed on the surface thereof and contains a magnetic roll of developing magnetic pole of 85 mT (850 Gauss) inside it as the magnetic toner carrying member 24*a*.

| | |
|---|---|
| Phenol resin | 100 parts |
| Graphite (particle diameter of approximately 7 βm) | 90 parts |
| Carbon black | 10 parts |

In addition, in the forward direction (in the direction of an arrow W) along the rotary direction of the photosensitive member 21 is caused to rotate at 120% of the periphery velocity of the photosensitive member 21 with the developing portion a (the developing region portion) being the opposite portion against the photosensitive member 21. The magnetic toner of a thin layer is coated onto this developing sleeve 24*a* with the elastic blade 24*c*. The magnetic toner has its layer thickness toward the developing sleeve 24*a* controlled by the elastic blade 24*c*, and electrons are given. At this time, the quantity of the magnetic toner brought into coating onto the developing sleeve 24*a* was 15 g/m$^2$.

The magnetic toner brought into coating onto the developing sleeve 24*a* is conveyed to the developing portion a, an opposite portion against the photosensitive member 21 and the sleeve 24*a* with rotation of the sleeve 24*a*. In addition, to the developing sleeve 24*a*, a developing bias voltage is applied by the developing bias applying power supply. The developing bias voltage in which a direct current voltage of −450 V and an alternate electric field of a frequency 1800 Hz and $5.22\times10^6$ V/m were overlapped was used and the interval a between the developing sleeve 24*a* and the photosensitive member 21 was brought into jumping phenomena.

The transfer roller 25 with a medium resistant as contact transferring means is brought into pressure contact at a line pressure of 98 N/m (100 g/cm) with the photosensitive member so that the transfer nip b is formed. To this transfer nip portion b, a transferring material P as a recording medium is sheet-fed from a not-shown sheet feeding portion, and in addition, to the transfer roller 25 a predetermined transfer bias voltage is applied from a transfer bias application power supply so that toner images in this side of the photosensitive member 21 are sequentially transferred onto the surface of the sheet-fed transferring material P.

In the present example, as for the roller resistant value, the one with $5\times10^8$ Ωcm was used and a direct current voltage of +3,000 V was applied to implement transferring. That is, the transferring material P introduced into the transfer nip portion b sandwiches this transfer nip portion b and is conveyed, while the toner images formed and born on the surface of the photosensitive member 21 will sequentially be transferred onto the front surface side thereof with an electrostatic force and the pressing force.

A reference numeral 26 denotes a fixing device such as a thermal fixing system, etc. The transferring material P that is sheet-fed to the transfer nip portion b and undergoes transfer of the toner images at the side of the photosensitive member 21 is separated from the surface of the photosensitive member 1, introduced into this fixing apparatus 26, subjected to fixing of the toner images, and discharged outside the apparatus as an image forming substance (a print or a copy).

The printer of the present example was deprived of a cleaning unit so that the transferring residual toner remaining on the surface of the photosensitive member 21 after transfer of toner images toward the transferring material P is not removed with the cleaner but reaches the developing portion a via the charging portion n corresponding to rotation of the photosensitive member 21, and in the developing apparatus 24, the developing-cleaning step in which developing and recovery of toner is implemented is executed.

The reference numeral 27 denotes an image forming apparatus detachably attached to the main body of the printer and the process cartridge. The printer of the present example is configured as an image forming apparatus detachably attached to the main body of the printer and a process cartridge collectively inclusive of three process apparatuses of the photosensitive member 21, the charging roller 22 and the developing device 24. Combination, etc. of the image forming apparatus and process equipments changed into a process cartridge will not be limited to those described above but be optional.

The reference numeral 28 denotes a detachment-attachment guide and holding member of the process cartridge.

(2) On behavior of conductive fine powder in the present example

As for the conductive fine powder added to the magnetic toner in the developing device 24, an appropriate quantity thereof moves to the side of the photosensitive member 21 together with the toner at the time of the toner developing on the electrostatic latent image at the side of the photosensitive member 21 by the developing device 24.

The toner image on the photosensitive member 21 is drawn to the side of the transfer member P being a recording medium due to influence of the transfer bias in the transferring portion b and is actively transferred, but the conductive fine powder on the photosensitive member 21 is not actively transferred to the side of the transfer member P due to its conductivity, and is practically attached and held on the photosensitive member 21 and remains.

In the present example, since the image forming apparatus does not have a cleaning step, the transferring residue toner remaining on the surface of the photosensitive member 21 after transfer as well as the above described residue conductive fine powder is carried as is to the charged portion n being a contact portion between the photosensitive member 21 and the charging roller 22 being a contacting charging member by way of movement of the surface of the photosensitive member 21, and is attached to or mixed into the charging roller 22. Accordingly, under a state that this conductive fine powder exists in the contact portion n between the photosensitive member 21 and the charging roller 22, injecting charging directly into the photosensitive member 21 is implemented.

Existence of this conductive fine powder enables minute contact performance and contact resistant toward the photosensitive member 21 of the charging roller 22 to be maintained even in the case where the toner is attached to and mixed into the charging roller 22, and therefore direct injecting charging of the photosensitive member 21 by the charging roller 22 can be implemented.

The charging roller 22 is brought into tight contact with the photosensitive member 21 via the conductive fine powder, and the conductive fine powder existing on the mutual contact surfaces of the charging roller 22 and the photosensitive member 21 is brought into friction-sliding without any space on the surface of the photosensitive member 21 so that the charging of the photosensitive member 21 by the charging roller 22 implement discharging phenomena due to existence of the conductive fine powder and stable and safe direct injecting charging becomes dominant, thus high charging efficiency that was not obtainable with the prior art roller charging, etc., and a potential approximately equivalent to a voltage applied to the charging roller 22 can be given to the photosensitive member 21.

In addition, the transfer residue toner that is attached to or mixed into the charging roller 22 is gradually spewed out onto the photosensitive member 21 from the charging roller 22 so as to reach the developing portion corresponding to movement of the surface of the photosensitive member 21 and the developing-cleaning (recovery) step is executed in the developing means.

The developing-cleaning step is to recover the toner remained on the photosensitive member 21 after transfer with a fog-removing bias of the developing apparatus, that is, fog-removing potential balance Vback being a potential balance between the direct current voltage applied to the developing device and the surface potential of the photosensitive member at the time of subsequent development in the image forming step, that is, at the time when subsequently the photosensitive member gets charged, exposed to form an latent image and the latent image is developed. In the case of reversal developing as with a printer in the present example, this developing-cleaning step is implemented by function of the electric field recovering the toner into the developing sleeve from the dark portion potential of the photosensitive member by the developing bias and of the electric field causing the toner to be attached to the light portion potential of the photosensitive member from the developing sleeve.

In addition, operation of the image forming apparatus shifts the conductive fine powder which is mixed into the magnetic toner of the developing device 24 to the surface of the photosensitive member 21 in the developing portion a and is carried to the charged portion n via the transferring portion b by the movement of the image bearing surface so that fresh conductive fine powder is continuously supplied to the charged portion n one by one, and therefore, even in the case of decrease in the conductive fine powder in the charged portion n due to dropping, etc., and deterioration, etc. of the powder, drop in charging performance is prevent from occurrence and good charging performance is maintained in a stable fashion.

Using a simple charging roller 22 as a contact charging member in the image forming apparatus in the contact charging system, the transferring system, and the toner recycling process, and in spite of contamination with the transferring residual toner of the charging roller 22, an ozone-less direct injecting charging at a low applied voltage can be stably maintained over a long period, an even charging performance can be given, and an image forming apparatus that lacks obstacles due to ozone compounds, or obstacles due to bad charging, etc., but has simple configuration and costs lowly can be obtained.

In addition, as described above, in order that the conductive fine powder does not spoil charging performance, the electric resistant value needs to be not more than $1\times10^9$ Ωcm. Therefore, in the case where a contact developing device in which the magnetic toner directly contacts the photosensitive member 21 in the developing portion a is used, electrons are injected into the photosensitive member 21 with the developing bias through the conductive fine powder in the developing agent and image fog will occur.

However, in the present example, the developing device is a not-contact type developing device, and thus the developing bias will not be injected into the photosensitive member 21, making good images obtainable. In addition, in the developing portion a, electron injection into the photosensitive member 21 does not take place so that high potential balance such as AC bias, etc. can be provided between the developing sleeve 24*a* and the photosensitive member 21, the conductive fine powder can be developed evenly, even application of conductive fine powder onto the surface of the photosensitive member 21 and even contact in the charged portion can give good charging performance and it become possible to obtain good images.

The conductive fine powder is intervened into the contact surface n between the charging roller 22 and the photosensitive member 21 so that lubrication effects (friction reduction effects) of the conductive fine powder enable provision of velocity difference easily and effectively between the charging roller 22 and the photosensitive member 21.

Provision of velocity difference between the charging roller 22 and the photosensitive member 21 remarkably increase opportunities that makes the conductive fine powder contact the photosensitive member 21 in the mutual contact surface portion n of the charging roller 22 and the photosensitive member 21 so as to make high contact performance attainable and good direct injecting charging possible.

In the present example, the charging roller 22 is configured to be rotary-driven and rotate in the direction opposite against the moving direction of the surface of the photosensitive member 21 as for its rotating direction so that an effect that the transferring residual toner on the photosensitive member 21 carried into the charging portion n is temporally recovered into the charging roller 22 and is averaged is obtained. That is, the transferring residual toner on the photosensitive member 21 is once separated with rotation in the reverse direction to implement charging so that direct injecting charging can be implemented in an advantageous fashion.

Moreover, intervention of an appropriate quantity of conductive fine powder in the contact portion n between the photosensitive drum 21 as an image bearing member and the charging roller 22 as the contact charging member reduces friction between the charging roller 22 and the photosensitive drum 21 by lubricating effects with the conductive fine powder, and makes it easy to rotary-drive the charging roller 22 with a velocity difference against the photosensitive drum 21. That is, the driving torque is reduced and scraping or cracks on the surface of the charging roller 22 or the photosensitive drum 21 can be prevented. Moreover, increase in contact opportunities by the particle makes sufficient charging performance attainable. In addition, imaging due to lack of the conductive fine powder from the charging roller 22 will not be affected badly.

(3) Assessment

In the present example, the magnetic toner 1 of 400 g was filled in the interior of the toner cartridge in an environment of low temperature and low humidity (15° C. and 10% RH), an environment of ordinary temperature and ordinary humidity (23° C. and 60% RH) and an environment of high temperature and high humidity (30° C. and 80% RH) so that image reproduction tests were implemented. As the photosensitive member, the above described photosensitive member 2 with the volume resistant of the uppermost surface layer being $5\times10^{12}$ Ωcm was used, and as the transferring material, paper of 75 g/m$^2$ was used. In the image features during the initial step, no fogs due to poor charging appeared, and good image density with high resolving performance was obtained. At this time, the photosensitive member potential after direct injecting charging was −680 V toward the applied charged bias of −700 V. Next, running performance was assessed with an image pattern consisting only of vertical lines at a printing rate of 4%. As a result, no image defects occurred due to poor charging after 6,000 sheets were printed, and good direct injecting charging performance was obtained.

In addition, after 6,000 sheets were printed, the photosensitive member potential after direct injecting charging was −660 V toward the applied charging bias of −700 V with drop in charging performance from the initial step was slight with 20 V, and no deterioration in image quality due to drop in charging performance was confirmed. Obtained results are shown in Tables 14 to 16.

Assessment items and assessment standards are similar to those in Example 1. In addition, the existing quantity of the conductive fine powder in the contact portion between the image bearing member and the contact charging member was measured by the above described method.

Example 34

Except that magnetic toner 2 was used in replace of the magnetic toner 1 used in Example 33, image reproduction tests were implemented as those in Example 33. The assessment results are shown in Tables 14 to 16.

With the magnetic toner of the present invention, an image that has good fixing performance, is excellent in environmental stability and charging stability, shows high image density also during a long term use, and is highly accurate is obtainable.

Moreover, also in the image forming method consisting of the contact charging method using the magnetic toner of the present invention and the magnetism-one-component developing method, as well as in the image forming method using the contact charging system, contact transferring system and tone recycle process, there occurs no deterioration in toner's performance and good images can be obtained for a long period in a stable fashion also for repetitious use.

TABLE 1

| | Treating agent | Amount (pbw) | Hydrophobicity (%) |
|---|---|---|---|
| Surface-treated magnetic material 1 | n-$C_{10}H_{21}Si(OCH_3)_3$ | 2 | 85 |
| Surface-treated magnetic material 3 | n-$C_4H_{13}Si(OCH_3)_3$ | 2 | 78 |
| Surface-treated magnetic material 4 | n-$C_{10}H_{21}Si(OCH_3)_3$ | 1.7 | 75 |
| Surface-treated magnetic material 5 | n-$C_{10}H_{21}Si(OCH_3)_3$ | 1.5 | 69 |
| Surface-treated magnetic material 6 | n-$C_{10}H_{21}Si(OCH_3)_3$ | 1.3 | 62 |
| Surface-treated magnetic material 7 | n-$C_{10}H_{21}Si(OCH_3)_3$ | 1.0 | 55 |

TABLE 1-continued

| | Treating agent | Amount (pbw) | Hydrophobicity (%) |
|---|---|---|---|
| Surface-treated magnetic material 8 | n-$C_{10}H_{21}Si(OCH_3)_3$ | 0.7 | 42 |
| Surface-treated magnetic material 9 | n-$C_{10}H_{21}Si(OCH_3)_3$ | 2.0 | 78 |
| Surface-treated magnetic material 10 | n-$C_{10}H_{21}Si(OCH_3)_3$ | 1.0 | 86 |
| Surface-treated magnetic material 11 | n-$C_{10}H_{21}Si(OCH_3)_3$ | 0.8 | 82 |
| Surface-treated magnetic material 12 | n-$C_{10}H_{21}Si(OCH_3)_3$ | 0.7 | 21 |
| Surface-treated magnetic material 13 | α-methacryloxy-trimethoxysilane | 5.0 | 34 |
| Surface-treated magnetic material 14 | n-$C_{10}H_{21}Si(OCH_3)_3$ | 0.7 | 24 |
| Magnetic material A | none | — | 0 |

TABLE 2

| Magnetic toner | Magnetic material used (pbw) | | Release agent (pbw) | | Toner average particle diam. (DM) (μm) | D4/D1 | Average circularity | Mode circularity | (A) (μm) | (B) | (C) | (D) (%) | (E) (%) | (F) (%) | GPC main peak molecular weight |
|---|---|---|---|---|---|---|---|---|---|---|---|---|---|---|---|
| 1 | ST1 | 90 | ES | 10 | 7.3 | 1.22 | 0.981 | 1.00 | 0.19 | 10 | 0.24 | 0.62 | 29.4 | 24 | 22,000 |
| 2 | ST1 | 90 | " | 10 | 7.3 | 1.22 | 0.981 | 1.00 | 0.19 | 10 | 0.25 | 0.64 | 35.8 | 24 | 22,000 |
| 3 | ST1 | 90 | " | 10 | 7.3 | 1.22 | 0.981 | 1.00 | 0.19 | 10 | 0.24 | 0.63 | — | 24 | 22,000 |
| 5 | ST3 | 90 | " | 10 | 7.6 | 1.20 | 0.982 | 1.00 | 0.19 | 10 | 0.16 | 0.64 | — | 26 | 20,000 |
| 6 | ST4 | 90 | " | 10 | 7.2 | 1.27 | 0.981 | 1.00 | 0.19 | 10 | 0.75 | 0.62 | — | 23 | 22,000 |
| 7 | ST5 | 90 | " | 10 | 7.0 | 1.31 | 0.980 | 1.00 | 0.19 | 10 | 1.14 | 0.64 | — | 26 | 20,000 |
| 8 | ST6 | 90 | " | 10 | 6.9 | 1.34 | 0.978 | 1.00 | 0.19 | 10 | 1.48 | 0.63 | — | 22 | 23,000 |
| 9 | ST7 | 90 | " | 10 | 6.8 | 1.36 | 0.975 | 1.00 | 0.19 | 10 | 1.92 | 0.66 | — | 23 | 22,000 |
| 10 | ST8 | 90 | " | 10 | 6.4 | 1.39 | 0.971 | 1.00 | 0.19 | 10 | 2.73 | 0.64 | — | 25 | 21,000 |
| 11 | ST9 | 90 | ES | 10 | 6.8 | 1.32 | 0.976 | 1.00 | 0.14 | 37 | 1.36 | 0.63 | — | 15 | 17,000 |
| 12 | ST10 | 90 | " | 10 | 7.2 | 1.25 | 0.979 | 1.00 | 0.35 | 16 | 0.48 | 0.63 | — | 26 | 26,000 |
| 13 | ST10 | 90 | " | 11 | 6.8 | 1.25 | 0.985 | 1.00 | 0.35 | 16 | 0.41 | 0.59 | — | 26 | 25,000 |
| 14 | ST10 | 100 | " | 10 | 7.0 | 1.26 | 0.980 | 1.00 | 0.35 | 16 | 0.59 | 0.61 | — | 27 | 26,000 |
| 15 | ST11 | 90 | " | 10 | 7.5 | 1.30 | 0.975 | 1.00 | 0.45 | 23 | 0.68 | 0.62 | — | 28 | 27,000 |
| 16 | UT1 | 98 | " | 10 | 7.8 | 1.38 | 0.970 | 1.00 | 0.19 | 10 | 1.69 | 0.62 | — | 30 | 30,000 |
| 17 | UT1 | 98 | " | 10 | 7.8 | 1.38 | 0.970 | 1.00 | 0.19 | 10 | 0.02 | 0.65 | — | 30 | 30,000 |
| 18 | ST12 | 90 | " | 10 | 6.4 | 1.48 | 0.968 | 0.98 | 0.19 | 10 | 3.89 | 0.64 | — | 22 | 23,000 |
| 19 | ST13 | 90 | " | 10 | 6.5 | 1.40 | 0.970 | 1.00 | 0.45 | 23 | 3.12 | 0.66 | — | 30 | 24,000 |
| 20 | ST14 | 90 | " | 10 | 6.5 | 1.47 | 0.970 | 0.99 | 0.19 | 10 | 3.68 | 0.66 | — | 23 | 22,000 |
| 21 | ST1 | 90 | " | 10 | 8.4 | 1.26 | 0.951 | 0.96 | 0.19 | 10 | 1.86 | 0.78 | — | 28 | 19,000 |

ST: Surface-treated magnetic material
UT: (Untreated) magnetic material
ES: Ester wax
(A): Average particle diameter of magnetic material
(B): Volume-average variation coefficient of magnetic material
(C): Liberation percentage of iron compound
(D): Liberation percentage of silica
(E): Liberation percentage of conductive fine powder
(F): THF-insoluble matter

TABLE 3

| Magnetic toner | Magnetic material used (pbw) | | Release agent (pbw) | | Toner average particle diam. (DM) (μm) | D4/D1 | Average circularity | Mode circularity | (A) (μm) | (B) | (C) | (D) (%) | (E) (%) | (F) (%) | GPC main peak molecular weight |
|---|---|---|---|---|---|---|---|---|---|---|---|---|---|---|---|
| 22 | ST1 | 90 | ES | 10 | 7.3 | 1.22 | 0.981 | 1.00 | 0.19 | 10 | 0.24 | 0.68 | — | 24 | 22,000 |
| 23 | ST1 | 90 | " | 10 | 7.3 | 1.22 | 0.981 | 1.00 | 0.19 | 10 | 0.25 | 1.21 | — | 24 | 22,000 |
| 24 | ST1 | 90 | " | 10 | 7.3 | 1.22 | 0.981 | 1.00 | 0.19 | 10 | 0.24 | 1.62 | — | 24 | 22,000 |
| 25 | ST1 | 90 | " | 10 | 7.3 | 1.22 | 0.981 | 1.00 | 0.19 | 10 | 0.24 | 1.56 | 38.5 | 24 | 22,000 |

TABLE 3-continued

| Magnetic toner | Magnetic material used (pbw) | Release agent (pbw) | Toner average particle diam. (DM) (μm) | D4/D1 | Average circularity | Mode circularity | (A) (μm) | (B) | (C) | (D) (%) | (E) (%) | (F) (%) | GPC main peak molecular weight |
|---|---|---|---|---|---|---|---|---|---|---|---|---|---|
| 26 | ST1 90 | " 10 | 7.3 | 1.22 | 0.981 | 1.00 | 0.19 | 10 | 0.24 | 2.18 | 53.6 | 24 | 22,000 |
| 27 | ST1 90 | " 10 | 7.3 | 1.22 | 0.981 | 1.00 | 0.19 | 10 | 0.23 | 0.06 | 4.2 | 24 | 22,000 |
| 28 | ST1 40 | " 10 | 7.8 | 1.17 | 0.988 | 1.00 | 0.19 | 10 | 0.10 | 0.99 | — | 29 | 27,000 |
| 29 | ST1 160 | " 10 | 6.4 | 1.38 | 0.972 | 1.00 | 0.19 | 10 | 0.93 | 0.96 | — | 16 | 18,000 |

ST: Surface-treated magnetic material
UT: (Untreated) magnetic material
ES: Ester wax
(A): Average particle diameter of magnetic material
(B): Volume-average variation coefficient of magnetic material
(C): Liberation percentage of iron compound
(D): Liberation percentage of silica
(E): Liberation percentage of conductive fine powder
(F): THF-insoluble matter

TABLE 4

| Magnetic toner | Magnetic material used (pbw) | Release agent (pbw) | Toner average particle diam. (D4) (μm) | D4/D1 | Average circularity | Modal circularity | (A) (μm) | (B) | (C) | (D) (%) | (E) (%) | GPC main peak molecular weight |
|---|---|---|---|---|---|---|---|---|---|---|---|---|
| 30 | ST1 90 | ES 0.8 | 7.1 | 1.19 | 0.987 | 1.00 | 0.19 | 10 | 0.24 | 0.68 | 21 | 22,000 |
| 31 | ST1 90 | " 35 | 8.4 | 1.36 | 0.972 | 1.00 | 0.19 | 10 | 0.25 | 0.70 | 19 | 22,000 |
| 32 | ST1 90 | PE 4 | 7.7 | 1.33 | 0.977 | 1.00 | 0.19 | 10 | 0.24 | 0.66 | 23 | 22,000 |
| 33 | ST1 90 | " 10 | 8.3 | 1.37 | 0.974 | 1.00 | 0.19 | 10 | 0.27 | 0.65 | 22 | 22,000 |
| 34 | ST1 90 | ES 10 | 7.2 | 1.22 | 0.981 | 1.00 | 0.19 | 10 | 0.26 | 0.68 | 4 | 32,000 |
| 35 | ST1 90 | " 10 | 7.3 | 1.22 | 0.980 | 1.00 | 0.19 | 10 | 0.25 | 0.67 | 11 | 29,000 |
| 36 | ST1 90 | " 10 | 7.4 | 1.21 | 0.981 | 1.00 | 0.19 | 10 | 0.24 | 0.62 | 46 | 18,000 |
| 37 | ST1 90 | " 10 | 7.1 | 1.23 | 0.981 | 1.00 | 0.19 | 10 | 0.25 | 0.64 | 58 | 15,000 |
| 38 | ST1 90 | " 10 | 7.3 | 1.22 | 0.982 | 1.00 | 0.19 | 10 | 0.26 | 0.68 | 75 | 12,000 |
| 39 | ST1 90 | " 10 | 7.5 | 1.20 | 0.982 | 1.00 | 0.19 | 10 | 0.23 | 0.65 | 1 | 36,000 |

ST: Surface-treated magnetic material
UT: (Untreated) magnetic material
ES: Ester wax
PE: Polyethylene wax
(A): Average particle diameter of magnetic material
(B): Volume-average variation coefficient of magnetic material
(C): Liberation percentage of iron compound
(D): Liberation percentage of silica
(E): THF-insoluble matter

TABLE 5

Evaluation Results in Ordinary-Temperature/Ordinary-Humidity Test

| | Magnetic toner used | Initial stage: Image density | Fog | Transfer eff. (%) | Image quality | After running test: Image density | Fog | Transfer eff. (%) | Image quality | Fixing perfor-mance | Anti-offset properties |
|---|---|---|---|---|---|---|---|---|---|---|---|
| Example: | | | | | | | | | | | |
| 1 | 1 | 1.46 | A | A | A | 1.46 | A | A | A | A | A |
| 2 | 2 | 1.45 | A | A | A | 1.45 | A | A | A | A | A |
| 3 | 3 | 1.43 | A | A | A | 1.43 | A | A | A | A | A |
| 5 | 5 | 1.43 | A | A | A | 1.42 | A | A | A | A | A |
| 6 | 6 | 1.41 | A | A | A | 1.41 | A | A | A | A | A |
| 7 | 7 | 1.41 | A | A | A | 1.40 | A | A | A | A | A |
| 8 | 8 | 1.38 | A | A | A | 1.36 | A | A | A | A | A |
| 9 | 9 | 1.36 | A | A | A | 1.35 | B | A | A | A | A |
| 10 | 10 | 1.34 | B | A | A | 1.34 | B | A | B | B | A |
| 11 | 11 | 1.37 | A | A | A | 1.36 | A | A | A | A | A |
| 12 | 12 | 1.36 | A | A | A | 1.35 | A | A | A | A | A |
| 13 | 13 | 1.35 | A | A | A | 1.34 | A | A | A | A | A |

TABLE 5-continued

| | | Evaluation Results in Ordinary-Temperature/Ordinary-Humidity Test | | | | | | | | | |
|---|---|---|---|---|---|---|---|---|---|---|---|
| | | Initial stage | | | | After running test | | | | | |
| | Magnetic toner used | Image density | Fog | Transfer eff. (%) | Image quality | Image density | Fog | Transfer eff. (%) | Image quality | Fixing perfor-mance | Anti-offset properties |
| 14 | 14 | 1.37 | A | A | A | 1.35 | A | A | A | A | A |
| 15 | 15 | 1.34 | A | A | A | 1.31 | A | A | A | A | A |
| 16 | 16 | 1.34 | B | A | A | 1.31 | B | B | B | B | A |
| Comparative Example: | | | | | | | | | | | |
| 1 | 17 | 1.41 | A | A | A | 1.30 | B | C | B | A | A |
| 2 | 18 | 1.31 | C | B | B | 1.27 | C | C | B | B | A |
| 3 | 19 | 1.32 | C | B | B | 1.28 | C | B | B | B | A |
| 4 | 20 | 1.33 | C | B | B | 1.30 | C | C | B | B | A |
| 5 | 21 | 1.41 | B | C | B | 1.40 | B | C | B | B | A |

TABLE 6

| | | Evaluation Results in Low-Temperature/Low-Humidity Test | | | | | | | | | |
|---|---|---|---|---|---|---|---|---|---|---|---|
| | | Initial stage | | | | After running test | | | | | |
| | Magnetic toner used | Image density | Fog | Transfer eff. (%) | Image quality | Image density | Fog | Transfer eff. (%) | Image quality | Fixing perfor-mance | Anti-offset properties |
| Example: | | | | | | | | | | | |
| 1 | 1 | 1.46 | A | A | A | 1.46 | A | A | A | A | A |
| 2 | 2 | 1.45 | A | A | A | 1.45 | A | A | A | A | A |
| 3 | 3 | 1.42 | A | A | A | 1.41 | A | A | A | A | A |
| 5 | 5 | 1.43 | A | A | A | 1.42 | A | A | A | A | A |
| 6 | 6 | 1.41 | A | A | A | 1.40 | B | A | A | A | A |
| 7 | 7 | 1.40 | B | A | A | 1.39 | B | B | A | A | A |
| 8 | 8 | 1.38 | B | A | B | 1.36 | B | B | B | A | A |
| 9 | 9 | 1.36 | B | B | B | 1.34 | C | B | B | A | A |
| 10 | 10 | 1.33 | C | B | B | 1.30 | C | B | C | B | A |
| 11 | 11 | 1.37 | B | A | B | 1.35 | B | B | B | A | A |
| 12 | 12 | 1.35 | A | A | A | 1.34 | B | A | A | A | A |
| 13 | 13 | 1.35 | A | A | A | 1.33 | B | A | A | A | A |
| 14 | 14 | 1.37 | A | A | A | 1.35 | B | A | A | A | A |
| 15 | 15 | 1.32 | B | A | A | 1.30 | B | A | A | A | A |
| 16 | 16 | 1.31 | C | B | B | 1.24 | C | C | C | B | A |
| Comparative Example: | | | | | | | | | | | |
| 1 | 17 | 1.40 | A | B | A | 1.09 | C | D | D | A | A |
| 2 | 18 | 1.25 | D | C | C | 1.19 | D | D | C | B | A |
| 3 | 19 | 1.27 | D | C | C | 1.23 | D | C | C | B | A |
| 4 | 20 | 1.26 | D | C | C | 1.20 | D | D | C | B | A |
| 5 | 21 | 1.38 | B | D | B | 1.36 | C | D | B | B | A |

TABLE 7

| | | Evaluation Results in High-Temperature/High-Humidity Test | | | | | | | |
|---|---|---|---|---|---|---|---|---|---|
| | | Initial stage | | | | After running test | | | |
| | Magnetic toner used | Image density | Fog | Transfer efficiency (%) | Image quality | Image density | Fog | Transfer efficiency (%) | Image quality |
| Example: | | | | | | | | | |
| 1 | 1 | 1.47 | A | A | A | 1.46 | A | A | A |
| 2 | 2 | 1.46 | A | A | A | 1.44 | A | A | A |
| 3 | 3 | 1.43 | A | A | A | 1.42 | A | A | A |
| 4 | 4 | 1.42 | A | A | A | 1.40 | A | A | A |
| 5 | 5 | 1.43 | A | A | A | 1.42 | A | A | A |

TABLE 7-continued

| | | Evaluation Results in High-Temperature/High-Humidity Test | | | | | | | |
|---|---|---|---|---|---|---|---|---|---|
| | | Initial stage | | | | After running test | | | |
| | Magnetic toner used | Image density | Fog | Transfer efficiency (%) | Image quality | Image density | Fog | Transfer efficiency (%) | Image quality |
| 6 | 6 | 1.41 | A | A | A | 1.40 | A | B | A |
| 7 | 7 | 1.41 | A | B | A | 1.39 | B | B | A |
| 8 | 8 | 1.39 | A | B | B | 1.37 | B | B | B |
| 9 | 9 | 1.36 | B | B | B | 1.33 | B | C | C |
| 10 | 10 | 1.34 | B | C | B | 1.30 | B | C | C |
| 11 | 11 | 1.36 | A | B | B | 1.33 | B | B | B |
| 12 | 12 | 1.35 | A | B | A | 1.32 | A | B | B |
| 13 | 13 | 1.35 | A | B | A | 1.33 | A | B | B |
| 14 | 14 | 1.37 | A | B | A | 1.34 | A | B | B |
| 15 | 15 | 1.33 | A | B | A | 1.30 | A | B | B |
| 16 | 16 | 1.32 | C | C | B | 1.28 | C | C | C |
| Comparative Example: | | | | | | | | | |
| 1 | 17 | 1.39 | A | B | A | 1.29 | B | C | C |
| 2 | 18 | 1.25 | D | D | C | 1.19 | D | D | D |
| 3 | 19 | 1.27 | C | D | C | 1.23 | C | D | D |
| 4 | 20 | 1.26 | D | D | C | 1.19 | D | D | D |
| 5 | 21 | 1.39 | B | D | B | 1.34 | B | D | C |

TABLE 8

| | | Evaluation Results in Ordinary-Temperature/Ordinary-Humidity Test | | | | | | | | | |
|---|---|---|---|---|---|---|---|---|---|---|---|
| | | Initial stage | | | | After running test | | | | | |
| | Magnetic toner used | Image density | Fog | Transfer eff. (%) | Image quality | Image density | Fog | Transfer eff. (%) | Image quality | Fixing perfor-mance | Anti-offset properties |
| Example: | | | | | | | | | | | |
| 17 | 1.40 | A | A | A | A | 1.39 | A | A | A | A | A |
| 18 | 1.41 | A | A | A | A | 1.40 | A | A | A | B | B |
| 19 | 1.39 | A | A | A | A | 1.39 | A | A | A | C | C |
| 20 | 1.40 | A | A | A | A | 1.38 | A | A | A | A | A |
| 21 | 1.41 | A | A | B | A | 1.40 | B | B | A | A | A |
| 22 | 1.40 | A | A | A | A | 1.39 | A | A | A | B | A |
| 23 | 1.23 | A | B | A | A | 1.23 | B | A | A | A | A |
| 24 | 1.52 | A | A | A | A | 1.51 | A | A | B | C | A |

TABLE 9

| | | Evaluation Results in Low-Temperature/Low-Humidity Test | | | | | | | | | |
|---|---|---|---|---|---|---|---|---|---|---|---|
| | | Initial stage | | | | After running test | | | | | |
| | Magnetic toner used | Image density | Fog | Transfer eff. (%) | Image quality | Image density | Fog | Transfer eff. (%) | Image quality | Fixing perfor-mance | Anti-offset properties |
| Example: | | | | | | | | | | | |
| 17 | 22 | 1.39 | A | A | A | 1.38 | A | A | A | A | A |
| 18 | 23 | 1.40 | A | A | A | 1.38 | A | A | B | B | B |
| 19 | 24 | 1.37 | B | A | B | 1.35 | B | B | B | C | C |
| 20 | 25 | 1.41 | B | A | B | 1.37 | B | B | B | A | A |
| 21 | 26 | 1.40 | B | B | B | 1.36 | C | B | B | A | A |
| 22 | 27 | 1.40 | A | A | A | 1.37 | B | B | B | B | A |
| 23 | 28 | 1.21 | B | A | A | 1.20 | B | A | A | A | A |
| 24 | 29 | 1.51 | A | A | B | 1.48 | A | B | B | C | A |

TABLE 10

| | | Evaluation Results in High-Temperature/High-Humidity Test | | | | | | | |
|---|---|---|---|---|---|---|---|---|---|
| | | Initial stage | | | | After running test | | | |
| | Magnetic toner used | Image density | Fog | Transfer efficiency (%) | Image quality | Image density | Fog | Transfer efficiency (%) | Image quality |
| Example: | | | | | | | | | |
| 17 | 22 | 1.40 | A | A | A | 1.39 | A | A | A |
| 18 | 23 | 1.39 | A | A | A | 1.37 | A | A | B |
| 19 | 24 | 1.37 | A | B | B | 1.34 | B | B | B |
| 20 | 25 | 1.41 | A | B | B | 1.37 | B | B | B |
| 21 | 26 | 1.40 | B | B | B | 1.34 | B | C | C |
| 22 | 27 | 1.40 | A | A | A | 1.36 | B | B | B |
| 23 | 28 | 1.23 | B | A | A | 1.20 | B | B | A |
| 24 | 29 | 1.53 | A | B | B | 1.47 | A | B | B |

TABLE 11

| | | Evaluation Results in Ordinary-Temperature/Ordinary-Humidity Test | | | | | | | | | |
|---|---|---|---|---|---|---|---|---|---|---|---|
| | | Initial stage | | | | After running test | | | | | |
| | Magnetic toner used | Image density | Fog | Transfer eff. (%) | Image quality | Image density | Fog | Transfer eff. (%) | Image quality | Fixing perfor-mance | Anti-offset properties |
| Example: | | | | | | | | | | | |
| 25 | 30 | 1.42 | A | A | A | 1.41 | A | A | A | C | C |
| 26 | 31 | 1.38 | A | B | A | 1.37 | B | B | A | A | A |
| 27 | 32 | 1.40 | A | A | A | 1.38 | A | B | A | C | A |
| 28 | 33 | 1.35 | A | B | A | 1.34 | B | B | B | C | A |
| 29 | 34 | 1.41 | A | A | A | 1.39 | A | A | A | A | C |
| 30 | 35 | 1.42 | A | A | A | 1.40 | A | A | A | A | A |
| 31 | 36 | 1.42 | A | A | A | 1.41 | A | A | A | A | A |
| 32 | 37 | 1.41 | A | A | A | 1.39 | A | A | A | C | A |
| Comparative Example: | | | | | | | | | | | |
| 5 | 38 | 1.42 | A | A | A | 1.40 | A | A | A | D | A |
| 6 | 39 | 1.41 | A | A | A | 1.37 | A | A | A | A | D |

TABLE 12

| | | Evaluation Results in Low-Temperature/Low-Humidity Test | | | | | | | | | |
|---|---|---|---|---|---|---|---|---|---|---|---|
| | | Initial stage | | | | After running test | | | | | |
| | Magnetic toner used | Image density | Fog | Transfer eff. (%) | Image quality | Image density | Fog | Transfer eff. (%) | Image quality | Fixing perfor-mance | Anti-offset properties |
| Example: | | | | | | | | | | | |
| 25 | 30 | 1.41 | A | A | A | 1.40 | A | A | A | C | C |
| 26 | 31 | 1.35 | B | B | A | 1.32 | B | B | B | A | A |
| 27 | 32 | 1.37 | B | A | A | 1.35 | B | B | A | C | A |
| 28 | 33 | 1.33 | B | B | B | 1.31 | B | B | B | C | A |
| 29 | 34 | 1.39 | A | A | A | 1.37 | A | A | A | A | C |
| 30 | 35 | 1.40 | A | A | A | 1.39 | A | A | A | A | A |
| 31 | 36 | 1.41 | A | A | A | 1.40 | A | A | A | A | A |
| 32 | 37 | 1.40 | A | A | A | 1.40 | A | A | A | C | A |
| Comparative Example: | | | | | | | | | | | |
| 5 | 38 | 1.41 | A | A | A | 1.40 | A | A | A | D | A |
| 6 | 39 | 1.39 | A | A | A | 1.34 | B | A | B | A | D |

TABLE 13

Evaluation Results in High-Temperature/High-Humidity Test

| | Magnetic toner used | Initial stage: Image density | Initial stage: Fog | Initial stage: Transfer efficiency (%) | Initial stage: Image quality | After running test: Image density | After running test: Fog | After running test: Transfer efficiency (%) | After running test: Image quality |
|---|---|---|---|---|---|---|---|---|---|
| Example: | | | | | | | | | |
| 25 | 30 | 1.42 | A | A | A | 1.41 | A | A | A |
| 26 | 31 | 1.37 | B | B | A | 1.32 | B | B | B |
| 27 | 32 | 1.38 | B | B | A | 1.34 | B | B | B |
| 28 | 33 | 1.34 | B | B | B | 1.29 | B | B | C |
| 29 | 34 | 1.40 | A | A | A | 1.37 | B | B | B |
| 30 | 35 | 1.41 | A | A | A | 1.38 | A | A | A |
| 31 | 36 | 1.41 | A | A | A | 1.40 | A | A | A |
| 32 | 37 | 1.40 | A | A | A | 1.39 | A | A | A |
| Comparative Example: | | | | | | | | | |
| 5 | 38 | 1.41 | A | A | A | 1.40 | A | A | A |
| 6 | 39 | 1.39 | A | A | A | 1.24 | B | C | C |

TABLE 14

Evaluation Results in Ordinary-Temperature/Ordinary-Humidity Test

| | Magnetic toner | Initial stage: Image density | Initial stage: Fog | Initial stage: Transfer eff. (%) | Initial stage: Image quality | After 6,000 sh. running test: Image density | After 6,000 sh. running test: Fog | After 6,000 sh. running test: Transfer eff. (%) | After 6,000 sh. running test: Image quality | Conductive fine powder, amount of interposition (particles/mm$^2$) |
|---|---|---|---|---|---|---|---|---|---|---|
| Example: | | | | | | | | | | |
| 33 | 1 | 1.48 | A | A | A | 1.48 | A | A | A | $2 \times 10^5$ |
| 34 | 2 | 1.46 | A | A | A | 1.46 | A | A | A | $6 \times 10^4$ |

TABLE 15

Evaluation Results in Low-Temperature/Low-Humidity Test

| | Magnetic toner | Initial stage: Image density | Initial stage: Fog | Initial stage: Transfer eff. (%) | Initial stage: Image quality | After 6,000 sh. running test: Image density | After 6,000 sh. running test: Fog | After 6,000 sh. running test: Transfer eff. (%) | After 6,000 sh. running test: Image quality | Conductive fine powder, amount of interposition (particles/mm$^2$) |
|---|---|---|---|---|---|---|---|---|---|---|
| Example: | | | | | | | | | | |
| 33 | 1 | 1.46 | A | A | A | 1.46 | A | A | A | $2 \times 10^5$ |
| 34 | 2 | 1.44 | A | A | A | 1.43 | A | A | A | $5 \times 10^4$ |

TABLE 16

Evaluation Results in High-Temperature/High-Humidity Test

| | Magnetic toner | Initial stage: Image density | Initial stage: Fog | Initial stage: Transfer eff. (%) | Initial stage: Image quality | After 6,000 sh. running test: Image density | After 6,000 sh. running test: Fog | After 6,000 sh. running test: Transfer eff. (%) | After 6,000 sh. running test: Image quality | Conductive fine powder, amount of interposition (particles/mm$^2$) |
|---|---|---|---|---|---|---|---|---|---|---|
| Example: | | | | | | | | | | |
| 33 | 1 | 1.48 | A | A | A | 1.47 | A | A | A | $3 \times 10^5$ |
| 34 | 2 | 1.45 | A | A | A | 1.45 | A | A | A | $6 \times 10^4$ |

What is claimed is:

1. A magnetic toner comprising magnetic toner particles containing at least a binder resin, a magnetic material containing a magnetic iron oxide, and a release agent;

said magnetic toner having;

a weight-average particle diameter of from 3 μm to 10 μm;

a magnetization intensity (saturation magnetization) of from 10 $Am^2/kg$ to 50 $Am^2/kg$ (emu/g) under application of a magnetic field of 79.6 kA/m (1,000 oersteds);

an average circularity of 0.970 or more;

a ratio of weight-average particle diameter to number-average particle diameter, of 1.40 or less;

iron and an iron compound which stand liberated from the magnetic toner particles at a liberation percentage of from 0.05% to 3.00%; and a resin component having a tetrahydrofuran-insoluble matter in an amount of from 3% by weight to 60% by weight.

2. The magnetic toner according to claim 1, wherein the toner has a mode circularity of 0.99 or more.

3. The magnetic toner according to claim 1, wherein, in its particle size distribution, the ratio of weight-average particle diameter to number-average particle diameter is 1.35 or less.

4. The magnetic toner according to claim 1, wherein the liberation percentage of the iron and iron compound is from 0.05% to 2.00%.

5. The magnetic toner according to claim 1, wherein the liberation percentage of the iron and iron compound is from 0.05% to 1.50%.

6. The magnetic toner according to claim 1, wherein the liberation percentage of the iron and iron compound is from 0.05% to 1.20%.

7. The magnetic toner according to claim 1, wherein the liberation percentage of the iron and iron compound is from 0.05% to 0.80%.

8. The magnetic toner according to claim 1, wherein the liberation percentage of the iron and iron compound is from 0.05% to 0.60%.

9. The magnetic toner according to claim 1, wherein said release agent is contained in an amount of from 1% by weight to 30% by weight based on the weight of the binder resin.

10. The magnetic toner according to claim 1, wherein said release agent has an endothermic peak temperature of from 40° C. to 110° C. as measured by differential thermal analysis.

11. The magnetic toner according to claim 1, wherein said release agent has an endothermic peak temperature of from 45° C. to 90° C. as measured by differential thermal analysis.

12. The magnetic toner according to claim 1, wherein the resin component has a tetrahydrofuran-insoluble matter in an amount of from 5% by weight to 50% by weight.

13. The magnetic toner according to claim 1, wherein the resin component has a peak top of the main peak in the region of molecular weight of from 5,000 to 50,000 in its molecular weight distribution of the tetrahydrofuran-soluble matter as measured by gel permeation chromatography.

14. The magnetic toner according to claim 1, which has an inorganic fine powder at the surfaces of said magnetic toner particles, and the inorganic fine powder has a number-average primary particle diameter of from 4 nm to 80 nm.

15. The magnetic toner according to claim 14, wherein said inorganic fine powder is at least one inorganic fine powder selected from the group consisting of silica, titanium oxide and alumina, or a composite oxide thereof.

16. The magnetic toner according to claim 14, wherein said inorganic fine powder is silica.

17. The magnetic toner according to claim 14, wherein said inorganic fine powder has been hydrophobic-treated.

18. The magnetic toner according to claim 14, wherein said inorganic fine powder has been treated with at least a silicone oil.

19. The magnetic toner according to claim 14, wherein said inorganic fine powder has been treated with a silane compound and, simultaneously with or thereafter, treated with a silicone oil.

20. The magnetic toner according to claim 16, which has a liberation percentage of silica, of from 0.1% to 2.0%.

21. The magnetic toner according to claim 16, which has a liberation percentage of silica, of from 0.1% to 1.5%.

22. The magnetic toner according to claim 1, which has at the surfaces of said magnetic toner particles a conductive fine powder having a volume-average particle diameter which is smaller than the weight-average particle diameter of the magnetic toner.

23. The magnetic toner according to claim 22, wherein said conductive fine powder has a resistivity of $1\times10^9$ Ω·cm or below.

24. The magnetic toner according to claim 22, wherein said conductive fine powder has a resistivity of $1\times10^8$ Ω·cm or below.

25. The magnetic toner according to claim 22, wherein said conductive fine powder is a non-magnetic conductive fine powder.

26. The magnetic toner according to claim 22, wherein said conductive fine powder is at a liberation percentage of from 5.0% to 50.0%.

27. The magnetic toner according to claim 1, wherein said magnetic material has a volume-average particle diameter of form 0.05 μm to 0.40 μm.

28. The magnetic toner according to claim 1, wherein said magnetic material has, in its particle size distribution, a volume-average variation coefficient of 35 or less.

29. The magnetic toner according to claim 1, wherein said magnetic material has been surface hydrophobic-treated with a coupling agent.

30. The magnetic toner according to claim 1, wherein said magnetic material has been surface hydrophobic-treated with a coupling agent in an aqueous medium.

31. The magnetic toner according to claim 1, wherein said binder resin contains a styrene-acrylic copolymer and a polyester resin.

32. The magnetic toner according to claim 31, wherein said polyester resin is a saturated polyester resin.

33. The magnetic toner according to claim 31, wherein said polyester resin is an unsaturated polyester resin.

34. The magnetic toner according to claim 1, wherein said binder resin contains a cross-linked styrene-acrylic copolymer.

35. An image-forming method comprising;

a charging step of charging an image-bearing member electrostatically by applying a voltage to a charging member kept in contact with the image-bearing member, forming a contact zone between them;

an electrostatic latent image forming step of forming an electrostatic latent image on the charged surface of the image-bearing member;

a developing step of forming a toner image by developing the electrostatic latent image by causing a magnetic toner to move to the electrostatic latent image at a developing zone where an alternating electric field is kept formed; the developing zone being formed between the image-bearing member for holding thereon the electrostatic latent image and a toner-carrying member for carrying the magnetic toner on its surface which are face to face disposed leaving a preset space between them, and a layer of the magnetic toner being formed on the surface of the toner-carrying member in a thickness smaller than that space; and a transfer step of transferring the toner image to a transfer material via, or not via, an intermediate transfer member;

said steps being repeated to form images;

wherein said magnetic toner comprises magnetic toner particles containing at least a binder resin, a magnetic material containing a magnetic iron oxide, and a release agent; said magnetic toner having;

a weight-average particle diameter of from 3 $\mu$m to 10 $\mu$m;

a magnetization intensity (saturation magnetization) of from 10 $Am^2/kg$ to 50 $Am^2/kg$ (emulg) under application of a magnetic field of 79.6 kA/m (1,000 oersteds); an average circularity of 0.970 or more;

a ratio of weight-average particle diameter to number-average particle diameter, of 1.40 or less;

iron and an iron compound which stand liberated from said magnetic toner particles at a liberation percentage of from 0.05% to 3.00%; and a resin component having a tetrahydrofuran(THF)-insoluble matter in an amount of from 3% by weight to 60% by weight, wherein said magnetic toner is the magnetic toner according to any one of claims 2 to 34.

36. An image-forming method comprising:

a charging step of charging an image-bearing member electrostatically by applying a voltage to a charging member kept in contact with the image-bearing member, forming a contact zone between them;

an electrostatic latent image forming step of forming an electrostatic latent image on the charged surface of the image-bearing member;

a developing step of forming a toner image by developing the electrostatic latent image by causing a magnetic toner to move to the electrostatic latent image at a developing zone where an alternating electric field is kept formed; the developing zone being formed between the image-bearing member for holding thereon the electrostatic latent image and a toner-carrying member for carrying the magnetic toner on its surface which are face to face disposed leaving a preset space between them, and a layer of the magnetic toner being formed on the surface of the toner-carrying member in a thickness smaller than that space; and a transfer step of transferring the toner image to a transfer material via, or not via, an intermediate transfer member;

said steps being repeated to form images;

wherein said magnetic toner comprises magnetic toner particles containing at least a binder resin, a magnetic material containing a magnetic iron oxide, and a release agent;

said magnetic toner having;

a weight-average particle diameter of from 3 $\mu$m to 10 $\mu$m;

a magnetization intensity (saturation magnetization) of from 10 $Am^2/kg$ to 50 $Am^2/kg$ (emu/g) under application of a magnetic field of 79.6 kA/m (1,000 oersteds);

an average circularity of 0.970 or more;

a ratio of weight-average particle diameter to number-average particle diameter, of 1.40 or less; iron and an iron compound which stand liberated from the magnetic toner particles at a liberation percentage of from 0.05% to 3.00%; and a resin component having a tetrahydrofuran-insoluble matter in an amount of from 3% by weight to 60% by weight.

37. The method according to claim 36, wherein said developing step serves also as a cleaning step of collecting the magnetic toner having remained on the image-bearing member after the toner image has been transferred to the transfer material.

38. The method according to claim 36, wherein a conductive fine powder is interposedly present at least at the contact zone between the charging member and the image-bearing member, and/or in the vicinity thereof.

39. The method according to claim 36, wherein said image-bearing member is charged when a conductive fine powder is interposedly present in an amount of $1\times10^3$ particles/$mm^2$ or more, at least at the contact zone between the charging member and the image-bearing member.

40. The method according to claim 36, wherein the charging member which forms said contact zone has a difference in speed between the movement speed of its surface and the movement speed of the surface of the image-bearing member.

41. The method according to claim 36, wherein said image-bearing member is charged while the charging member and the image-bearing member move in the direction opposite to each other.

42. The method according to claim 36, wherein said charging member is a roller member having an Asker-C hardness of 50 degrees or less, and said image-bearing member is charged by applying a voltage to this roller member.

43. The method according to claim 36, wherein said charging member is a roller member whose surface has concavities having an average cell diameter of from 5 $\mu$m to 300 $\mu$m in terms of that of a sphere and, the concavities being regarded as voids, having a surface void volume of from 15% to 90%, and said image-bearing member is charged by applying a voltage to this roller member.

44. The method according to claim 36, wherein said charging member has a volume resistivity of from $1\times10^3$ $\Omega\cdot$cm to $1\times10^8$ $\Omega\cdot$cm, and said image-bearing member is charged by applying a voltage to this charging member.

45. The method according to claim 36, wherein said charging member is a brush member having a conductivity, and said image-bearing member is charged by applying a voltage to this brush member.

46. The method according to claim 36, wherein, in said charging step, said image-bearing member is contact charged by applying a direct voltage or a voltage formed by superimposing on a direct voltage an alternating voltage having a peak-to-peak voltage less than 2×Vth (Vth: discharge start voltage under application of direct voltage) (V).

47. The method according to claim 36, wherein said image-bearing member is contact charged by applying a direct voltage or a voltage formed by superimposing on a direct voltage an alternating voltage having a peak-to-peak voltage less than Vth (V).

48. The method according to claim 36, wherein said image-bearing member has an outermost surface layer having a volume resistivity of from $1\times10^9$ $\Omega\cdot$cm to $1\times10^{14}$ $\Omega\cdot$cm.

49. The method according to claim 36, wherein said image-bearing member has an outermost surface layer which is a resin layer in which at least conductive fine particles having a metal oxide have been dispersed.

50. The method according to claim 36, wherein said image-bearing member has a surface having a contact angle to water of 85 degrees or more.

51. The method according to claim 36, wherein said image-bearing member has an outermost surface layer which is a resin layer in which at least one lubricant fine particles selected from fluorine resin particles, silicone resin particles and polyolefin resin particles have been dispersed.

52. The method according to claim 36, wherein said image-bearing member is a photosensitive member that is formed from a photoconductive material.

53. The method according to claim 36, wherein said electrostatic latent image is formed on the image-bearing member by imagewise exposure.

54. The method according to claim 36, wherein said toner image is formed by forming on the toner-carrying member a layer of the magnetic toner in an amount of from 5 $g/m^2$ to 50 $g/m^2$, and transferring the magnetic toner to the image-bearing member from the layer of the magnetic toner.

55. The method according to claim 36, wherein said space between the image-bearing member and the toner-carrying member is from 100 $\mu$m to 1,000 $\mu$m.

56. The method according to claim 36, wherein said toner image is formed by causing the magnetic toner to move to the electrostatic latent image on the image-bearing member by applying an alternating voltage to the toner-carrying member, and the alternating voltage has a peak-to-peak electric field intensity of from $3\times10^6$ V/m to $10\times10^6$ V/m and a frequency of from 500 Hz to 5,000 Hz.

57. The method according to claim 36, wherein a transfer member comes into contact with the image-bearing member via the transfer material at the time of transfer, and the toner image on the image-bearing member is transferred to the transfer material.

* * * * *

UNITED STATES PATENT AND TRADEMARK OFFICE

CERTIFICATE OF CORRECTION

PATENT NO. : 6,596,452 B2
DATED : July 22, 2003
INVENTOR(S) : Michihisa Magome et al.

It is certified that error appears in the above-identified patent and that said Letters Patent is hereby corrected as shown below:

Title page,
Item [56], References Cited, FOREIGN PATTERN DOCUMENTS,
"2/120865 5/1990" should read -- 2-120865 5/1990 --; and
"63-250660 10/1998" should read -- 63-250660 10/1988 --.
Item [75] Inventors,
"Tsutomu Kukimoto, Kanagawa-ken (JP); Tsuyoshi Takiguchi, Kanagawa-ken (JP); Akira Hashimoto, Shizuoka-ken (JP); Keiji Komoto, Shizuoka-ken (JP)" should read -- Tsutomu Kukimoto, Yokohama (JP); Tsuyoshi Takiguchi, Shizuoka (JP); Akira Hashimoto, Mishima (JP); Keiji Komoto, Numazeu (JP) --.

Column 1,
Line 52, "make" should read -- make the --.

Column 3,
Line 20, "disclose," should read -- discloses, --.

Column 5,
Line 35, "mount" should read -- amount --.

Column 7,
Line 18, "state" should read -- stated --.

Column 8,
Line 54, "rub" should read -- rubs --.

Column 9,
Line 54, "even if even" should read -- even if --; and
Line 60, "areass" should read -- areas --.

Column 10,
Line 25, "no" should read -- any --;
Line 26, "less cause" should read -- cause less --;
Line 50, "be" should read -- been --; and
Line 59, "taking" should read -- taken --.

Column 12,
Line 28, "fine" should read -- fine powder --.

UNITED STATES PATENT AND TRADEMARK OFFICE

CERTIFICATE OF CORRECTION

PATENT NO. : 6,596,452 B2
DATED : July 22, 2003
INVENTOR(S) : Michihisa Magome et al.

It is certified that error appears in the above-identified patent and that said Letters Patent is hereby corrected as shown below:

Column 13,
Line 3, “objects” should read -- objects, --;
Lines 5 and 50, “agent.” should read -- agent; --;
Line 42, “space; and” should read -- space; --;
Line 45, “ber;” should read -- ber; and --;
Line 46, “images;” should read -- images, --; and Column 16,
Line 7, “complicate” should read -- complicated --.

Column 17,
Line 24, “compound” should read -- compounds --.

Column 18,
Line 40, “brings” should read -- bring --.

Column 19,
Line 1, “minuter” should read -- minute --; and
Line 40, “has also” should read -- also has --.

Column 20,
Line 21, “mean” should read -- means --.

Column 22,
Line 64, “caused” should read -- cause --.

Column 27,
Line 37, “pH of” should read -- pH --.

Column 29,
Line 28, “material” should read -- materials --.

Column 30,
Line 55, “K.K.” should read -- K.K.) --.

Column 31,
Line 54, “$W_4$)]100” should read -- $W_4$)] x 100 --.

Column 32,
Lines 3-7, “” should be deleted.

UNITED STATES PATENT AND TRADEMARK OFFICE

CERTIFICATE OF CORRECTION

PATENT NO. : 6,596,452 B2
DATED : July 22, 2003
INVENTOR(S) : Michihisa Magome et al.

It is certified that error appears in the above-identified patent and that said Letters Patent is hereby corrected as shown below:

Column 35,
Line 26, "such as" should read -- such as a styrene-acrylic copolymer, which may be cross-linked, where useful styrene-acrylic copolymers include, e.g., --; and
Line 35, "acrylate copolymer" should read -- acrylate copolymer, such styrene-acrylic copolymers and a polyester resin, where the resin may be saturated or unsaturated, --.

Column 36,
Line 17, "cunyl" should read -- cumyl --;
Line 41, "is" should read -- are --; and
Line 48, "including," should read -- includes, --.

Column 40,
Line 12, "any" should be deleted.

Column 45,
Line 23, "if" should read -- If --.

Column 46,
Lines 13 and 20, "particle" should read -- particles --; and
Line 21, "preferably" should read -- preferably be --.

Column 47,
Line 10, "almost" should read -- almost all --; and
Line 50, "kvpp" should read -- kVpp --.

Column 50,
Line 39, "powder;" should read -- powder: --.

Column 52,
Line 23, "designed" should read -- be designed --; and
Line 62, "be not" should read -- not be --.

Column 53,
Line 32, "are" should read -- is --.

Column 55,
Line 15, "about" should read -- about a --.

Column 60,
Line 32, "be" should read -- not --; and
Line 33, "not" should read -- be --.

UNITED STATES PATENT AND TRADEMARK OFFICE

CERTIFICATE OF CORRECTION

PATENT NO. : 6,596,452 B2
DATED : July 22, 2003
INVENTOR(S) : Michihisa Magome et al.

It is certified that error appears in the above-identified patent and that said Letters Patent is hereby corrected as shown below:

Column 61,
Line 12, "85%." should read -- 85%.¶ Production example 2 of a surface-treated magnetic material¶ A surface-treated magnetic material 2 was obtained in the same manner as in production example 1 except that n-$C_4H_{13}Si(OCH_3)_3$ was used as a silane coupling agent in production example 1 of a surface-treated magnetic material. The hydrophobicity of the magnetic material was 78%. --.

Column 63,
Line 62, "compound" should read -- compound) --.

Column 64,
Line 47, "Table 2." should read -- Table 2.¶ Production of magnetic toner 4¶ A magnetic toner 4 was produced in the same manner as in the production example of magnetic toner 3 except that surface-treated magnetic powder 2 was used. The physical properties of magnetic toner 4 are shown in Table 2. --.

Column 67,
Line 22, "minute" should read -- minutes --.

Column 68,
Line 35, "of-the" should read -- of the --.

Column 71,
Line 44, "7 βm)" should read -- 7 μm) --.

Column 72,
Line 44, "above described" should read -- above-described --.

Column 73,
Line 35, "toners 2, 3, and 5-16" should read -- toners 2-16 --.

Column 74,
Line 50, "acts" should read -- acts as --.

Column 75,
Line 36, "60%. Image" should read -- 60%. ¶Image --;
Line 47, "1" should be deleted;
Lines 53 and 57, "above described" should read -- above-described --; and
Line 61, "force n" should read -- force. n --.

UNITED STATES PATENT AND TRADEMARK OFFICE

CERTIFICATE OF CORRECTION

PATENT NO. : 6,596,452 B2 
DATED : July 22, 2003
INVENTOR(S) : Michihisa Magome et al.

It is certified that error appears in the above-identified patent and that said Letters Patent is hereby corrected as shown below:

Column 76,
Lines 3 and 18, "above described" should read -- above-described --;
Lines 4 and 30, "1" should be deleted; and
Line 47, "βm)" should read -- μm) --.

Column 78,
Line 6, "above described" should read -- above-described --.

Column 79,
Line 15, "lowly" should read -- low --; and
Line 36, "become" should read -- becomes --.

Column 80,
Lines 19 and 45, "above described" should read -- above-described --; and
Line 49, "replace" should read -- replaces --.

Column 81,

"

Table 1

| | Treating agent | Amount (pbw) | Hydrophobicity (%) |
|---|---|---|---|
| Surface-treated magnetic material 1 | "$C_{10}H_{21}Si(OCH_3)3$" | 2 | 85 |
| Surface-treated magnetic material 3 | "$C_4H_{13}Si(OCH_3)3$" | 2 | 78 |

"

should read

--

Table 1

| | Treating agent | Amount (pbw) | Hydrophobicity (%) |
|---|---|---|---|
| Surface-treated magnetic material 1 | "$C_{10}H_{21}Si(OCH_3)3$" | 2 | 85 |
| Surface-treated magnetic material 7 | "$C_4H_{13}Si(OCH_3)3$" | 2 | 78 |
| Surface-treated magnetic material 3 | "$C_{18}H_{37}Si(OCH_3)3$" | 2 | 93 |

--; and

Table 2, should read

--

Table 2

| Magnetic toner | Magnetic material used | (pbw) | Release agent | (pbw) | Toner average particle diam (DM) (μm) | D4/D1 | Average circularity | Mode circularity | (A) (μm) | (B) | (C) | (D) (%) | (E) (%) | (F) (%) | GPC main peak molecular weight |
|---|---|---|---|---|---|---|---|---|---|---|---|---|---|---|---|
| 1 | ST1 | 90 | ES | 10 | 7.3 | 1.22 | 0.981 | 1.00 | 0.19 | 10 | 0.24 | 0.62 | 29.4 | 24 | 22,000 |
| 2 | ST1 | 90 | " | 10 | 7.3 | 1.22 | 0.981 | 1.00 | 0.19 | 10 | 0.25 | 0.64 | 35.8 | 24 | 22,000 |
| 3 | ST1 | 90 | " | 10 | 7.3 | 1.22 | 0.981 | 1.00 | 0.19 | 10 | 0.24 | 0.63 | - | 24 | 22,000 |
| 4 | ST2 | 90 | " | 10 | 7.1 | 1.23 | 0.980 | 1.00 | 0.19 | 10 | 0.57 | 0.65 | - | 21 | 24,000 |
| 5 | ST3 | 90 | " | 10 | 7.6 | 1.20 | 0.982 | 1.00 | 0.19 | 10 | 0.16 | 0.64 | - | 26 | 20,000 |
| 6 | ST4 | 90 | " | 10 | 7.2 | 1.27 | 0.981 | 1.00 | 0.19 | 10 | 0.75 | 0.62 | - | 23 | 22,000 |
| 7 | ST5 | 90 | " | 10 | 7.0 | 1.31 | 0.980 | 1.00 | 0.19 | 10 | 1.14 | 0.64 | - | 26 | 20,000 |
| 8 | ST6 | 90 | " | 10 | 6.9 | 1.34 | 0.978 | 1.00 | 0.19 | 10 | 1.48 | 0.63 | - | 22 | 23,000 |
| 9 | ST7 | 90 | " | 10 | 6.8 | 1.36 | 0.975 | 1.00 | 0.19 | 10 | 1.92 | 0.66 | - | 23 | 22,000 |
| 10 | ST8 | 90 | " | 10 | 6.4 | 1.39 | 0.971 | 1.00 | 0.19 | 10 | 2.73 | 0.64 | - | 25 | 21,000 |

ST: Surface-treated magnetic material
UT: (Untreated) magnetic material
ES: Ester wax
(A): Average particle diameter of magnetic material
(B): Volume-average variation coefficient of magnetic material
(C): Liberation percentage of iron compound
(D): Liberation percentage of silica
(E): Liberation percentage of conductive fine powder
(F): THF-insoluble matter

--.

UNITED STATES PATENT AND TRADEMARK OFFICE

CERTIFICATE OF CORRECTION

PATENT NO. : 6,596,452 B2
DATED : July 22, 2003
INVENTOR(S) : Michihisa Magome et al.

It is certified that error appears in the above-identified patent and that said Letters Patent is hereby corrected as shown below:

Column 94,
Line 34, “form” should read -- from --;
Line 54, “comprising;” should read -- comprising:--; and
Line 67, “formed; the” should read -- formed; ¶the --.

Column 95,
Line 15, “agent; said” should read -- agent; --;
Line 19, “(emulg)” should read -- (em/g) --; and
Line 21, “oersteds); an” should read -- oersteds); ¶an --.

Column 96,
Line 3, “less, iron” should read -- less; ¶iron --.

Signed and Sealed this

Fourteenth Day of September, 2004

JON W. DUDAS
*Director of the United States Patent and Trademark Office*